US006751423B2

(12) United States Patent
Sakaizawa et al.

(10) Patent No.: US 6,751,423 B2
(45) Date of Patent: Jun. 15, 2004

(54) DEVELOPING APPARATUS AND IMAGE FORMING APPARATUS

(75) Inventors: Katsuhiro Sakaizawa, Numazu (JP); Satoshi Tsuruya, Mishima (JP); Seiichi Shinohara, Mishima (JP); Masahiro Shibata, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/295,917

(22) Filed: Nov. 18, 2002

(65) Prior Publication Data

US 2003/0128997 A1 Jul. 10, 2003

(30) Foreign Application Priority Data

Dec. 28, 2001 (JP) ..... 2001-401053
Feb. 15, 2002 (JP) ..... 2002-039021
Jul. 26, 2002 (JP) ..... 2002-218205

(51) Int. Cl.[7] ..... G03G 15/08
(52) U.S. Cl. ..... 399/55; 399/284; 399/285
(58) Field of Search ..... 399/53, 55, 284, 399/285, 270, 274

(56) References Cited

U.S. PATENT DOCUMENTS 5,519,472 A 5/1996 Ojima et al. ..... 399/274
5,570,166 A 10/1996 Ohzeki et al. ..... 399/270

FOREIGN PATENT DOCUMENTS

JP 58-153972 9/1983
JP 5-11599 1/1993

*Primary Examiner*—Arthur T. Grimley
*Assistant Examiner*—Ryan M Gleitz
(74) *Attorney, Agent, or Firm*—Fitzpatrick, Cella, Harper & Scinto

(57) ABSTRACT

A developing apparatus includes a developer carrying member for carrying a developer to develop an electrostatic image formed on an image bearing member with the developer; a developer regulating member regulates an amount of the developer carried on the developer carrying member; and a controller for controlling a potential difference between the developer carrying member and the developer regulating member such that the potential difference is larger in at least a part of non-developing operation than in a developing operation when the developer carrying member carries the developer.

36 Claims, 23 Drawing Sheets

(a)

(b)

DEVELOPING APPARATUS AND IMAGE FORMING APPARATUS

FIELD OF THE INVENTION AND RELATED ART

The present invention relates to an image forming apparatus such as a copying machine, a printer, etc., which employs an electrophotographic or electrostatic recording method. It also relates to a developing apparatus suitable for an image forming apparatus employing such a developing apparatus.

In the past, as an electrophotographic employing an electrophotographic or electrostatic recording method, an apparatus having the structure shown in FIG. 18 has been known. FIG. 18 is a schematic drawing of an example of image forming apparatus in accordance with the prior art, for showing the basic structure thereof.

In the case of this image forming apparatus, a photoconductive drum 100 is employed as an image bearing member. The photoconductive drum 100 comprises: a cylindrical substrate formed of, for example, aluminum; and a photoconductive layer (organic photoconductive layer, for example) coated on the peripheral surface of the cylindrical substrate. It is rotationally driven. Disposed around the photoconductive drum 100 are a charge roller 101, an unshown laser beam type scanning optical system, a developing device 102 as a developing means, a transfer roller 111, and a cleaner 109, which are listed in order, in terms of the rotational direction of the photoconductive drum 100.

After the peripheral surface of the photoconductive drum 100 is uniformly charged by the charge roller 101, it is exposed to the beam of laser light projected in the scanning manner from the unshown optical system. As a result, an electrostatic latent image is formed on the peripheral surface of the photoconductive drum 100. This electrostatic latent image is visualized (developed) with the use of the toner (developer) in the developing device.

Recording medium, which in this case is a piece of transfer medium P, is fed into the main assembly of an image forming apparatus, through an unshown sheet feeding opening, and is delivered, in synchronism with the above described formation of the visible image (toner image), to the area in which the peripheral surfaces of the photoconductive drum 100 and transfer roller 111 are virtually in contact with each other, and in which the visible image (toner image) is transferred onto the transfer medium P. Thereafter, the image on the transfer medium P is welded to the transfer medium P by a fixing device 110.

The developing device 102 comprises: a development roller 108 as a developer bearing member; a supply roller 105 for supplying nonmagnetic single-component toner (negative in inherent polarity) to the development roller 103; a stirring member 106 for conveying the toner within the container to the adjacencies of the supply roller 105; a development blade 104 as a developer amount regulating member for regulating the amount of the toner on the peripheral surface of the development roller 103; etc.

Since the development roller 103 is placed in contact with the photoconductive drum 100, it is formed of elastic substance. The development blade 104 is placed in contact with the peripheral surface of the development roller 103, with the use of the resiliency of a piece of thin springy metallic plate, generating a small amount of contact pressure against the peripheral surface of the development roller 103.

In order to transfer the toner from the development roller 103 onto the photoconductive drum 100, development bias is applied to the development roller 103 from a development bias power source 107 so that the development roller 103 is charged to a predetermined potential level. Further, in order to stabilize the electric charge of the toner, a blade bias power source 108 is connected to the development blade 104, and blade bias is applied to the development blade 104 so that the development blade 104 is charged to a predetermined potential level (Japanese Laid-open Patent Application 05-011599). There are various blade bias power sources (108); for example, those which are identical in potential as the development bias 107, those which are different in potential from the development bias 107, etc.

As described above, in the case of an image forming apparatus in accordance with the prior art (which hereinafter may be referred to as a conventional image forming apparatus), fixed DC bias or AC bias is applied to the development blade 104 in an attempt to stabilize the toner in terms of electric charge, manner in which the toner is coated, etc.

However, in the case of a conventional image forming apparatus, it was difficult to stabilize the toner coat while preventing the toner from scattering, preventing the reversal toner from solidifying on the development blade, and also, preventing the toner from welding itself to the development blade.

For example, when an image forming operation was carried out using one of the conventional image forming apparatuses, the following problems could be observed.

Firstly, when the potential of the development bias power source 107 was rendered the same as that of the blade bias power source 108, the image forming apparatus began to form images irregular in density, more specifically, images having unwanted vertical streaks across the halftone areas thereof, after the formation of approximately 1,000 copies. The streaks similar to the vertical streaks of the images were found also on the portion of the peripheral surface of the development roller 103, on the immediately downstream side with respect to the development blade 104, in terms of the rotational direction of the development roller 103.

The visual examination of the development blade 104 revealed that agglomerations of toner had welded to the area a (area next to downstream border of contact area between development blade 104 and development roller 103, in terms of rotational direction of development roller 103) of the development blade 104. Obviously, the toner particles in the toner layer, the positions of which corresponded to those of the agglomerations of the toner welded to the development blade 104, were blocked by the agglomerations. As a result, the toner layer on the peripheral surface of the development roller 103 became thinner, across the areas corresponding in position to the areas of the development blade 104 having the toner agglomerations, effecting therefore images suffering from density anomaly in the form of unwanted vertical streaks.

The cause of the above described problem will be described with reference to FIG. 19 which is a schematic drawing for showing the process in which the toner particles weld in agglomeration to the development blade. Designated by a referential code T are negatively charged nonmagnetic single-component toner particles. The developer is a mixture of the toner particles T and external additive particles G1 as auxiliary particles.

The toner particles borne on the peripheral surface of the development roller 103 are negatively charged particles. In the normal ambience, after passing the development blade 104, the potential of the toner layer on the peripheral surface of the development roller 103 is in the range of approximately −20−−50 V (measured with Surface Potentiometer Model 1334: Treck Co., Ltd.). In the contact area between the development roller 103 and development blade 104, the surface of the development blade 104 is constantly rubbed by the toner particles. Therefore, the external additive particles are not likely to remain adhered to the surface of the development blade 104.

However, on the downstream side of the contact area between the development roller 103 and development blade 104 (area a in drawing), the distance between the toner layer and the surface of the development blade 104 gradually increases, creating potential gradient.

In other words, even though the development roller 103 and development blade 104 remain the same in potential, the surface portion of the toner layer on the peripheral surface of the development roller 103 becomes greater in negative potential than the development blade 104, because of the potential of the negatively charged toner particles in the toner layer on the development roller 103.

Thus, the negative charged external additive particles G1 in the surface portion of the toner layer move away from the layer, and adhere to the area a of the surface of the development blade 104. The amount of these external additive particles G1 adhering to the area a of the surface of the development blade 104 gradually increases with the increase in the cumulative usage of the image forming apparatus, substantially increasing the apparent roughness of the surface of the development blade 104.

Then, the roughened surface of the development blade 104 is rubbed by the toner layer. As a result, some of the toner particles in the toner layer are welded in agglomeration to the surface of the development blade 104 by the frictional heat. This is the theory behind the welding, in agglomeration, of toner particles to the surface of the development blade 104.

In the case of the conventional image forming apparatus disclosed in Japanese Laid-open Patent Application 05-011599, a voltage of −300 V is constantly supplied to the development roller 103 from the development bias power source 107, and a voltage of −400 V is supplied to the development blade 104 from the blade bias power source 108, creating a potential difference of approximately 100 V between the development roller 103 and development blade 104. Therefore, the negatively charged external additive particles G1 do not move away from the surface of the toner, in spite of the electric charge which the toner layer has.

However, when a potential difference was provided between the development roller 103 and development blade 104 as disclosed in Japanese Laid-open Patent Application 05-011599, the follow problems occurred.

For example, after the formation of approximately 1,500 copies, the image forming apparatus began to form copies which were low in density across the solid areas and/or suffered from unwanted vertical streaks. This problem was found also on the portion of the peripheral surface of the development roller 103, on the immediately downstream side of the contact area between the development roller 103 and development blade 104, in terms of the rotational direction of the development roller 103.

The visual examination of the development blade 104 carried out to find the causes of this problem revealed that the toner particles had adhered to the entirety of the area b (area next to upstream border of contact area between development blade 104 and development roller 103) of the development blade 104, although having not been welded thereto, but having adhered fast enough to make it impossible to blow them away with the use of an air brush or the like. The toner particles were dammed by the agglomerations of toner particles adhering to the area b of the development blade 104. Therefore, the toner layer became thinner on the areas corresponding in position to the agglomerations, effecting therefore images suffering from the density anomaly in the form of vertical streaks.

Next, referring to FIG. 19, the effects of the change of the potential of the development roller 103 (−300 V) and development blade 104 (−400 V) will be concretely described.

As the toner particles having been given triboelectric charge by the supply roller 105 reach the area (adjacencies of area b) next to the upstream border of the contact area between the development roller 103 and development blade 104, the reversal toner particles (positively charged toner particles) in the toner layer are attracted to the area b of the surface of the development blade 104 due to the potential difference between the development roller 103 and development blade 104. The greater the potential difference between the development roller 103 and development blade 104, the greater the attraction between the reversal toner particles and the surface of the development blade 104. Therefore, in terms of the unwanted solid adhesion of the toner particles to the development blade 104, the area b is worst.

As the amount of the toner particles solidly adhering to the area b increases, the toner particles being moved in the direction of the area b by the rotation of the development roller 103 are dammed by the toner particles adhering to the area b of the development blade 104. As a result, the toner layer on the peripheral surface of the development roller 103 becomes thinner, across the areas corresponding in position to the agglomerations of the toner particles adhering to the area b of the development blade 104, effecting images which are low in density across the solid area. Further, since the amount by which the toner particles adhere to the area b of the development blade 104 are uneven in terms of its lengthwise direction, effecting the unwanted vertical streaks, in addition to the reduction in the density of the solid area.

This problem becomes particularly conspicuous when an external additive G2, which is positive in inherent polarity, in addition to the external additive G1, which is negative in inherent polarity (which hereinafter will be referred to as negative external additive) is mixed as auxiliary particulate additive into the toner. The external additive particles G2 positive in inherent polarity (which hereinafter will be referred to as positive external additive) are sometimes added to the mixture of the toner particles and the external additive negative in inherent polarity, for the purpose of stabilizing the electric charge of the toner, adjusting the fluidity of the toner, and the like. The external additive particles G2 positive in inherent polarity move in the same fashion as the aforementioned reversal toner particles. Therefore, they also adhere, as do the reversal toner particles, to the area b, or the portion of the development blade 104 in the adjacencies of the contact area between the development roller 103 and development blade 104, on the free edge side of the development blade 104 with respect to the contact area, contributing to the formation of the images which are low in density across the solid areas, and/or have unwanted vertical streaks.

Further, the surface potential level of the toner layer is affected by the condition of the ambience in which the image forming apparatus is operated; it increases as the humidity increases, and decreases as humidity decreases. Therefore, the voltage applied to the development blade 104 must be precisely controlled.

When AC bias is constantly applied to the development blade 104 as disclosed in Japanese Laid-open Patent Application 58-153972, a toner cloud is generated, by the AC bias, in the area a, that is, the area on the immediately downstream side of the contact area between the development roller 103 and development blade 104. The generation of this toner cloud results in useless scattering of the toner particles, contaminating the interior of the apparatus. Also, as AC bias is applied to the development blade 104, "attack noises" are generated by the AC bias due to the contact between the development roller 103 and development blade 104.

In the case of a conventional image forming apparatus which used nonmagnetic single-component toner, toner sometimes leaked from the developing device, soiling the recording medium surface. In particular, in the case of a conventional apparatus in which the blade bias power source and development bias power source were rendered the same in potential, the signs of toner leakage were conspicuous. Moreover, the usage of nonmagnetic single-component toner, the particles of which are high in the degree of sphericity, more frequently caused toner leak due to the higher toner fluidity, although it resulted in the formation of images superior in dot reproducibility.

It is thought that this toner leak occurred for the following reason:

The toner particles are borne on, and remain adhered to, the development roller 103 due to the electric charge of the toner particles and the physical attraction between the toner particles and development roller 103. Therefore, when the toner particles are not uniform in the amount of electric charge, that is, when the toner layer contains toner particles with a smaller amount of electric charge and toner particles with a larger amount of electric charge, the toner particles with a smaller amount of electric charge are not as firmly held to the development roller 103 as the toner particles with a larger amount of electric charge, and therefore, they leak.

The detailed examination of the leaked toner particles with a smaller amount of electric charge revealed that the leaked toner particles are agglomerations of the reversal toner particles, that is, positively charged toner particles, and the normal toner particles, that is, negatively charged toner particles.

SUMMARY OF THE INVENTION

The primary object of the present invention is to provide a developing apparatus and an image forming apparatus, in which developer does not solidly adhere, nor weld, to the developer regulating member thereof.

Another object of the present invention is to provide a developing apparatus and an image forming apparatus, in which the amount by which developer is borne on the developer bearing member remains constant.

Another object of the present invention is to provide a developing apparatus and an image forming apparatus, in which developer does not leak during image formation.

Another object of the present invention is to provide a developing apparatus and an image forming apparatus, which are capable of reliably form, for a long period of time, images which do not suffer from the insufficient density and unwanted vertical streaks.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
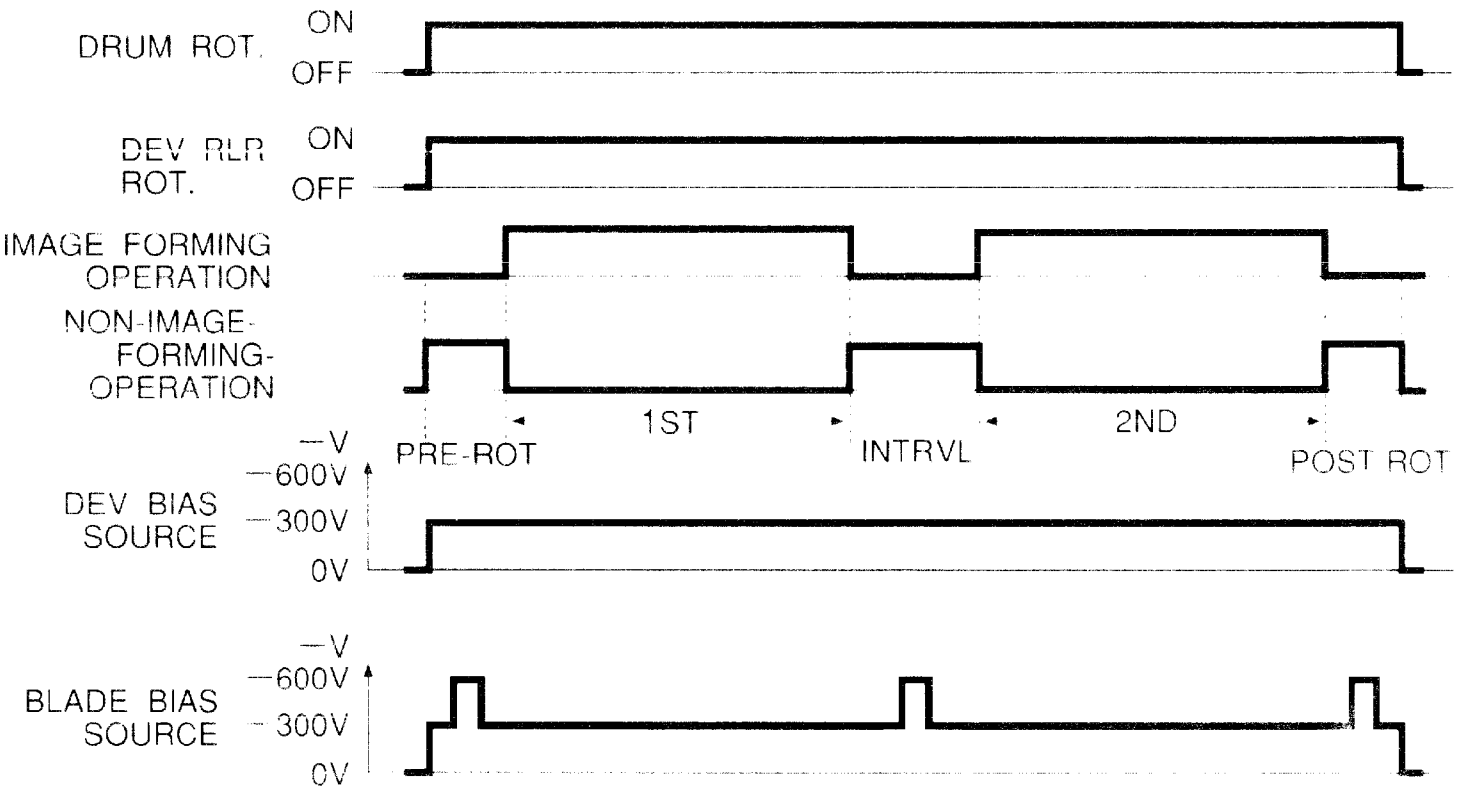
FIG. 1 is a diagram of the image formation sequence in the first embodiment of the present invention.

Hereinafter, the preferred embodiments of an image forming apparatus and a process cartridge in accordance with the present invention will be described in detail with reference to the appended drawings.

In the case of a conventional image forming apparatus, the toner layer and toner particles therein are stabilized, in their properties such as electric charge given to the toner particles, by the application of fixed DC bias or AC bias. However, it was difficult for a conventional image forming apparatus to stabilize the toner coat while preventing the toner particles therein from scattering, preventing reversal toner particles from solidly adhering to the development blade, and also, preventing the toner particles therein from welding to the development blade.

This embodiment is characterized in that control is executed so that while the development roller (developer bearing member) is rotated during the image formation period (development period), the development roller and development blade (developer regulating member) remain approximately the same in potential, whereas during at least a part of the non-image formation period (non-development period), that is, the period in which an image is not formed (while image is not developed), potential difference is provided between the development roller and development blade. In other words, the external additive particles adhering to the development blade are removed during the non-image formation period; the development blade is rejuvenated during the non-image formation period.

It is desired that when creating a predetermined amount of potential difference between the development roller and development blade during at least a part of the non-image formation period, control is executed so that the potential of the development blade is made greater than that of the development roller by increasing the potential of the development blade while keeping the development roller and development blade on the same side as the developer in terms of polarity. This is for the following reason. That is, the external additive, which is the same in polarity as the toner particles, is mixed into the toner by an amount greater than the amount by which the external additive opposite in polarity to the toner particles is mixed into the toner. Therefore, the probability that the external additive the same in polarity to the toner particles adheres to the development blade is greater than the probability that the external additive opposite in polarity to the toner particles adheres to the development blade. However, when the probability that the external additive opposite in polarity to the toner particles adheres to the development blade is greater than the probability that the external additive the same in polarity to the toner particles adheres to the development blade, such voltage that is opposite in polarity to the toner particles and greater in potential may be applied.

Here, "an image formation period" means a period in which the developing means is developing a latent image into a visible image, which is to be transferred onto the image formation area (area exclusive of margins) of transfer medium, and "a non-image formation period" means a period which is any of the periods other than the image formation period, and in which a latent image is not developed even though the development roller is rotating, for example, the period in which the margin portions of recording medium is passed through the development station (during this period, visible image is not formed), the period in which the image bearing member is preparatorily rotated prior to the beginning of the actual image formation process, the period in which the image bearing member is preparatorily rotated immediately after the completion of the actual image formation process, the interval (sheet interval), in time, between the consecutive two transfer mediums during the production of multiple copies, the pre-rotation period in which the image bearing member is preparatorily rotated a multiple number of time immediately after the power is turned on, etc.

Figure 19:
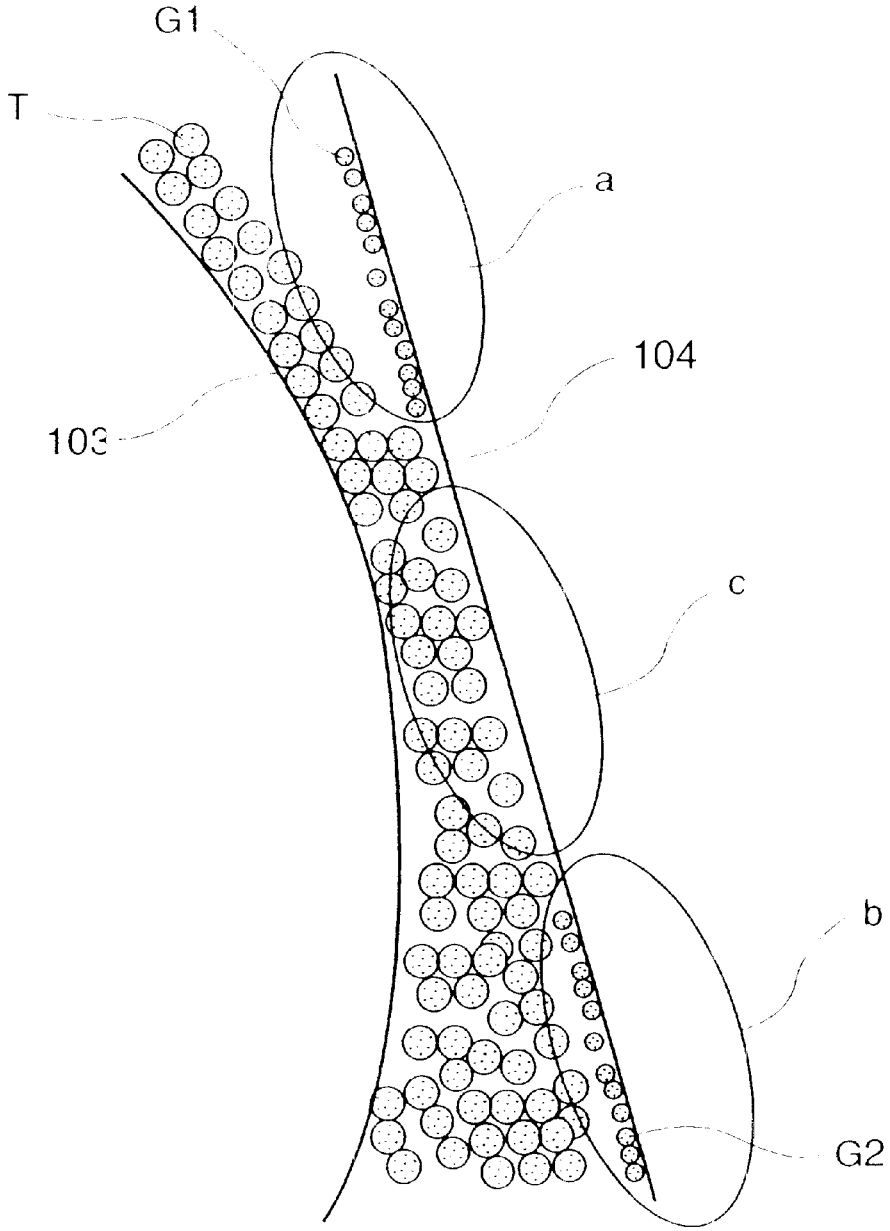
PRIOR ART FIG. 19
FIG. 19 is a schematic drawing for describing the welding of toner particles to the development blade of a developing device in accordance with the prior art.

In other words, in this embodiment, in order to prevent the toner particles from solidly adhering to, or welding to, the development blade, the negatively charged external additive particles having adhered to the development blade (area a in FIG. 19) during the image formation period in which the development roller and development blade are approximately the same in potential, are transferred from the development blade onto the development roller to rejuvenate the development blade, during one of the non-image formation periods.

To describe more specifically this development blade rejuvenating operation, while a voltage of −300 V, for example, is applied to the development roller during one of the non-image formation periods, that is, the period in which a portion of a transfer medium equivalent to the margin portion of an image is moved through the development station, preparatory pre-rotation period in which the image bearing member is preparatorily rotated before the actual image formation process, preparatory post-rotation period in which the image bearing member is preparatorily rotated after the completion of the actual image formation process, sheet interval period, etc., a voltage greater than −300 V (for example, voltage within range of −400 V—900 V) is applied to the development blade for a short time, in order to return the negatively charged external additive particles having adhered to the development blade during the image formation period, to the development roller.

With the employment of the above described process, the external additive particles having adhered to the development blade during the image formation period in which the development roller and development blade are approximately equal in potential, do not accumulate on the development blade. Without the accumulation of the external additive particles on the development blade, the apparent surface roughness of the development blade is not increased by the external additive particles. Therefore, the toner particles are not captured by the development blade. Therefore, the toner particles do not weld to the development blade (area a in FIG. 19).

In this embodiment, "approximately equal in potential" means the potential difference between the blade bias and development bias is no more than ±60 V. For example, if the potential of the development blade is no more than −240 V when the development bias is −300 V, the amount by which toner passes the development blade substantially decreases, making it difficult to effect a satisfactory level of image density. On the contrary, if the development blade bias is no less than −360 V when the development bias is −300 V, it is easier for the positively charged external additive particles, which will be described later, to adhere to the development blade, which is a problem, because, as the positively charged external additive particles adhere to the portion of the development blade in the adjacencies of the contact area between the development roller and development blade, on the free edge side of the development blade with respect to the contact area, they dam the toner particles as the toner particles enter the contact area, and the damming of the toner particles in the contact area effects images suffering from the density anomaly in the form of the vertical streaks.

Further, the development blade rejuvenating process is carried out in a short time during one of the non-image formation periods. Therefore, even if the reversal toner particles and/or positively charged external additive particles adhere to the free edge side (area b in FIG. 19) of the development blade, the development bias returns them to the development roller, preventing them from accumulating on the development blade, being therefore prevented from effecting image defects such as abnormally low image density, unwanted vertical streaks, etc.

In this embodiment, it is particularly important that the development roller is rotating while the potential difference is provided between the development roller and development blade during one of the non-image formation periods. This is for the following reason. That is, if the potential difference is provided while the development roller is not rotating, the positively charged external additive particles sometimes adhere again to the development blade. While the development roller rotates, the positively charged external additive particles having been returned to the development roller are moved away from the downstream border (area a in FIG. 19) of the contact area between the development roller and development blade, by the rotation of the development roller, being prevented from adhering again to the development blade.

The potential difference provided between the development roller and development roller during the non-image formation period is desired to be in the range of 60 V–500 V, for the following reason. If the potential difference is no more than 60 V, it is impossible for the potential difference to transfer the negatively charged external additive particles having adhered to the development blade, onto the development roller; in other words, the potential difference is ineffective for preventing the toner particles from welding to the development blade. On the contrary, if the potential difference is no less than 500 V, it is likely to trigger electric discharge between the development roller and development blade, and also, it increases the electric current which flows between the development blade and development roller, necessitating an electric power source of a higher capacity.

Further, in this embodiment, two or more particulate auxiliary additives may be used as the particulate auxiliary additives for toner. In particular, it is desired that one of the two or more particulate auxiliary additives added to toner is opposite (positive) to the toner in inherent polarity, because the addition of such a particulate auxiliary additive to the toner makes it possible to scrape away, in cooperation with the rotation of the development roller, the negatively charged external additive particles adhering to the development blade.

The values of the shape factors SF-1 and SF-2 of the toner particle measured using an image analyzing apparatus are desired to be in the ranges of 100–160 and 100–160, respectively, for the following reason. That is, when they are in these range, the friction between the development roller and development blade is substantially smaller than otherwise, generating a much smaller amount of frictional heat, and therefore, further reducing the possibility that the toner particles weld to the development blade.

Further, at least the developing means is desired to be structured as a part of a process cartridge removably mountable in the main assembly of an image forming apparatus. However, the developing means may be in the form of a discrete development cartridge, or a part of a process cartridge integrally comprising an image bearing member, a charging means, a cleaning means, etc., in addition to the developing means. With the provision of one of such structural arrangements, it is possible to reduce the amount of the labor required of an operator involved in the various image forming apparatus maintenance operations, for example, the operation for replenishing an image forming apparatus with toner, operation for replacing a developing device, the service life of which had expired, etc., simplifying thereby the operation for reliably outputting satisfactory images.

(Embodiment 1)

Next, referring to FIGS. 1–4, the first embodiment of the developing apparatus and image forming apparatus in accordance with the present invention will be described.

First, referring to FIG. 2, the image forming apparatus in this embodiment will be described. The image forming apparatus in this embodiment employs a reversal developing method, that is, a developing method in which a latent image is visualized by adhering toner particles to the exposed points of an image bearing member. More specifically, it is an image forming apparatus in which a latent image is developed by placing the developer bearing member, bearing negatively charged single-component toner particles, in contact with the image bearing member.

Figure 2:
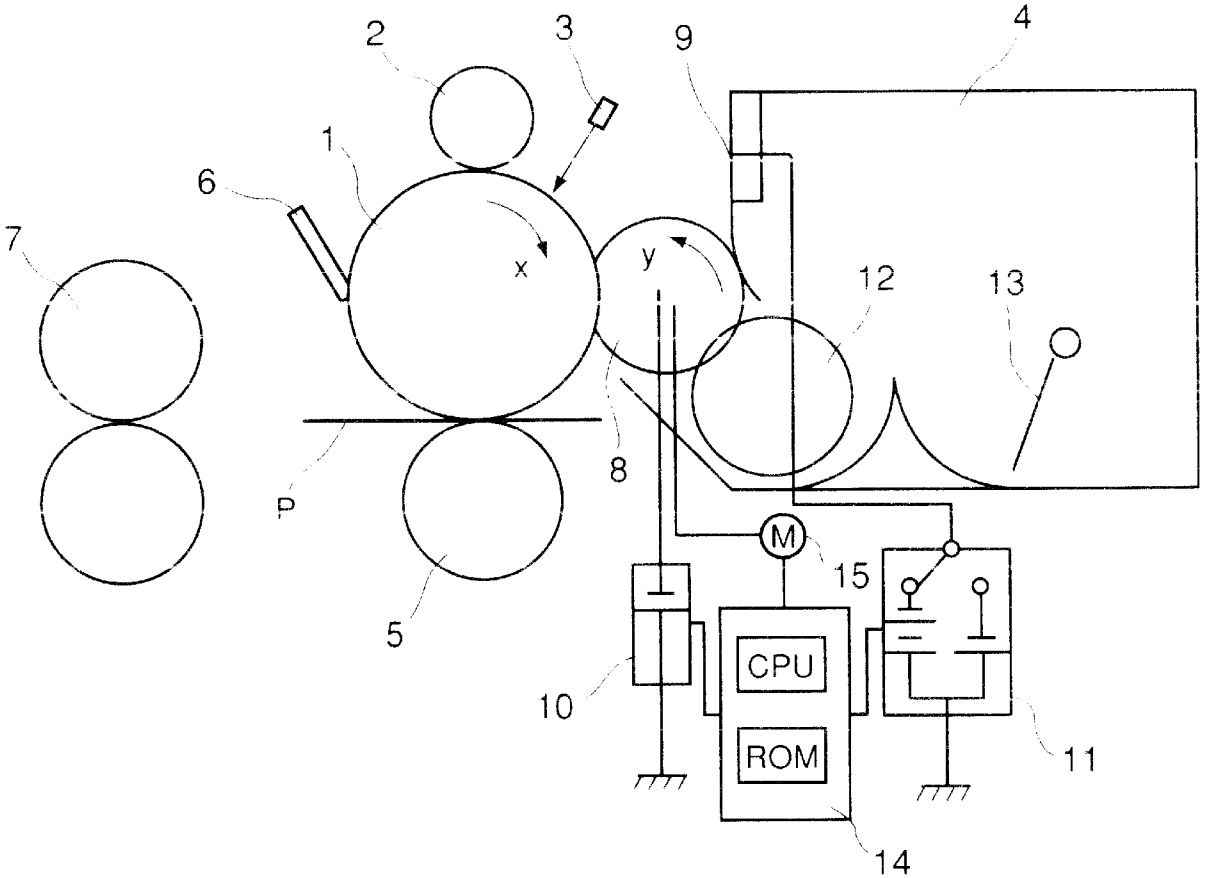
FIG. 2 is a schematic drawing of the image forming apparatus in the first embodiment of the present invention.

Also referring to FIG. 2, designated by a referential code 1 is a photoconductive drum as an image bearing member, which is rotatable in the direction indicated by an arrow mark x. As the photoconductive drum 1 is rotated, it is uniformly charged to the negative polarity by a charge roller 2 as the primary charging device, across its peripheral surface. As the photoconductive drum 1 is further rotated, numerous points of the negatively and uniformly charged portion of the peripheral surface of the photoconductive drum 1 are selectively exposed by an exposing device 3. As a result, the electric charge of each of the exposed points attenuates, effecting an electrostatic latent image on the peripheral surface of the photoconductive drum 1.

A referential code 4 stands for a developing device, which is a developing means for transferring particulate toner as developer onto the exposed points of the electrostatic latent image to visualize the electrostatic latent image. The toner used by the developing device is nonmagnetic single-component toner. The developing method employed in this embodiment is the so-called reversal developing method, which transfers toner particles onto the exposed points of the uniformly charged portion of the peripheral surface of the photoconductive drum 1.

After being transferred onto the photoconductive drum 1, the toner particles are transferred onto a piece of transfer medium P by a transfer roller 5 as a transfer charging device. The toner particles which remained on the photoconductive drum 1 without being transferred are removed from the photoconductive drum 1 by a cleaning means 6.

The toner particles on the transfer medium P are thermally welded to the transfer medium P by a fixing device 7. As a result, a permanent image is formed on the transfer medium P.

The development device 4 comprises: a development roller 8; a supply roller 12 for supplying toner to the development roller 8; a development blade 9 as a developer regulating member; and a stirring member 13 for conveying toner to the supply roller 12.

The development roller 8 is rotatable in the direction indicated by an arrow mark y by a motor 15 as a driving apparatus. The development process which the development roller 8 performs is the so-called contact development process in which the development roller 8 is placed in contact with the peripheral surface of the photoconductive drum 1. Therefore, the development roller 8 is desired to be formed of a material, such as rubber, which is elastic. To the development roller 8, a voltage of approximately −300 V is supplied from a development bias power source 10. The toner particles on the development roller 8 are transferred onto the exposed points on the photoconductive drum 1 by the potential difference between the exposed points on the photoconductive drum 1 and the voltage supplied to the development roller 8 from the development bias power source 10.

The development blade 9 is formed of a piece of thin metallic plate, and is kept in contact with the development roller 8 with the utilization of the resiliency of the development blade 9. As the material for the thin metallic plate, stainless steel, phosphor bronze, etc., can be used. In this embodiment, a piece of 0.1 mm thick plate of phosphor bronze is used. The toner layer on the development roller 8 is rubbed by the development blade 9, being thereby given triboelectric charge, while being regulated in thickness. To the development blade 9, blade bias is supplied from a blade bias power source 11.

In this embodiment, a piece of thin metallic plate is used as the material for the development blade 9. However, this does not means that the selection of the material for the development blade 9 is limited to thin metallic plate. For example, the development blade 9 may comprise a piece of thin metallic plate, and a chip of electrically conductive rubber pasted to the metallic plate, or a layer of conductive substance coated on the metallic plate, etc.

Next, the development roller 8, and the like, which characterize this embodiment, will be described.

(Structure of Development Roller)

The development roller 8 is a so-called elastic development roller, that is, a development roller which has a metallic core and an elastic layer thereon. The development roller 8 in this embodiment comprises: a stainless steel core with a diameter of 8 mm, and an approximately 4 mm thick first layer (base layer) formed of solid butadiene rubber in which carbon articles are dispersed.

The development roller 8 also comprises an approximately 10 $\mu$m thick second layer (mid layer) formed of nitrile rubber in which spherical resin particles, the diameter of which is in the range of approximately 20 $\mu$m–60 $\mu$m, are dispersed. The spherical resin particles bear the role of adjusting the surface roughness of the development roller 8.

It also comprises a third layer (surface layer) formed on the second layer. The surface layer is formed of urethane rubber adjusted in electric resistance by carbon, and is approximately 10 $\mu$m in thickness. The surface layer formed of the resinous substance is for charging the toner particles as the toner particles rub against it. Therefore, such a resinous substance that is capable of charging the toner particles to a predetermined polarity is preferable as the material for the surface layer, that is, the third layer.

(Material for Development Roller)

As for the materials for the base and mid layers of the development roller, an ordinary rubber, such as silicone rubber, butyl rubber, natural rubber, acrylic rubber, EPDM (ethylene-propylene copolymer), a mixture of the preceding rubbers, etc., can be used in addition to the previously listed rubbers.

A material having a desired electric resistance is realized by dispersing carbon resin particles, metallic particles, ionic conductor particles, or the like, in one of these rubbers. The ionic conductor particles can be made by dispersing ionic conductor, such as lithium perchlorate, quaternary ammonium salts, etc., in a binder.

When such a toner that is negative in inherent polarity is used, the preferable materials for the resinous binder for the surface layer are urethane resin, silicone resin, polyamide resin, etc. When such a toner that is positive in inherent polarity is used, the preferable materials are fluorinated resin, and the like. The surface layer material having a desired electric resistance can be obtained by dispersing the above described carbon resin particles, metallic particles, ion conductor particles, etc., in one of the above described resinous materials.

The development roller 8 in this embodiment has three layers. However, this does not means that the selection of the development roller structure must be limited to the structure in this embodiment. Further, in order to provide the development roller 8 with a desired degree of surface roughness, spheric particles are dispersed in the material for the mid layer. However, the roughness of the surface of the base layer may be utilized to provide the development roller 8 with the desired degree of roughness. In such a case, only two layers are necessary.

(Electric Resistance of Development Roller)

As for the electric resistance value of the development roller, the surface resistance, and bulk resistance (resistance in terms of thickness direction of development roller), which will be described later, are desired to be in the following ranges.

The surface resistance is desired to be in the range of $2\times10^3$ Ω–$8\times10^{14}$ Ω, preferably, $5\times10^4$ Ω–$1\times10^{12}$ Ω. If it is no more than $2\times10^3$ Ω, it is difficult to give triboelectric charge to toner particles, whereas if it is no less than $8\times10^{14}$ Ω, an unwanted pattern (ghost), that is, density anomaly, which reflects the pattern of the image formed on the photoconductive drum 1 during its preceding rotation, is likely to be formed by the residual charge resulting from the triboelectric charge given to toner particles by the development roller.

The bulk resistance is desired to be in the range of $2\times10^4$ Ω–$5\times10^8$ Ω. If it is no more than $2\times10^4$ Ω, a substantially larger amount of electric current flows through the elastic layer, necessitating a greater current capacity, whereas if it is no less than $5\times10^8$ Ω, the electric current which flows during development is likely to be impeded.

(Method for Measuring Development Roller Resistance)

(1) Method for Measuring Surface Resistance of Roller

Figure 3:
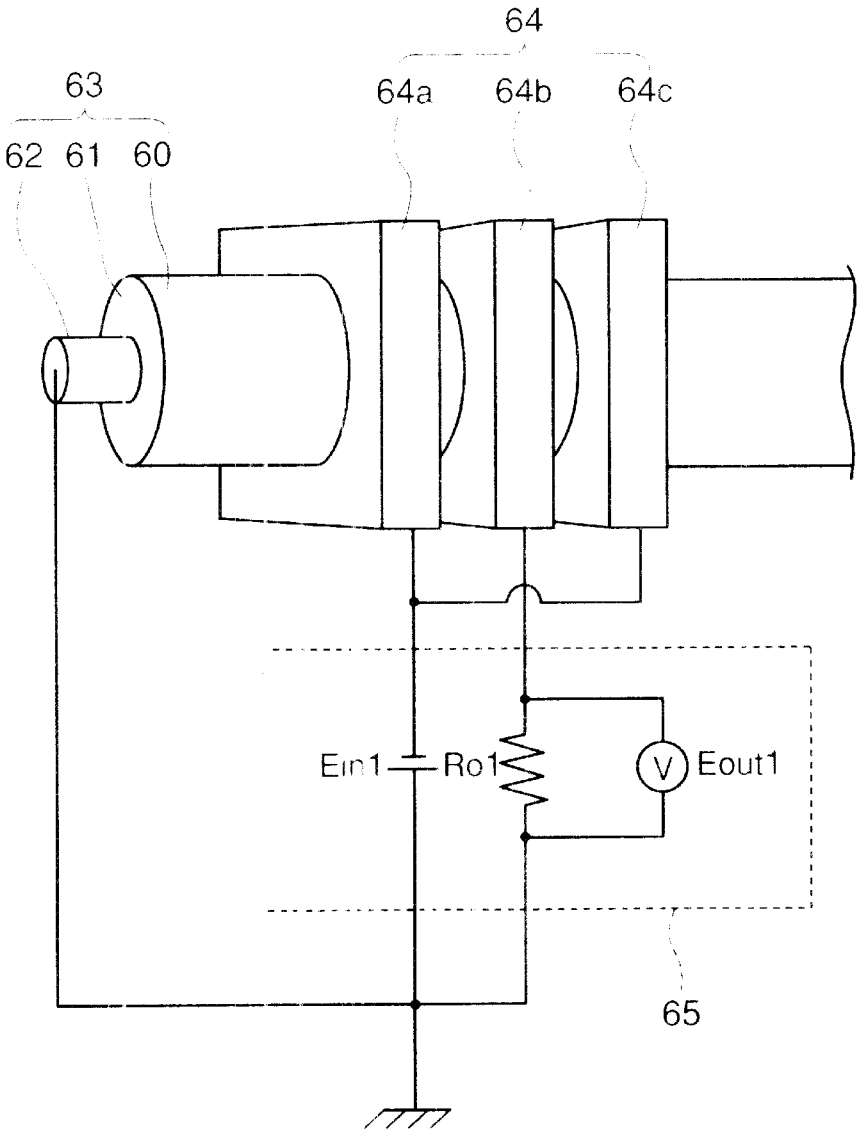
FIG. 3 is a drawing for describing the method for measuring the surface resistance of a roller.

Referring to FIG. 3, a method for measuring the surface resistance of a roller will be described. In the drawing, a referential code 63 stands for a roller, the object, the surface resistance of which is measured. The roller 63 comprises an electrically conductive metallic core 62 formed of stainless steel or the like, an elastic layer 61 formed on the peripheral surface of the metallic core 62, and a surface layer 60. In the case of a roller comprising only a single layer, that is, an elastic layer, the elastic layer 61 includes the surface layer 60.

An electrode assembly 64 comprises: electrodes 64*a* and 64*c* for applying the voltage, which will be described later, and a measurement electrode 64*b*. Each electrode is 5 mm in thickness, and has a cylindrical hole formed by cylindrically cutting through the center portion of the electrode. The internal surface of the cylindrical hole is placed in contact with the peripheral surface of the roller 63, or the object, the surface resistance of which is measured. Further, the three electrodes are disposed with 5 mm intervals.

Designated by a referential code 65 is a measurement circuit, which comprises a power source $E_{in1}$, a resistor $R_{01}$, and a voltmeter $E_{out1}$. In this embodiment, the voltage output of the power source $E_{in1}$ is 100 V (DC). The resistance $R_{01}$ is desired to be in the range of 100 Ω–10 MΩ. The resistance $R_{01}$ is for measuring weak current. Therefore, its resistance value is desired to be no less than $10^2$th–$10^4$th the surface resistance of the roller, that is, the property to be measured. For example, when the surface resistance of the roller is approximately $1\times10^8$ Ω, the preferable resistance value for the resistor $R_{01}$ is 100 kΩ.

The value of the surface resistance Rs of the roller is calculated from the following mathematical equation:

$$Rs=2\times(E_{in1}/E_{out1}/R_{01}) \quad (\Omega)$$

In the case of the measurement circuit 65, the resistance between electrodes 64*a* and 64*b*, and the resistance between electrodes 64*c* and 64*b*, are measured in parallel. Therefore, the true value of the surface resistance between two points which are 5 mm apart from each other is twice the value obtained by the measurement circuit. Thus, the resistance value obtained by the measurement circuit is multiplied by a factor of "2".

In this embodiment, the voltmeter $E_{out1}$ is read 10 seconds after the beginning of the voltage application.

(2) Method for Measuring Bulk Resistance of Roller

Figure 4:
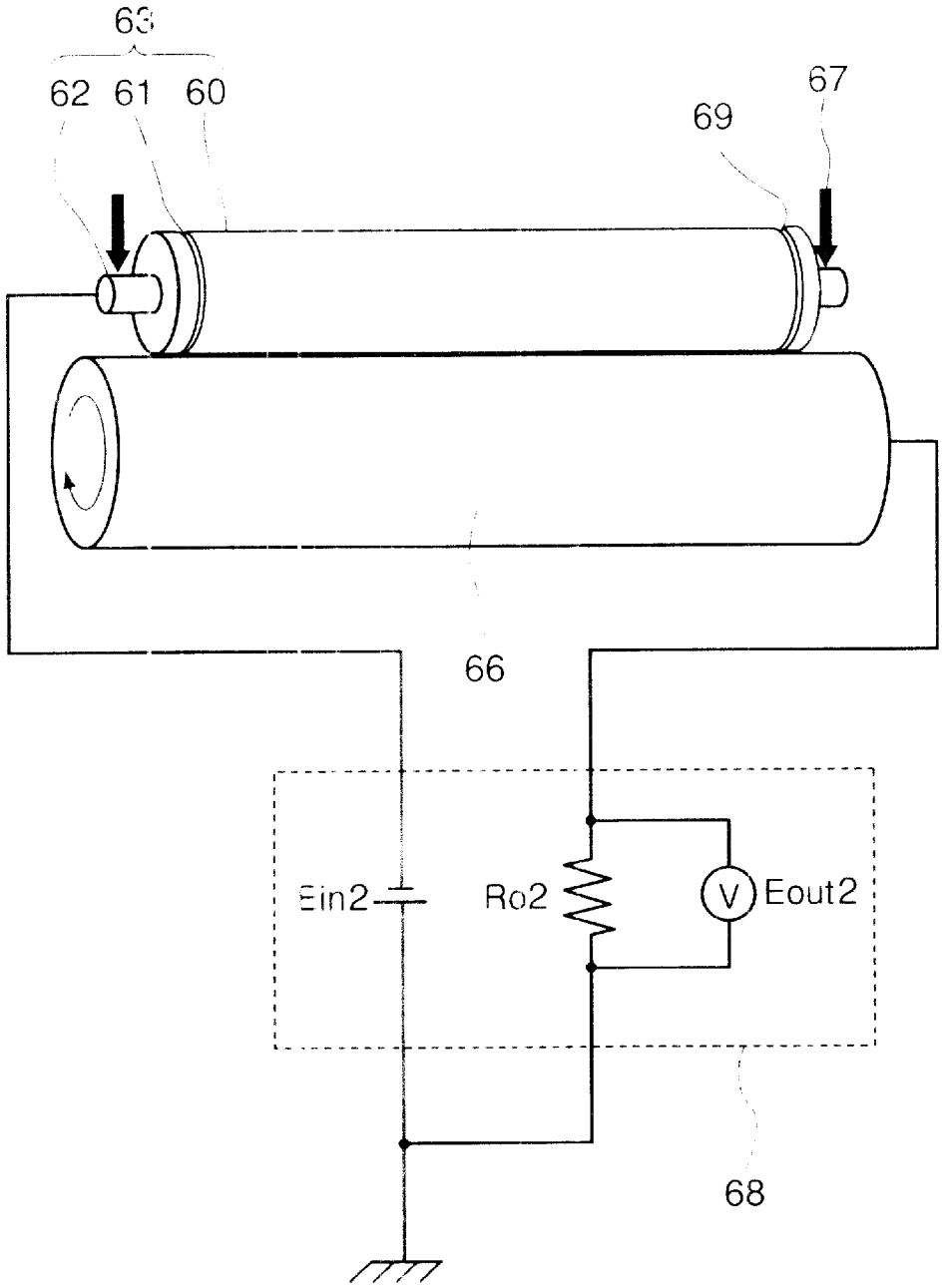
FIG. 4 is a drawing for describing the method for measuring the bulk resistance of a roller.

Referring to FIG. 4, the method for measuring the bulk resistance of the roller will be described. In the drawing, a referential code 63 stands for a roller, the object, the surface resistance of which is measured. The roller 63 comprises an electrically conductive metallic core 62 formed of stainless steel or the like, an elastic layer 61 formed on the peripheral surface of the metallic core 62, and a surface layer 60. In the case of a roller comprising only a single layer, that is, an elastic layer, the elastic layer 61 includes the surface layer 60.

Designated by a referential code 66 is a cylindrical stainless steel member with a diameter of 30 mm, which is rotated in the direction indicated by the arrow mark at a peripheral velocity of approximately 48 mm/sec. Here, the roller 63 is rotated by the rotation of the cylindrical member 66. The lengthwise end portions of the roller 63 are fitted with a pair of rings 69, one for one, for regulating to 50 $\mu$m, the distance by which the roller 66 theoretically enters (in order to make uniform, contact area between roller and cylindrical member). The pair of rings 69 are cylindrical, and their external diameters are smaller by 100 $\mu$m than that of the roller 63.

Designated by a referential code 67 is a predetermined amount of load applied to both lengthwise end portions (lengthwise end portions of metallic core 62) of the roller 63. More concretely, a load of 500 g is applied to each lengthwise end portion of the metallic core 62; in other words, the roller 63 is pressed upon the cylindrical member by the total load of 1 kg.

A referential code 68 stands for the measurement circuit, which comprises a power source $E_{in2}$, a resistor $R_{02}$, and a voltmeter $E_{out2}$. In this embodiment, the voltage output of the power source $E_{in2}$ is 300 V (DC). The value of the resistance $R_{02}$ is desired to be in the range of 100 Ω–10 MΩ. The resistance $R_{02}$ is for measuring weak current. Therefore, its resistance value is desired to be no less than $10^2$th –$10^4$th of the bulk resistance of the roller, that is, the property to be measured. For example, when the bulk resistance of the roller is approximately $1\times10^6$ Ω, the preferable resistance value for the resistor $R_{02}$ is 1 kΩ.

The value of the bulk resistance Rb of the roller is calculated from the following mathematical equation:

$$Rb=E_{in2}/E_{out2}/R_2 \quad (\Omega)$$

In this embodiment, the voltmeter $E_{out2}$ is read 10 seconds after the beginning of the voltage application.

(Surface Roughness of Development Roller)

The ideal surface roughness of the development roller 8 depends on the particle diameter of the toner, besides the other factors. Generally, however, it is desired to be in the range of 3 $\mu$m –15 $\mu$m, in ten-point mean roughness Rz. When the particle diameter of the employed toner is 6 $\mu$m in mean volume diameter, the ten-point mean roughness Rz of the surface of the development roller 8 is preferred to be in the range of 5 $\mu$m –12 $\mu$m. When the toner particle diameter is smaller than 6 $\mu$m, the ten-point mean roughness Rz of the surface of the development roller 8 is desired to be rendered slightly smaller than the value in the above range. If the ten-point mean roughness Rz of the surface of the development roller 8 is no more than 3 $\mu$m, it is difficult for the development roller 8 to effectively convey the toner, resulting in density deficiency, whereas if it is no less than 15 $\mu$m, it is difficult for the development roller 8 to sufficiently charge the toner, resulting in the generation of the so-called fog, that is, the phenomenon that toner particles adhere to the non-image portions, that is, unexposed points, of the photoconductive drum 1.

As the definition of "ten-point mean roughness Rz", the definition in JISBO601 was adopted. As for the means for measuring the ten-point mean roughness Rz of the surface of the development roller, a surface roughness gauge SE-30H (Kosaka Kenkyusho Co., Ltd.) was used.

(Hardness of Rubber)

As the means for measuring the hardness of the rubber of the development roller, a rubber hardness gauge (scaled in Asker C) (Kobunshi Keiki Co., Ltd.) was used. The hardness of the rubber as the material for the development roller is desired to be in the range of 35°–65° (in Asker C scale). If it is no less than 65° (Asker C), toner particles are melted by the friction between the toner particles and development roller, welding to the development blade and/or development roller. Therefore, it is not desired that the hardness of the rubber is no less than 65°. Further, if the hardness of the rubber as the material for the development roller is no less than 65°, the state of the contact between the development roller 8 and photoconductive drum 1 is likely to become unstable. On the other hard, if it is no more than 30°, a roller comprising an elastic layer formed of such a rubber is likely to permanently deform, being therefore unsuitable as the development roller. More preferably, the hardness of the rubber as the material for the development roller is desired to be in the range of 35°–55°. Using a rubber, the hardness of which is in this range (relatively low), as the material for the elastic layer for the development roller makes it possible to frictionally charge toner particles without subjecting the toner particles to an excessive amount of stress.

(Method for Manufacturing Development Roller)

Next, an example of the methods for manufacturing development rollers in accordance with this embodiment will be described.

First, electrically conductive adhesive is coated on the metallic core of a development roller to past to the metallic core, a piece of solid rubber sheet formed of rubber in which carbon resin particles or the like are dispersed, and also, to secure satisfactory electrical connection between the rubber sheet and metallic core. Then, the piece of solid rubber sheet is wrapped around the peripheral surface of the metallic core. Then, the combination of the metallic core and the solid rubber sheet pasted thereto is placed in a metallic mold. Next, the metallic mold containing the combination is placed in a press, and the solid rubber sheet is cured by the application of heat and pressure. Then, the peripheral surface of the roller, that is, the peripheral surface of the cured solid rubber layer, is polished to finish the roller with a solid elastic layer. The mid and surface layers can be formed by coating in layers the materials therefor on the peripheral surface of the solid elastic layer by roller-coating, spraying, dipping, or the like methods. The thickness in which the ionic conductor layer is coated is desired to be in the range of 3 μm–50 μm. If it is no more than 3 μm, it is possible that the ionic conductor layer will be shaved away as it is rubbed by the photoconductive drum 1, whereas if it is no less than 50 μm, the material for the ionic conductor layer must be repeatedly coated to realize a desired thickness, making it impractical, from the standpoint of manufacture, to form an ionic conductor layer no less than 50 μm in thickness.

[Development Blade]

The contact pressure of the development blade is desired to be in the range of approximately 15 g/cm–45 g/cm. If it is no more than 15 g/cm, toner fails to be properly charged, resulting in the formation of "fog", which reduces image quality, whereas if it is no less than 45 g/cm, the external additive particles to which are mixed in toner are likely to be peeled away from the toner particles by the pressure from the development blade, resulting in the deterioration of the toner in terms of chargeability.

The development blade is formed of a metallic material. However, in order to improve the efficiency with which the development blade charges toner particles, it may be coated with a resinous substance or the like. As for the resinous substance, when the polarity to which toner particles are charged is negative, polyamide resin is preferable, whereas when the polarity to which toner is charged is positive, fluorinated resin or the like is used.

The linear load of the development blade is measured using the following method: A piece of thin stainless steel plate, which is 100 mm (length)×15 mm (width)×30 μm (thickness) in physical dimension, is prepared as a plate to be pulled out, and another piece of thin stainless steel, which is 180 mm×(length)×30 mm (width)×30 μm (thickness) in physical dimension, is prepared as a pinching plate. The pinching plate is folded in half, and the plate-to-be-pulled-out is inserted between the two halves of the pinching plate, and the pinching plate, which is holding the plate-to-be-pulled-out, is inserted between the development roller 8 and development blade 9. In this state, the plate-to-be-pulled-out is pulled out at a constant velocity by pulling a spring scale, or the like, attached to the plate-to-be-pulled-out, and while it is pulled out at the constant velocity, the spring scale (unit of measurement: g) is read. Then, the read value is divided by 1.5 to obtain the linear load measured in the unit of g/cm.

(Contact Pressure between Development Roller and Photoconductive Drum)

The contact pressure between the development roller 8 and photoconductive drum 1, measured in the unit of linear load in the same manner as is the linear load between the development blade and development roller, is desired to be in the range of 20 g/cm–120 g/cm, for the following reason: If the linear load between the development roller 8 and photoconductive drum 1 is no more than 20 g/cm, the state of the contact between the development roller 8 and photoconductive drum 1 becomes unstable. On the other hand, if it is no less than 120 g/cm, the external additive particles dispersed in toner are likely to peeled away from the surface of a toner particle. As the external additive particles are peeled away, the toner particle deteriorates in chargeability, reducing thereby the efficiency with which it is charged by the development blade 9.

Designated by a referential code 14 is a control circuit (controlling means), which controls the rotational driving of the development roller 8, the voltage values of the development bias power source 10 and blade bias power source 11, etc.

FIG. 1 is a diagram of the operational sequence of the image forming apparatus in this embodiment, in which two prints are consecutively outputted.

Referring to FIG. 1, when the bold lines representing the rotation of the photoconductive drum and development roller are at the raised level, they means that the photoconductive drum 1 and development roller 8 are being rotationally driven.

In this embodiment, the photoconductive drum 1 and development roller 8 are always in contact with each other. Therefore, while the photoconductive drum 1 is rotating, the development roller 8 is also rotating. However, in the case of apparatuses employing the so-called noncontact developing method in which a predetermined amount of gap is always kept between the peripheral surfaces of the photoconductive drum and development roller, or in the case of apparatuses which employ a contact developing method, but in which the photoconductive drum and development roller are separable from each other, the photoconductive drum 1 and development roller 8 do not always rotate together.

Referring to FIG. 1, as the image forming apparatus is requested to output images by an unshown personal computer or the like, the photoconductive drum 1 and development roller 8 begin to be rotationally driven. As soon as the photoconductive drum 1 and development roller 8 begin rotating, the development bias and blade bias, which are virtually equal in potential at about −300 V, are applied from the development bias power source 10 and blade bias power source 11. The period immediately after the development roller 8, etc., begin to be rotated is the period in which the various components in the image forming apparatus are prepared for image formation; in other words, it is a period in which no image is formed (non-development period).

The image formation period (development period) refers to a period which corresponds to any of the various processes for forming a toner image across the surface of the transfer medium P minus the margins. The non-image formation period (non-development period) refers to any period which is not the image formation period, and in which the development roller is rotating. For example, it refers to the preparatory pre- and post-rotation periods for the photoconductive drum 1, and the so-called "sheet interval", which corresponds to the interval between two consecutively outputted prints.

After the preparatory pre-rotation of the photoconductive drum 1 is started, and voltage of approximately −300 V is started to be applied from the development bias power source 10 and blade bias power source 11, a voltage of approximately −600 V is applied to the blade bias power source 11 for a very short length time, which in this embodiment is 100 msec.

Voltages of −600 V and −300 V are applied to the development blade 9 and development roller 8, respectively, during the non-image formation period, that is, a period in which the image on the recording medium P is not affected by the voltage application. With this voltage application, the potential difference for making it possible to transfer negatively charged particles (toner particles and external additive particles) from the development blade onto the development roller is provided between the development blade 9 and development roller 8. As a result, the negatively charged external additive particles adhering to the development blade 9 (portion of development blade in adjacencies of contact area between development roller and development blade, on fixed edge side of development blade with respect to contact area: area a in FIG. 19) immediately after the development roller begins to rotate are transferred onto the development roller 8.

After the very brief application of the voltages of −600 V and −300 V to the development blade 9 and development roller 8, respectively, the potential of the development bias power source 10 and blade bias power source 11 are rendered virtually the same at approximately −300 V. Then, the image formation on the first transfer medium P is started (image formation period).

During this image formation period, the development roller 8 and development blade 9 are kept approximately the same in potential. Therefore, as the development roller 8 rotates, the negatively charged external additive particles are moved from the contact area between the development roller and development blade to the portion of the development blade 9 in the adjacencies of the contact area, on the fixed edge side of the development blade 9 with respect to the contact area, by the rotation of the development roller 8 and electric charge of the toner layer. However, the reversal toner particles (positively charged toner particles), positively charged external additive particles, etc., do not adhere to the development blade 9.

As the image formation on the first transfer medium P ends, the so-called "sheet interval", that is, the interval between the preceding image formation process and the following one, begins. During this sheet interval, a voltage of −600 V is applied to the development blade 9 for a duration of 100 msec as was in the preparatory pre-rotation period. As a result, the negatively charged external additive particles having migrated to the fixed edge side of the development blade 9 from the contact area portion of the development blade 9 during the image formation on the first transfer medium P are transferred onto the development roller 8 by the bias generated by this voltage of −600 V applied to the development blade 9. This process occurs while the development roller 8 rotates. Therefore, once the negatively charged external additive particles are transferred onto the development roller 8, there is no chance for them to return to the development blade 9.

Next, the image formation on the second transfer medium P is carried out in the same manner as that for the first transfer medium P. Also during this image formation, the negatively charged external additive particles are made to migrate from the contact area between the development roller and development blade, to the portion of the development blade 9 in the adjacencies of the contact area, on the free edge side of the development blade 9 with respect to the contact area, and accumulate thereon, as described previously.

As the image formation on the second transfer medium P ends, the preparatory post-rotation period for the formation of the next print begins.

Also during this preparatory post-rotation period, a voltage of −600 V is applied to the development blade 9 for a duration of 100 msec as was in the preparatory pre-rotation period, and the sheet interval. As a result, the negatively charged external additive particles having migrated to the fixed edge side of the development blade 9 from the contact area during the image formation on the second transfer medium P are transferred onto the development roller 8 by the bias generated by this voltage of −600 V applied to the development blade 9. This process occurs while the development roller 8 rotates. Therefore, once the negatively charged external additive particles are transferred onto the development roller 8, there is no chance for them to return to the development blade 9.

Then, the rotation of the development roller 8 and photoconductive drum 1 is stopped after the completion of the post-rotation process.

As described above, according to this embodiment, the development blade 9 is rejuvenated by returning the negatively charged external additive particles having migrated from the contact area between the development blade 9 and development roller 8 to the area of the development blade 9 in the adjacencies of the contact area, on the fixed edge side of the development blade 9 with respect to the contact area, to the development roller 8, by providing a predetermined potential difference between the development blade 9 and development roller 8 for a very brief length of time, during the non-image forming periods. Therefore, the negatively charged external additive particles having migrated from the contact area between the development blade 9 and development roller 8 to the area of the development blade 9 in the adjacencies of the border of the contact area, on the fixed edge side of the development blade 9 with respect to the contact area, do not accumulate thereon. Therefore, the toner particles do not weld to the development blade 9.

The reason why a predetermined potential difference is provided between the development blade 9 and development roller 8 for a very brief moment during the non-image formation periods is as follows: If a voltage of −600 V is applied to the development blade while the development blade 9 and development roller 8 are approximately the same in potential level, the amount by which the toner remains on the peripheral surface of the development roller 8, and which is regulated by the development blade 9, abruptly changes, resulting in the formation of an image having a ghost border, across which image density is distinctively different.

It is unnecessary that the potential difference is provided between the development blade 9 and development roller 8 for a brief moment, during every non-image formation period. For example, the potential difference may provided during only the preparatory pre-rotation period, only the preparatory post-rotation period, etc.; in other words, it is optional when the potential difference is provided.

In this embodiment, the brief length of time during which potential difference is provided between the development blade 9 and development roller 8 is set to 100 msec. However, it does not need to be limited to 100 msec, although no less than 5 msec is necessary in order for the development blade 9 to be properly rejuvenated. There is no upper limited to the length of the voltage application time. However, the increase in the voltage application time results in the reduction in printing speed. Therefore, the reasonable upper limit is several seconds.

Further, in this embodiment, the number of times a voltage of −600 V is applied for a brief moment during a given non-image formation period is only one. However, it does not need to be limited to one. In other words, the potential difference may be provided twice or more during the preparatory pre-rotation period, for example.

(Toner)

In order for a single-component toner to be compatible with the image forming apparatus in this embodiment, the toner particles therein are such that when the cross section of a given toner particle is examined with the use of a transmission electron microscope, it is visible that wax has not thoroughly diffused into bonding resin, remaining fragmentally dispersed therein like spherical or conic islands.

With the wax in each toner particle being is fragmentally dispersed in the above described manner, that is, with the wax in each toner particle being fragmentally wrapped by the bonding resin, the toner particle is less likely to deteriorate, and also, is less likely to contaminate an image forming apparatus. Therefore, the toner remains stable in chargeability, making it possible to form images superior in dot reproducibility, for a long period of time. Further, when the toner is heated, the wax is allowed to more effectively play its role. Therefore, the toner is superior in terms of the low temperature fixability and offset resistance.

A practical method for visually examine the cross section of a toner particle is as follows: First, toner particles are evenly dispersed in epoxy resin which hardens at the normal temperature, and the mixture is left alone in an ambience, which is 40° C. in temperature, for two days to allow the epoxy resin to harden. Then, the hardened mixture is dyed with triruthenium tetroxide, if necessary, the combination of triruthenium tetroxide and triosmium tetroxide. Then, thin sections are cut as sample pieces from the hardened and dyed mixture, with the use of a microtome. Then, these sections are observed with the use of a transmission electron microscope (TEM) in order to examine the internal state of a toner particle.

In order to enhance the contrast between the wax portion of a toner particle and the resin portion, that is, the shell portion of a toner particle, based on the slight difference in the degree of crystallization between the two components, it is desired that a dying method which uses triruthenium tetroxide is employed. It was observed, through the above described examination of the cross section of a toner particle, that the structure of a toner particle in this embodiment is such that wax portion of the toner particle is wrapped by the shell formed of the resin portion of the toner particle.

The wax used as the material for the toner in this embodiment is desired to be such that the highest peak of the heat absorption curve thereof obtained with the use of a differential scanning calorimeter falls in the range of 40° C.–130° C. when temperature is increasing. Using such a wax that is highest in heat absorbency when its temperature is in the above temperature range, as the wax for toner, makes it possible for a toner image to be fixed at a relatively low temperature, and also, improves a toner particle in releasability.

If a wax is such that the temperature corresponding to the highest peak of the aforementioned heat absorption curve thereof is no higher than 40° C., the wax is weak in tackiness. Therefore, if such a wax is used as the material for the wax portion of a toner particle, a resultant toner particle will be inferior in the resistance to high temperature offset, and also, will be excessively glossy. On the other hand, if a wax is such that the temperature corresponding to the highest peak of the aforementioned heat absorption curve thereof is no lower than 130° C., using such a wax as the material for the wax portion of a toner particle necessitates higher fixation temperature, and also, makes it difficult to properly flatten the surface of a toner image while it is fixed. Therefore, such a wax is undesired as the material for the wax portion of a toner particle, in particular, as the material for the wax portion of a color toner particle, because color toner particles comprising such a wax will not melt fast enough to be mixed to realize secondary colors. Further, if a wax which is high in the temperature corresponding to the highest peak of the heat absorption curve thereof is used as the material for a toner particle, it creates such a problem that it precipitates in medium (water) when manufacturing toner by a polymerization method, that is, when directly forming particulate toner in medium (water) by polymerization. This is another reason why the usage of such a wax is undesired.

The method used in this embodiment to find out the temperature corresponding to the highest peak of the heat absorption curve thereof is in compliance with "ASTMD3418-8", and is as follows. As the instrument for the measurement, a DSC-7, a product of Perkin-Elmer Co., Ltd., for example, is used. The temperature detected by the temperature sensor of the instrument is corrected with reference to the melting points of indium and zinc, and the calory detected by the calorimeter of the instrument is corrected with reference to the amount of the latent heat of fusion of indium. As for a vessel in which samples are placed, an aluminum pan is used. For comparison, another aluminum pan, which is empty, is heated and cooled, once, to study its thermal hysteresis. The heat absorption is measured while raising the temperature at a rate of 10° C./min.

As for the practical selections of wax usable as the material for the toner compatible with this embodiment, there are paraffin wax, polyolefine wax, Fischer-Tropch wax, amide wax, higher fatty acid, ester wax, derivatives, or graft/block compounds, of the preceding waxes, etc.

In order for a toner to be compatible with this embodiment, the toner is desired to be in the range of 100–160, preferably, in the range of 100–140, in the value of the shape factor SF-1 measured by an image analyzing apparatus, and also, is desired to be in the range of 100–140, preferably, in the range of 100–120, in the value of the shape factor SF-2. In addition, it is desired that the value of (SF-2)/(SF-1) is no more than 0.1. When the above conditions are all met, not only is the toner desirable in terms of its various properties, but also it is better compatible with the image analyzing apparatus.

The shape factors SF-1 and SF-2 mentioned above are parameters obtained in the following manner: 100 toner particles are randomly selected from a toner image with the use of a microscope FE-SEM (S-800), a product of Hitachi, Ltd. with a magnification of 500×, and their image data are fed into an image analyzing apparatus (Luzex 3), a product of Nicore Co., Ltd., through an interface, to analyze them. Then, the values of the shape factors SF-1 and SF-2 are calculated using the following formulas:

$$SF\text{-}1=\{(MXLNG)2/AREA\}\times(\pi/4)\times 100$$

$$SF\text{-}2=\{(PERI)2/AREA\}\times(1/4\pi)\times 100$$

AREA: projected area of toner particle

XLNG: absolute maximum length

PERI: circumference length

The shape factor SF-1 shows the degree of roundness of a toner particle, which ranges from being spherical to being indefinite in form. The shape factor SF-2 shows the degree of surface roughness of a toner particle; the greater the value of SF-2, the rougher the surface of a toner particle.

If the value of the shape factor SF-1 is no less than 160, a toner particle is substantially lower in rolling resistance than otherwise, requiring higher torque. Further, it is greater in friction, being therefore greater in frictional heat. Therefore, it is likely to be easily deteriorated by heat.

From the standpoint of the efficiency with which a toner image is transferred, the shape factor SF-2 of a toner particle is desired to in the range of 100–140, and the value of (SF-2)/(SF-1) is desired to be no more than 1.0. If the shape factor SF-2 of a toner is no less than 140, and also, the value of (SF-2)/(SF-1) is no less than 1.0, the toner particles of the toner are not smooth across their surface; they are substantially rougher across their surfaces than otherwise, being therefore likely to be lower in the efficiency with which they are transferred from the peripheral surface of the photoconductive drum 1 onto transfer medium such as the transfer medium P.

A toner, which is no more than 160 and 140 in the shape factors SF-1 and SF-2, respectively, more easily separates from the development blade 9 as the potential difference is provided between the development blade 9 and development roller 8. Therefore, using such a toner is particularly effective to prevent the phenomenon that toner welds to a development blade.

Moreover, in order for a toner to be used as a preferable toner used in this embodiment, the toner particles are desired to be coated with external additive to assure that they will be given a predetermined amount of electric charge.

In this sense, the ratio at which the surface of a toner particle is covered with external additive is desired to be in the range of 5%–99%, preferable, 10%–99%.

The external additive coverage ratio of the toner particle surface is measured using the following method: 100 toner particles are randomly selected from a toner image, with the use of a microscope FE-SEM (S-800), a product of Hitachi, Ltd., and their data are fed into an image analyzing apparatus (Luzex 3), a product of Nicore Co., Ltd., through an interface. The data obtained through the analyses are converted into binary data. Since the toner particle surface and the external additive are different in brightness, the area SG of the portion covered with the external additive and entire area ST (inclusive of portion covered with external additive) of each toner are separately obtained, and the external additive coverage ratio of a toner is calculated using the following formula:

$$\text{External additive coverage ratio}\,(\%) = (SG/ST)\times 100$$

In order for an external additive to be preferably used in this embodiment, the weight average particles diameter of the external additive is desired to be no more than 1/10 of that of the toner to which it is added. Here, the particles diameter of an external additive means the average particle diameter of an external additive obtained through visual observation of the toner particle surface with the use of an electron microscope. As for the selections of external additive, the following are available:

They are metallic oxides (aluminum oxide, titanium oxide, strontium titanate, cerium oxide, magnesium oxide, chromium oxide, tin oxide, zinc oxide, etc.), nitride (silicon nitride, etc.), carbide (silicon carbide), metallic salts (calcium sulfate, barium sulfate, calcium carbonate, etc.), fatty acid metallic salts (zinc stearate, calcium stearate, etc.), carbon black, silica, etc.

In this embodiment, auxiliary particles are added to the toner (100 parts in weight); one part in weight of silica, as an external additive negative in inherent charge polarity, is added to 100 parts in weight of toner, and 0.1 part in weight of titanium oxide, as an external additive positive in inherent charge polarity, to 100 parts in weight of toner. Addition of the positive external additive is effective for adjusting the fluidity of the toner, and also, for stabilizing the amount by which electric charge is given to the toner. In the case of a conventional image forming apparatus, the positive external additive adheres to the portion of the development blade 9 in the adjacencies of the contact area between the development roller and development blade, on the free edge side of the development roller 9 with respect to the contact area, and therefore, cannot be used. In this embodiment, however, the positively charged external additive particles adhering to the free edge side of the development blade 9 are peeled away by the friction from the development roller 8 and toner particles, being thereby prevented from affecting the image formation process.

The amount in weight ratio by which one or more of the above listed external additives are added per 100 parts of toner is desired to be in the range of 0.01 wt. %-10 wt. %, preferably, 0.05 wt. %–5 wt. %. These external additives may be used alone, or in combination. They are preferred to be dehydrated.

If the amount in weight ratio by which external additive is added to a single-component developer is no more than 0.01 part, the single-component developer is substantially inferior in fluidity, transfer efficiency, and development efficiency, effecting therefore density anomaly, so-called toner scatteration, that is, the phenomenon that the adjacencies of the toner image are contaminated by the scattered toner particles.

On the other hand, if the amount in weight of the external additive in the toner is no less than 10 parts, a substantial amount of the external additive adheres to the photoconductive drum 1 and development roller 8, reducing thereby the efficiency with which toner particles are charged, and/or disturbing toner images.

As described above, according to this embodiment, during the actual image formation period, that is, while the development roller is rotating, the development roller 8 and development blade 9 are kept virtually equal in potential, whereas during at least a part of a non-image formation period, the potential difference is provided between the development roller 8 and development blade 9 by making the development roller 9 greater in potential than the development roller 8 by increasing the potential of the development roller 8 while keeping the development roller 8 and development blade 9 on the same side as the developer in terms of polarity. Therefore, toner particles are prevented from remaining adhered to, accumulating on, and/or welding to, the development blade 9. Therefore, images suffering from image density anomalies, and unwanted vertical streaks, are not formed.

(Embodiment 2)

Hereinafter, referring to FIGS. 5–7, the second embodiment of the present invention will be described. The components in this embodiment similar to those in the first embodiment are given the same referential codes as those given to the corresponding ones, and their descriptions will not be given here.

Figure 5:
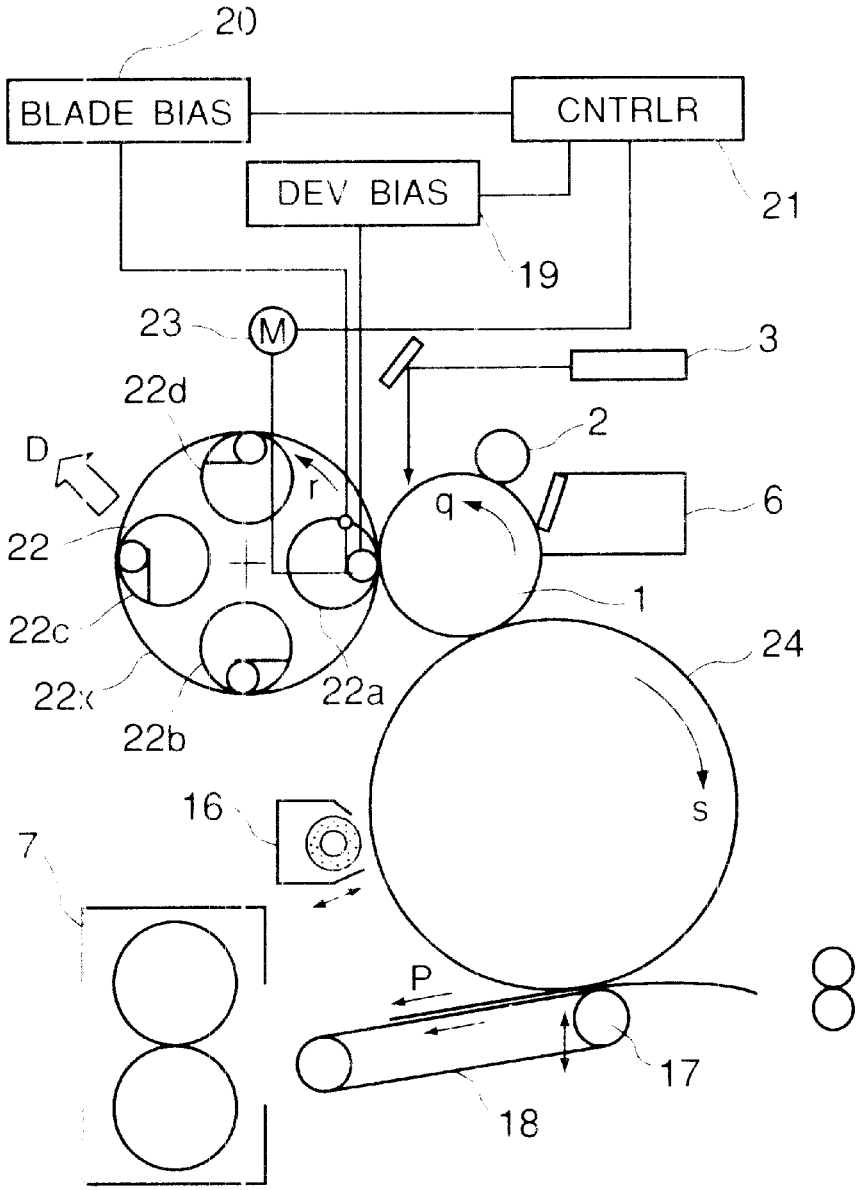
FIG. 5 is a schematic drawing of the image forming apparatus in the second embodiment of the present invention.

FIG. 5 is a schematic drawing of the image forming apparatus in this embodiment. This image forming apparatus is a color image forming apparatus, roughly comprising: a photoconductive drum 1 as an image bearing member; a charge roller 2 as a charging means; an exposing device 3 for latently imprinting image formation information; a developing device 22 for developing an electrostatic latent image on the photoconductive drum 1 into a visible image; and an intermediary transferring member 24.

The developing device 22 comprises: a rotary 22*x* as a development cartridge supporting member; a yellow color component development cartridge 22*a*, a magenta color component development cartridge 22*b*, a cyan color component development cartridge 22*c*, and a black color component development cartridge 22*d*.

The image forming apparatus in this embodiment is an electrophotographic color image forming apparatus. It separates an intended image into four color components, which are yellow Y, magenta M, cyan C, and black Bk, based on the image formation data sent from an unshown personal computer, work station, or the like, and sequentially forms four color toner images corresponding to the four color components, based on the four sets of image formation data separately derived from the original data. These color toner images are transferred in layers onto the intermediary transferring member 24, and then, are transferred all at once onto transfer medium (recording medium), such a piece of paper to obtain a full-color image. The image forming apparatus in this embodiment is the so-called rotary type color printer, that is, a color printer which employs such a developing apparatus that comprises the rotary 22*x* and a plurality of developing means, that is, developing cartridges 22*a*, 22*b*, 22*c, and* 22*d* mounted in the rotary 22*x*.

Referring to FIG. 5, the image forming apparatus comprises an organic photoconductive drum 1 as an image bearing member. As an image forming operation is started, the photoconductive drum 1 is rotationally driven in the direction indicated by an arrow mark a. The peripheral surface of this photoconductive drum 1 is uniformly charged to a predetermined potential level, that is, the dark area potential level, by the application of bias to the metallic core of the charge roller 2 as a contact charging means. Then, the uniformly charged peripheral surface of the photoconductive drum 1 is exposed to the scanning laser beam projected from the exposing device 3 while being turned on and off in accordance with the image formation data for a first color component, or the yellow (Y) color component. As a result, the exposed points of the peripheral surface of the photoconductive drum 1 are reduced in potential level (to light area potential), effecting the first electrostatic latent image.

The electrostatic latent image formed through the above described process is developed into a visible image by one of the developing means (development cartridges) mounted in the rotary 22*x* of the developing device 22. The rotary 22*x* is structured for integrally holding a first development cartridge 22*a* containing yellow (Y) toner as the toner of a first color, a second development cartridge 22*b* containing magenta (M) toner as the toner of a second color, a third development cartridge 22*c* containing cyan (C) toner as the toner of a third color, and a fourth development cartridge 22*d* containing black (Bk) toner as the toner of a fourth color. It is rotated (in direction indicated by arrow mark r) to move a specific development cartridge to the development station in which the cartridge opposes the photoconductive drum 1.

There is a toner layer with a predetermined thickness on the development roller, as a developer bearing member, of the development cartridge (22*a*, 22*b*, 22*c*, or 22*d*) in the development station in which the development cartridge opposes the photoconductive drum 1. As the development roller as a developer bearing member is rotationally driven by a motor 23, a predetermined bias is applied to the metallic core of the development roller. As a result, the electrostatic latent image on the photoconductive drum 1 is developed. Each of the development cartridges 22*a*, 22*b*, 22*c*, and 22*d* is rendered discrete, being enabled to be replaced, independently from the others, as it wears out.

First, the aforementioned first electrostatic latent image is developed into a visible image by the first development cartridge 22*a* containing Y toner as the toner of a first color. Whether a developing method is of a contact type or non contact type does not matter. In this embodiment, a latent image formed on the photoconductive drum 1 by exposure is reversely developed with the use of the combination of nonmagnetic single-component toner and a contact developing method.

The first toner image of a first color, that is, the first visualized image, is electrostatically transferred (primary transfer) onto the surface of the intermediary transferring member 24 as the second image bearing member, in the first transfer station, which is the transfer medium nipping portion between the photoconductive drum 1 and intermediary transfer member 24. The intermediary transferring member 24 comprises a cylinder as a substrate, an electrically conductive elastic layer coated on the peripheral surface of the cylinder, and a surface layer coated on the electrically conductive elastic layer.

The circumference of the intermediary transfer member 24 is greater than the length of the largest piece of transfer medium passable through the image forming apparatus. The intermediary transfer member 24 is kept pressed on the photoconductive drum 1 with the application of a predetermined amount of pressure, and is rotationally driven at virtually the same peripheral velocity as that of the photoconductive drum 1 in the direction (direction indicated by arrow s in FIG. 5) opposite to the rotational direction of the photoconductive drum 1 (in contact area, peripheral surface of photoconductive drum 1 and peripheral surface of intermediary transfer member 24 move in the same direction).

To the cylinder portion of the intermediary transfer member 24, such voltage (primary transfer voltage) that is opposite in polarity to the toner is applied. As a result, the toner image on the peripheral surface of the photoconductive drum 1 is electrostatically transferred (primary transfer) onto the surface of the intermediary transfer member 24.

Meanwhile, the toner particles remaining on the peripheral surface of the photoconductive drum 1 after the completion of the primary transfer are removed by a cleaning means 6, in order to prepare the photoconductive drum 1 for the next latent image forming rotation.

Then, more image formation processes similar to the yellow image formation process described above are successively repeated. As a result, the toner image of a second color developed with the use of M toner, the toner image of a third color developed with the use of C toner, and the toner image of a fourth color developed with the use of Bk toner are sequentially transferred in layers onto the surface of the intermediary transfer member 24, effecting thereby a full-color toner image.

Thereafter, a transfer belt 18, which was kept away from the peripheral surface of the intermediary transfer member 24, is pressed upon the peripheral surface of the intermediary transfer member 24 with the application of a predetermined pressure, and is rotationally driven. There is disposed a transfer roller 17 within the loop formed by the transfer belt 18. To the transfer roller 17, voltage (secondary transfer bias) which is opposite in polarity to the polarity of the toner is applied. As a result, all the color toner images layered on the surface of the intermediary transfer member 24 are transferred all at once onto the surface of a transfer medium P delivered with a predetermined timing. Thereafter, the transfer medium P is conveyed to a fixing device 7, in which the full-color image, that is, the combination of four color toner images, is fixed to the transfer medium P, becoming a permanent full-color image. Then, the transfer medium P is discharged from the image forming apparatus as a full-color print of the intended full-color image.

The toner particles remaining on the peripheral surface of the intermediary transfer member 24 after the secondary transfer are removed by an intermediary transferring member cleaning apparatus 16 placed in contact with the peripheral surface of the intermediary transfer member 24 with a predetermined timing.

Figure 7:
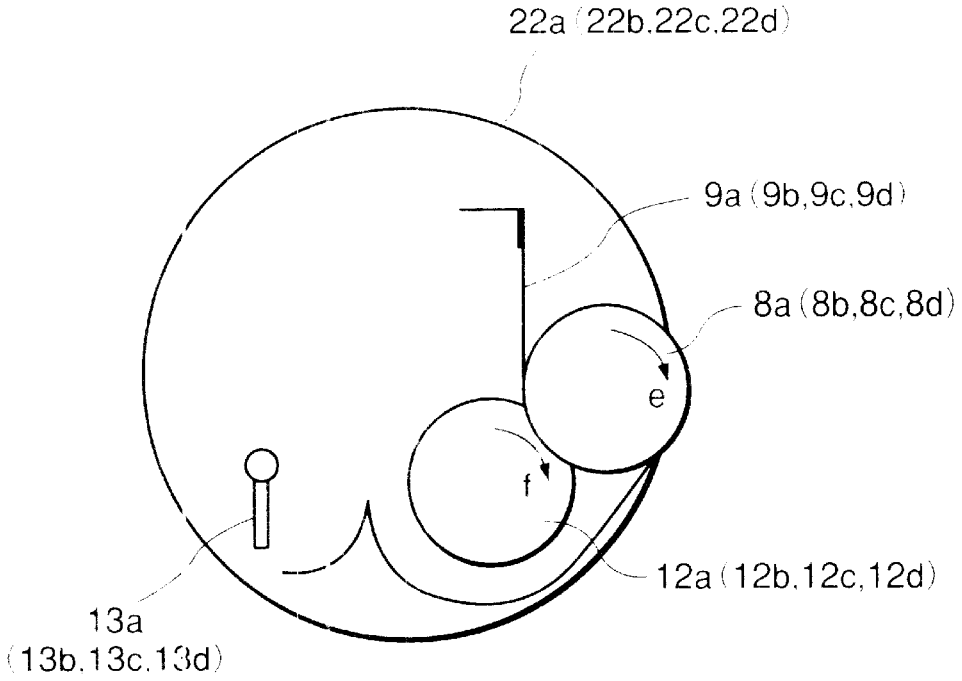
FIG. 7 is a schematic sectional view of the development cartridge in the second embodiment of the present invention.

FIG. 7 is a schematic sectional view of the development cartridge 22*a*, 22*b*, 22*c*, or 22*d*, as the developing means in this embodiment, containing Y, M, C, and Bk toners, respectively. It is for showing the structure of the development cartridge. These development cartridges 22*a*, 22*b*, 22*c*, and 22*d* are structured so that they can be removably mounted into the rotary type color printer, as an example of image forming apparatus, shown in FIG. 5, by opening and closing an unshown cartridge exchange cover. When the rotary is in the state shown in FIG. 5, that is, when the cyan color development cartridge 22*c* mounting space is at the cartridge removal position, the cyan color development cartridge 22*c* can be removed in the diagonally upward direction indicated by an arrow mark D.

In the case of the rotary type color printer shown in FIG. 5, each of the development cartridges must be mounted into, or removed from, the image forming apparatus main assembly when the corresponding cartridge mounting space is at the cartridge removal position (mounting position). Thus, in order to replace the yellow, magenta, or black color development cartridges 22*a*, 22*b*, or 22*d*, that is, a cartridge other than the cyan color development cartridge 22*c*, the rotary 22*x* must be rotated so that the corresponding cartridge mounting space comes to the cartridge removal position (position of cartridge 22*c* in FIG. 5).

Hereinafter, for the simplification of the description of the development cartridges, only the development cartridge 22*a* containing Y toner will be described. The descriptions of the development cartridges 22*b*, 22*c*, and 22*d* containing other color toners, one for one, are virtually the same as that of the development cartridge 22*a*.

The development cartridge 22*a* in this embodiment, shown in FIG. 7, is a reversal developing means in which nonmagnetic single-component Y toner as developer is contained.

This development cartridge 22*a* comprises: a development roller 8*a* which develops a latent image on the peripheral surface of the photoconductive drum 1 as it is rotated in contact with the peripheral surface of the photoconductive drum 1 in the direction indicated by an arrow mark e in the drawing; a supply roller 12*a* as a toner supplying means which is rotated in the direction indicated by an arrow mark f to supply the development roller 8*a* with toner; a development blade 9*a* as a developer regulating member for regulating the amount by which the toner is allowed to remain on the development roller 8*a*, as well as the amount by which the toner on the development roller 8*a* is given electric charge; a stirring member 13*a* for supplying the supply roller 12*a* with toner while stirring the toner; etc.

Figure 6:
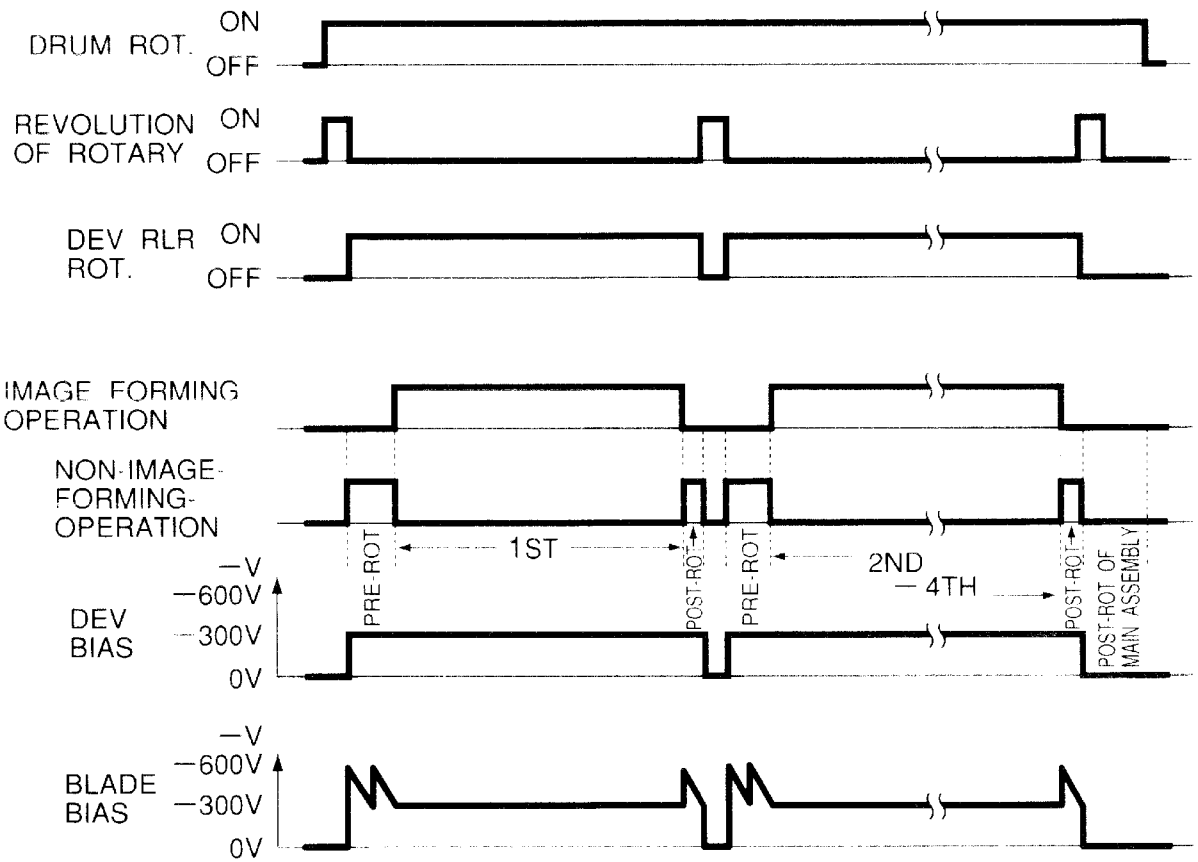
FIG. 6 is a diagram of the image formation sequence in the second embodiment of the present invention.

Referring to FIG. 6, as the printer is requested to output images by an unshown personal computer, or the like, the photoconductive drum 1 begins to be rotated, and the rotary is rotated to move the development roller 22*a* for a first color, in a manner to orbit about the rotational axis of the rotary, into the development station, in which the development cartridge 22*a* opposes the photoconductive drum 1.

As the development cartridge 22*a* for a first color (yellow) is positioned in the development station in which it opposes the photoconductive drum 1, the development roller 8*a* begins to be preparatorily rotated, and at the same time, voltage begins to be supplied, under the control of the control section (controlling means), to the development roller 8*a* and development blade 9*a* from the development bias power source 19 and blade bias power source 20 as voltage applying means. The voltage applied to the development roller 8*a* from the development bias power source 19 is a DC voltage of approximately −300 V, and the voltage applied to the development blade 9*a* is an AC voltage with a peak-to-peak voltage of −600 V and a sawtooth waveform. The voltage with the sawtooth waveform from the blade bias power source 20 is applied for a duration equivalent to two waveform cycles. The length of each wave cycle is 90 msec.

During a non-image formation period (development period) in which the toner image on the transfer medium P is not affected by the voltages applied to the development roller 8*a* and development blade 9*a*, the voltage with the peak-to-peak voltage of −600 V and the sawtooth waveform, and the DC voltage of −300 V, are applied to the development blade 9*a* and development roller 8*a*, respectively; in other words, a potential difference capable of transferring the negatively charged particles (toner particles and external additive particles) from the development blade 9*a* to the development roller 8*a* is provided. As a result, immediately after the development roller 8*a* begins to be rotated, the negatively charged external additive particles adhering to the development blade 9*a* are transferred onto the development roller 8*a*.

After the brief application of −600 V (sawtooth waveform) and −300 V to the development blade 9*a* and development roller 8*a*, respectively, the potential of the development bias power source 19 and blade bias power source 20 are rendered approximately equal at about −300 V, and the image corresponding to a first color begins to be formed on the photoconductive drum 1 (image formation period begins).

During this image formation period (development period), the development roller 8*a* and development blade 9*a* are approximately equal in potential. Therefore, the negatively charged external additive particles are made to migrate from the contact area between the development roller 8*a* and development blade 9*a*, onto the portion of the development blade 9*a* in the adjacencies of the contact area, on the fixed edge side of the development blade 9*a* with respect to the contact area, by the rotation of the development roller 8*a* and the electric charge of the toner layer. However, the reversal toner particles, positively charged external additive particles, etc., do not adhere to the development blade 9*a*.

As the formation of the image corresponding to a first color ends, the preparatory post-rotation period for the development cartridge 22*a* begins. During this period, a voltage with a peak-to-peak voltage of −600 V and a sawtooth waveform is applied for a duration equivalent to a single waveform cycle, to the development blade 9*a* from the blade bias power source 20. As a result, the negatively charged external additive particles having adhered to the development blade 9*a* in the yellow color development cartridge 22*a* during the image formation period are transferred onto the development roller 8*a*; the development blade 9*a* is rejuvenated.

Then, the rotation of the development roller 8*a* is stopped, and the rotary 22*x* is rotated to prepare the image forming apparatus for the formation of the image of the next color (magenta). During this rotation of the rotary 22*x* for moving the process cartridges in the manner to orbit about the rotational axis of the rotary 22*x*, voltage is not supplied from the development bias power source 19 and blade bias power source 20.

As the development cartridge 22*b* for a second color (magenta) is moved into the development station in which it opposes the photoconductive drum 1, the rotation of the rotary 22*x* is stopped.

Then, the preparatory pre-rotation of the development roller 8*b* is started as was the preparatory pre-rotation of the development roller 8*a* of the development cartridge 22*a* for a first color. At the same time, voltage begins to be supplied from the development bias power source 19 and blade bias power source 20. The voltages supplied from the development bias power source 19 and blade bias power source 20 during this preparatory pre-rotation period are a DC voltage of approximately −300 V, and an AC voltage with a peak-to-peak voltage of −600 V and a sawtooth waveform, respectively. The voltage with the sawtooth wave form from the blade bias power source 20 is applied for a duration equivalent to two waveform cycles. The length of each waveform cycle is 90 msec. Thereafter, as the preparatory pre-rotation of the development roller 8*b* ends, the image formation period, in which the image corresponding to a second color, begins as did the image formation period for a first color. During this image formation period, the negatively charged external additive particles gradually migrate from the contact area between the development roller 8*b* and development blade 9*b*, onto the portion of the development blade 9*b* in the adjacencies of the contact area, on the free edge side of the development blade 9*b* with respect to the contact area, accumulating thereon as did they in the process cartridge 22*a*. Then, the process similar to those carried out in the process cartridge 22*a* and process cartridge 22*b* is carried out in the rests of the process cartridges (for third and fourth colors).

Since the negatively charged external additive particles having adhered to the development blade during the preceding image forming period are transferred, as described above, during the preparatory pre-rotation period for each color, the external additive particles are prevented from accumulating on the development blade. Therefore, it is possible to provide a reliable image forming apparatus.

As the image formation for a fourth color ends, the preparatory post-rotation period for the fourth color begins. During this period, a voltage with a peak-to-peak voltage of −600 V and a sawtooth waveform is applied for a duration equivalent to a single waveform cycle, to the development blade 9*a* from the blade bias power source 20. Thereafter, the rotation of the development roller 8*d* is stopped, and the rotary 22*x* is rotated in a manner to make the process cartridges about the rotational axis of the rotary 22*x*. The voltage supply from the development bias power source 19 and blade bias power source 20 is stopped before this rotation of the rotary 22*x*.

As this rotation of the rotary 22*x* ends, the post-rotation period for the main assembly of the image forming apparatus, that is, the period in which the intermediary transfer member 24, photoconductive drum 1, etc., are preparatorily rotated for the next printing operation, begins. Then, the rotation of the photoconductive drum 1 is stopped at the completion of this post-rotation period for the apparatus main assembly.

As described above, according to this embodiment, when images are formed by a full-color image forming apparatus, the development roller 8 (8*a*–8*d*) and development blade 9 (9*a*–9*d*) are kept virtually the same in potential during the image formation period, that is, the period in which the development roller 8 is rotated, whereas during at least a part of the non-image formation period, potential difference is provided between the development roller 8 and development blade 9 by rendering the potential of the development blade 9 greater than that of the development roller by increasing the potential of the development blade 9 while keeping the development roller 8 and development blade 9 on the same side as the developer in terms of polarity. Therefore, the adhesion of toner particles to the development blade 9, accumulation of toner particles to the development roller 9, and welding of toner particles to the development roller 9, can be prevented even in a full-color image forming apparatus, making it possible to prevent the formation of full-color images suffering from the aforementioned insufficient density and unwanted vertical streaks.

In addition, among the various image forming apparatus components and means, the developing means inclusive of toner, which wears out relatively faster, is transformed into a process cartridge removably mountable in the main assembly of an image forming apparatus. Therefore, the labor required of an operator involved in various maintenance works is substantially reduced.

(Embodiment 3)

Next, referring to FIGS. 8 and 9, the third embodiment of the present invention will be described. The components in this embodiment similar to those in the first embodiment are given the same referential codes as those given to the corresponding ones in the first embodiment, and their descriptions will not be given here.

In the preceding embodiments of the present invention, the period in which a predetermined potential difference is provided between the development roller and development blade was made to coincide with one of the non-image formation periods: the preparatory pre-rotation period, preparatory post-rotation period, sheet intervals, etc.

In this embodiment, however, instead of carrying out the above described development rejuvenation sequence during one or more of the sheet intervals, the cumulative number of prints is counted, and the rejuvenation sequence is carried out for every predetermined number of prints to rejuvenate the development blade.

Figure 8:
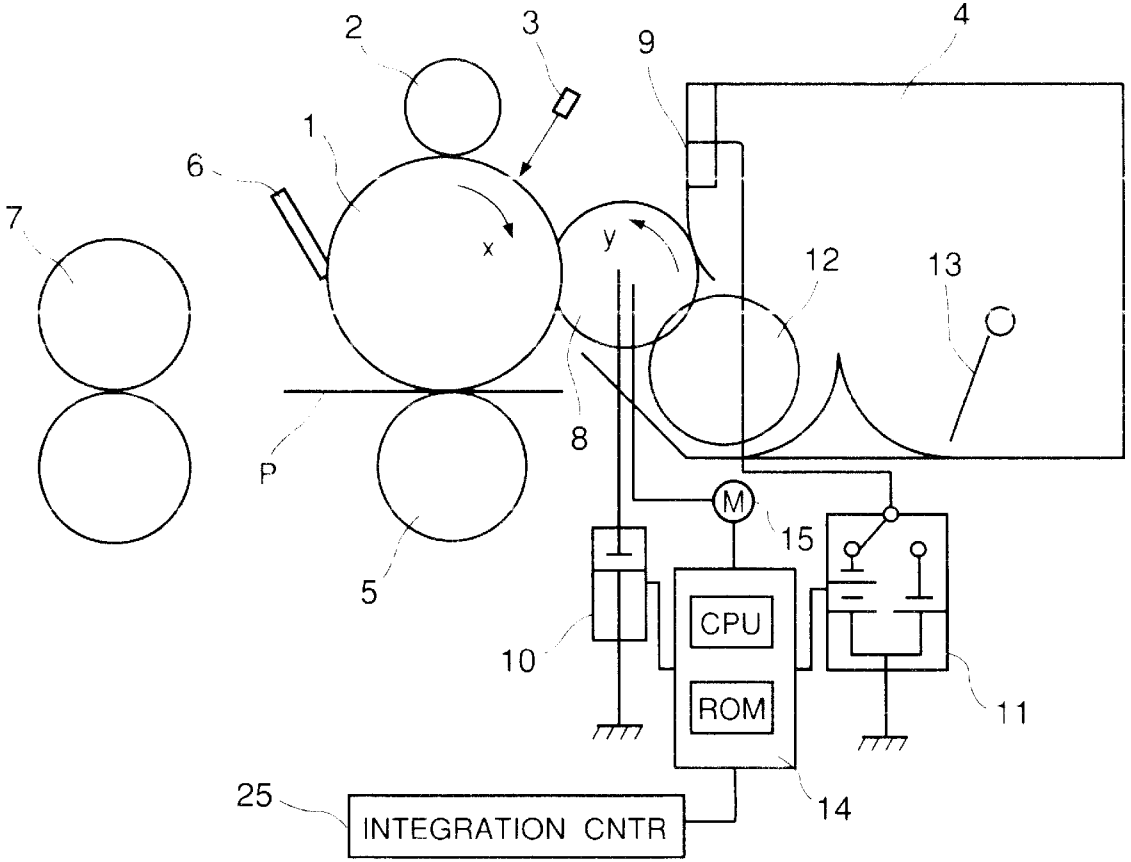
FIG. 8 is a schematic drawing of the image forming apparatus in the third embodiment of the present invention.

Referring to FIG. 8, a referential code 25 stands for a cumulative counter, which is controlled by a control circuit 14. The cumulative counter counts the number of prints, and as the cumulative count reaches a predetermined number, it signals the control circuit 14 that the predetermined number is reached.

Figure 9:
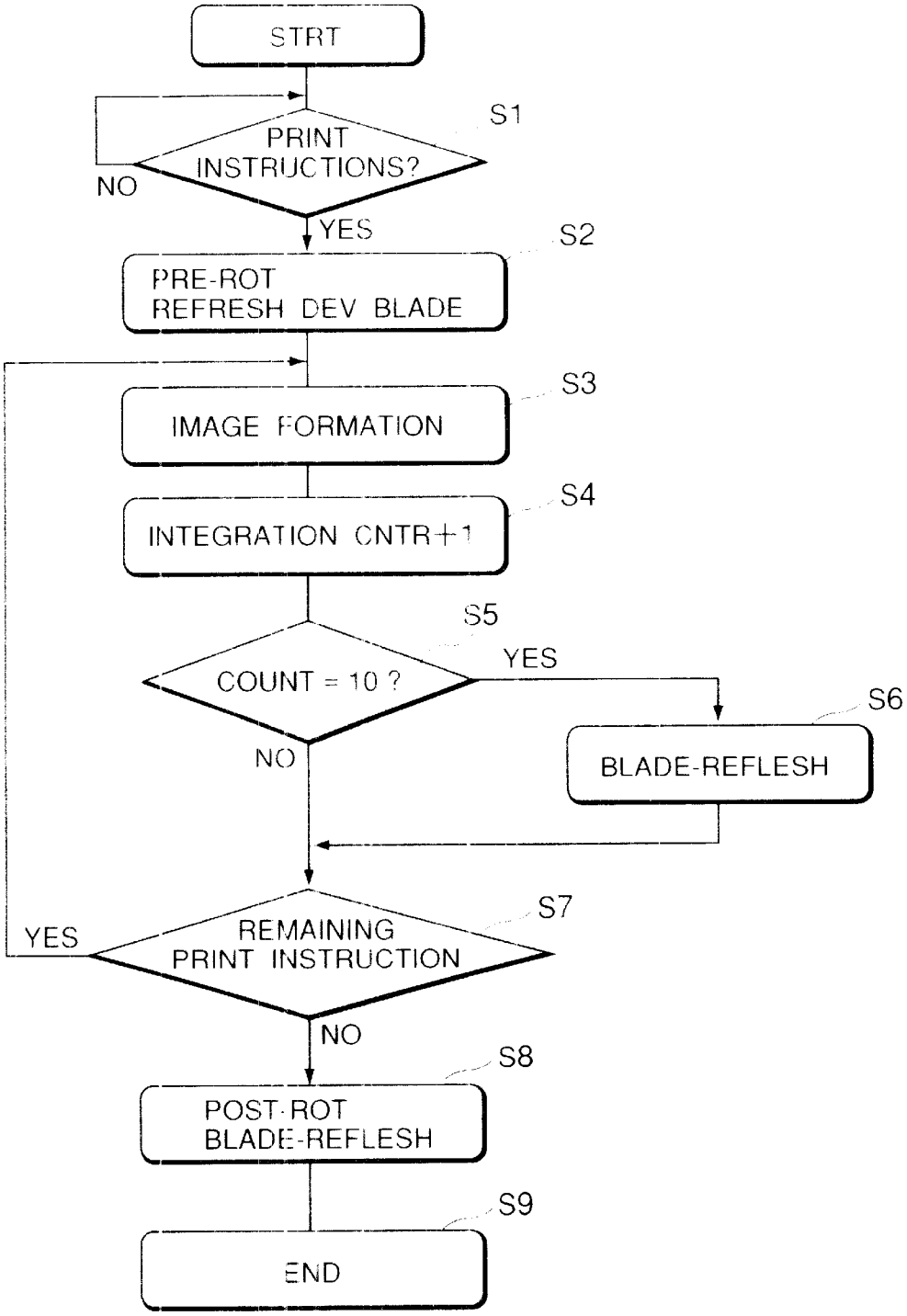
FIG. 9 is a flowchart of the development blade rejuvenating operation in the third embodiment of the present invention.

FIG. 9 is a flowchart of the recovery sequence in this embodiment.

Referring to FIG. 9, in Step S1, the image forming apparatus is on standby, waiting for an image formation request signal. As an image formation request signal is received, the rotation of the photoconductive drum 1 and development roller 8 is started; in other words, the preparatory pre-rotation period begins, in which the development blade 9 is rejuvenated by applying −600 V and −300 V to the development blade 9 and development roller 8, respectively (Step S2), providing between the development blade 9 and development roller 8, a potential difference large enough to transfer the negatively charged particles (toner particles and external additive particles) from the development blade 9 onto the development roller 8. Thus, the negatively charged external additive particles adhering to the development blade 9 (portion of the development blade 9, on fixed edge side with respect to contact area between development roller and development blade: area a in FIG. 19) are transferred onto the development roller 8, immediately after the development roller 8 begins to be rotated.

After the brief application of −600 V and −300 V to the development blade 9*a* and development roller 8*a*, respectively, the potential of the development bias power source 19 and blade bias power source 20 are rendered approximately equal at about −300 V, and an image corresponding to a first color begins to be formed on the photoconductive drum 1 (Step S3).

During this image formation period, the development roller 8*a* and development blade 9*a* are kept approximately equal in potential. Therefore, the external additive particles adhering to the contact area portion of the development blade 9*a* are made to migrate from the contact area between the development roller 8*a* and development blade 9*a*, onto the portion of the development blade 9*a* in the adjacencies of the contact area, on the fixed edge side of the development blade 9*a* with respect to the contact area, by the rotation of the development roller 8*a* and the electric charge of the toner layer. However, the reversal toner particles, positively charged external additive particles, etc., do not adhere to the development blade 9*a*.

While the first image is formed, "+1" is added to the cumulative counter (Step S4). Then, it is decided whether or not the count value in the cumulative counter has reached 10 (Step S5).

If it is determined that the count value in the cumulative counter has reached 10, −600 V and −300 V are applied to the development blade 9 and development roller 8, respectively, to rejuvenate the development blade 9 (Step S6). In this embodiment, the time spent for the rejuvenation of the development blade 9 in Step S6 is 3 seconds.

After the completion of the rejuvenation operation (Step S6), or when the count value in the cumulative counter is less than 10 in Step S5, the image forming apparatus remains on standby, waiting for a print request signal (Step S7). In this case, the image forming operation is continued without carrying out the development blade rejuvenation sequence during the sheet interval.

When no more print request signal is sent, the preparatory post-rotation period begins, in which −600 V and −300 V are applied to the development blade 9 and development roller 8, respectively, to rejuvenate the development blade 9 (Step S8).

Then, after the negatively charged external additive particles on the development blade 9 are transferred onto the development roller 8, the rotational driving of the development roller 8 is stopped; the voltage application from the development bias power source 10 and blade bias power source 11 is stopped; and the driving of the photoconductive drum 1 is stopped (Step S9).

The timing with which the development blade 9 and development roller 8 are made different in potential for a brief moment does not need to be every 10 prints. In other words, the length of the development blade rejuvenation interval, in terms of the number of prints, is optional; all that is necessary is for the development blade rejuvenation sequence is carried out for every predetermined number of prints when a large number of prints are continually outputted. However, when a large number of prints are continuously outputted, negatively charged external additive particles continuously accumulate on the development blade. Therefore, in order to prevent toner particles from welding to the development blade 9, the development blade 9 should be rejuvenated at least once per 100 prints.

As described above, according to this embodiment, when a substantial number of prints are continuously outputted, the development blade 9 and development roller 8 are made different in potential for a brief moment, during the non-image formation period after the production of every predetermined number of prints, in order to return the negatively charged external additive particles to the development roller 8 to rejuvenate the development blade 9. Therefore, the negatively charged external additive particles having migrated from the contact area portion of the development blade onto the portion of the development blade, on the fixed edge side with respect to the contact area, do not accumulate thereon, being therefore prevented from welding to the development blade 9.

(Embodiment 4)

Next, preferable embodiments of the image forming apparatus and process cartridge in accordance with the present invention different from the above described ones will be described in detail.

The image forming apparatus in this embodiment is characterized in that the relationship in terms of potential between the development roller (developer bearing member) and development blade (developer regulating member) is made to be such that during the image formation period, that is, the period in which a latent image is developed, the development roller and development blade are made approximately the same in potential, whereas during a part of the no-image formation period, the development blade is rejuvenated by removing the external additive particles adhering to the development blade by providing potential difference between the development roller and development blade (rejuvenation operation). Therefore, even when a substantial number of prints are continuously outputted, images suffering from such defects as abnormally low density and/or unwanted vertical streaks that are traceable to the welding of toner particles to the development blade are not produced.

In the image forming apparatus in this embodiment, the bias for the development roller and the bias for the development blade are supplied from a single voltage applying means. Also in this embodiment, during the image formation period, the development roller and development blade are kept virtually the same in potential, and during the non-image formation period, they are made different in the voltages applied thereto to make them different in potential. In this embodiment, however, the development roller and development blade are made different in potential by a voltage attenuation controlling means which retards the attenuation of the potential of the development blade, relative to the attenuation of the potential of the development roller (retardation control). This is one of the essential characteristics of this embodiment.

With the employment of the above described method, the relatively expensive transformers of the power supply circuits, and the circuitry for the transformers, can be replaced with a relatively inexpensive retardation circuits to reduce the cost of the power supply circuits.

As described above, in the case of this image forming apparatus, the development roller and development blade are made different in potential, with the employment of only a single voltage applying means. In other words, the formation of images suffering from abnormally low density and unwanted vertical streaks can be prevented by a simple structure.

Unlike the preceding embodiments, this embodiment does not require two power sources, reducing therefore the cost necessary to put the present invention to practical use.

This embodiment is the same as the preceding embodiments in that in order to rejuvenate the development blade by providing potential difference between the development roller and development blade, the potential of the development blade is made greater than that of the development roller by increasing the potential of the development blade while keeping the development roller and development blade on the same side, in terms of polarity, as the developer.

Further, in this embodiment, the development blade rejuvenating operation can be made more effective by increasing the amount of the potential difference provided between the development roller and development blade by increasing the voltage applied by the voltage applying means during the image formation period.

As described above, according to this embodiment, the negatively charged external additive particles having adhered to the development blade (area a in FIG. 19) during the formation of each print, more specifically, during each period in which the development roller and development blade are kept virtually the same in potential to develop a latent image, are transferred onto the development roller to rejuvenate the development blade, during the non-image formation period. Therefore, toner particles do not solidly adhere to the development blade nor weld to the development blade.

In the case of the development blade rejuvenating sequence in this embodiment, the negatively charged external additive particles having adhered to the development blade during the image formation period are returned to the development roller by briefly applying to the development blade a voltage greater in potential than the voltage being applied to the development roller (impulsively changing voltage applied to development blade), during one or more of the non-image formation periods, that is, the periods corresponding to the margin portions of a transfer medium, preparatory pre-rotation period, preparatory post-rotation period, sheet interval periods, and/or etc. More specifically, if −300 V, for example, is being applied to the development roller during one or more of the non-image formation periods, a voltage greater in potential level than −300 V (for example, in range of −400 V--900V) is briefly applied to the development blade (voltage applied to development blade is impulsively changed).

Here, "to impulsively change" means to apply for a brief moment, for example, approximately 15 msec–20 msec, such a voltage that is the same in polarity as the developer and is greater in potential than the voltage applied during the image formation period. Such a voltage may be applied longer than 20 msec. However, in order to apply such a voltage longer than 20 msec, the sheet intervals period, pre-rotation period, etc., must be lengthened, resulting in through-put reduction. Therefore, the length of the time such a voltage is applied is desired-to be no more than 20 msec. Further, the length of time such a voltage is applied may be no more than 15 msec. However, if the length of time such a voltage is applied is no more than 15 msec, it is difficult for the potential of the development blade to reach the target level, due to the delay in the power source response. Therefore, it is desired to be no less than 15 msec.

As is evident from the above description, according to this embodiment, the external additive having adhered to the development blade does not accumulate on the development blade. Therefore, the apparent surface roughness of the development blade is not increased by the external additive. Therefore, toner particles are not caught by the development blade. Therefore, toner particles do not weld to the development blade (area a in FIG. 19).

Further, this development blade rejuvenation sequence is occurs in a very brief moment during one or more of the non-image formation periods. Therefore, even if reversal toner particles and positively charged external additive particles adhere to the portion of the development blade, immediately next to the contact area, on the free edge side with respect to the contact area (area b in FIG. 19), they return to the development roller during the image formation period. Therefore, they do not accumulate on the development blade. Therefore, they do not effect images suffering from image defects such as unwanted vertical streaks, abnormally low density, etc.

It is particularly important in this embodiment that when the development roller and development blade are made different in potential during one or more of the aforementioned non-image formation periods, the development roller is rotating. This is for the following reason: If the development roller and development blade are made different in potential while the development roller does not rotate, the external additive particles sometimes adhere again to the development blade, whereas if the development roller and development blade are made different in potential while the development roller rotate, the positively charged external additive particles having been returned to the development roller are moved away from the downstream edge (area corresponding to area a in FIG. 19) of the contact area between the development blade and development roller, in terms of the rotational direction of the development roller, by the rotation of the development roller, being prevented from adhering again to the development blade.

The magnitude of the potential difference provided between the development roller and development blade during one or more of the aforementioned non-image formation periods has only to be no less than 60 V, preferably, no less than 60 V and no more than 700 V, more preferably, no less than 60 V and no more than 500 V, for the following reason: If it is no more than 60 V, the negatively charged external additive particles adhering to the development blade cannot be transferred onto the development roller; the potential difference less than 60 V is not effective to prevent the welding of toner particles to the development blade.

Further, the greater the potential difference, the more effective it is. Therefore, in theory, there is no limit to the magnitude of the potential difference. In reality, however, the value above which electrical leak (breakdown) occurs between the development roller and development blade is the practical upper limit. In this embodiment, however, only a single voltage applying means is employed, and the amount by which electric charge is accumulated is not large. Therefore, even when a potential difference of 700 V occurred, leak did not occur. Incidentally, a potential difference of 700 V is more than enough for accomplishing the object of the present invention. The reason why the potential difference is preferred to be no more than 500 V is that when the potential difference is no less than 500 V, electric discharge is likely to occur between the development roller and development blade.

Further in this embodiment, two or more particulate substances may be used as the auxiliary external additive for toner. One of the particulate auxiliary external additive is desired to opposite in inherent charge polarity to toner (positive if toner is negative), since such an auxiliary external additive is capable of scrape down, in cooperation with the rotation of the development roller, the negatively charged external additive having adhered to the development blade.

Further, at least the developing means is desired to be structured as a part of a cartridge (process cartridge) removably mountable in the main assembly of an image forming apparatus. In this case, the developing means may be in the form of a discrete development cartridge, or a part of a process cartridge integrally comprising an image bearing member, a charging means, a cleaning means, etc., in addition to the developing means. With the provision of one of such structural arrangements, it is possible to reduce the amount of the labor required of an operator involved in the various image forming apparatus maintenance operations, for example, the operation for replenishing an image forming apparatus with toner, operation for replacing a developing device, the service life of which had expired, etc., simplifying thereby the operation for reliably outputting satisfactory images.

(Embodiment 4)

Next, referring to FIGS. 10 and 11, the fourth embodiment of the present invention will be described.

First, referring to FIG. 11, the image forming apparatus in this embodiment will be described. The image forming apparatus in this embodiment employs a reversal developing method, that is, a developing method in which a latent image is visualized by adhering toner particles to the exposed points of an image bearing member. More specifically, it is an image forming apparatus in which a latent image is developed by placing the developer bearing member, which is bearing negatively charged single-component toner particles, in contact with the image bearing member.

Figure 11:
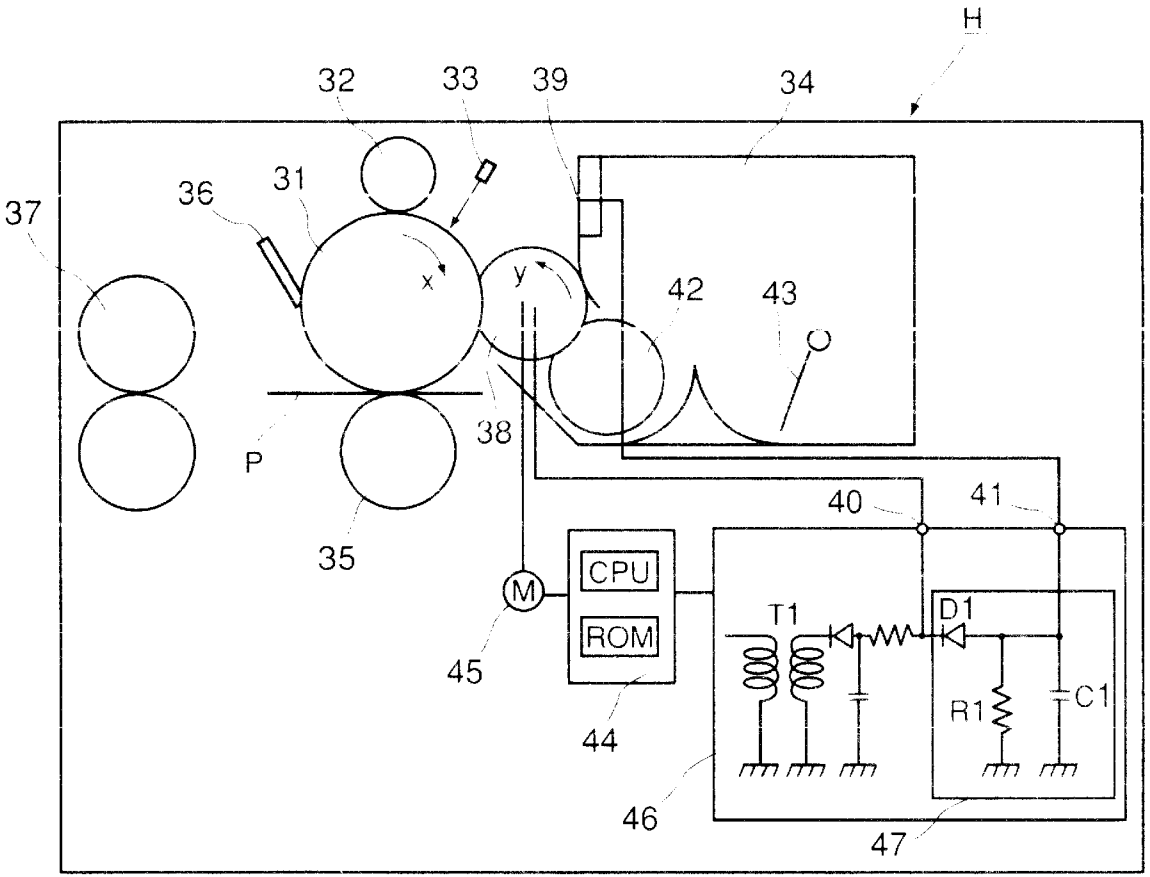
FIG. 11 is a schematic drawing of the image forming apparatus in the fourth embodiment of the present invention.

Also referring to FIG. 11, designated by a referential code 31 is a photoconductive drum as an image bearing member, which is rotatable in the direction indicated by an arrow mark x. As the photoconductive drum 31 is rotated, it is negatively and uniformly charged by a charge roller 32 as the primary charging device, across its peripheral surface. As the photoconductive drum 31 is further rotated, numerous points of the negatively and uniformly charged portion of the peripheral surface of the photoconductive drum 31 are selectively exposed by an exposing device 33 which uses a laser or the like. As a result, the electric charge of each of the exposed points attenuates, effecting an electrostatic latent image on the peripheral surface of the photoconductive drum 31.

A referential code 34 stands for a developing device, which is the so-called reversal type developing means, that is, a developing means for transferring toner as developer onto the exposed points of the electrostatic latent image to visualize the electrostatic latent image. The toner used by this developing device is nonmagnetic single-component toner. The developing device 34 is structured so that it can be removably mountable in the main assembly H of the image forming apparatus, being therefore replaceable as it wears out.

After being transferred onto the photoconductive drum 31, the toner particles are transferred onto a piece of transfer medium P by a transfer roller 35 as a transfer charging device. The toner particles which remained on the photoconductive drum 31 without being transferred are removed from the photoconductive drum 31 by a cleaning means 36.

The toner particles on the transfer medium P are thermally welded to the transfer medium P by a fixing device 37. As a result, a permanent image is formed on the transfer medium P.

The developing device 34 comprises: a development roller 38; a supply roller 42 for supplying toner to the development roller 38; a development blade 39 as a developer regulating member; and a stirring member 43 for conveying toner to the supply roller 42.

The development roller 38 is rotatable in the direction indicated by an arrow mark y by a motor 45 as a driving apparatus. The development process which the development roller 38 performs is the so-called contact development process in which the development roller 38 is placed in contact with the peripheral surface of the photoconductive drum 31. Therefore, the development roller 38 is desired to be formed of a material, such as rubber, in order to provide the surface portion of the development roller 38 with elasticity.

To the development roller 38, a voltage of approximately −300 V is supplied from a development bias contact 40. As a result, the exposed points of the peripheral surface of the photoconductive drum 31 become different in potential from the peripheral surface of the development roller 38. With the presence of this potential difference, the toner particles on the development roller 38 are transferred onto the exposed points on the photoconductive drum 31.

The development blade 39 is formed of a piece of thin metallic plate, and is kept in contact with the development roller 38 with the utilization of the resiliency of the development blade 39. As the material for the thin metallic plate, stainless steel, phosphor bronze, etc., can be used. In this embodiment, a piece of 0.1 mm thick plate of phosphor bronze is used. The layer of the toner on the development roller 38 is rubbed by the development blade 39 and development roller 38, being thereby given triboelectric charge while being regulated in thickness. To the development blade 39, blade bias is supplied from a blade bias contact 41.

Designated by a referential code 44 is a control circuit (controlling means), which controls the rotational driving of the development roller 38, values of the voltages supplied to the development bias contact 40 and blade bias contact 41, etc.

Designated by a referential code 46 is a hith voltage power source as a voltage applying means, which supplies voltage to the development roller 38 and development blade 39 through the development bias contact 40 and blade bias contact 41, respectively.

Designated by a referential code 47 is a voltage attenuation controlling (retarding) means disposed in the high voltage power source 46. The voltage attenuation retarding means 47 branches from the development bias contact 40, and retards the attenuation of the voltage applied to the blade bias contact 41.

This voltage attenuation regarding means 47 comprises a diode D1, a resistor R1, and a condenser C1. In this embodiment, the values of the resistor R1 and condenser C1 are 100 MΩ and 2,200 pF, respectively.

As for the electric resistance of the development roller 38 in this embodiment, the surface resistance is $6.8\times10^{10}$ Ω, and the bulk resistance is $2.8\times10^{6}$ Ω.

Figure 10:
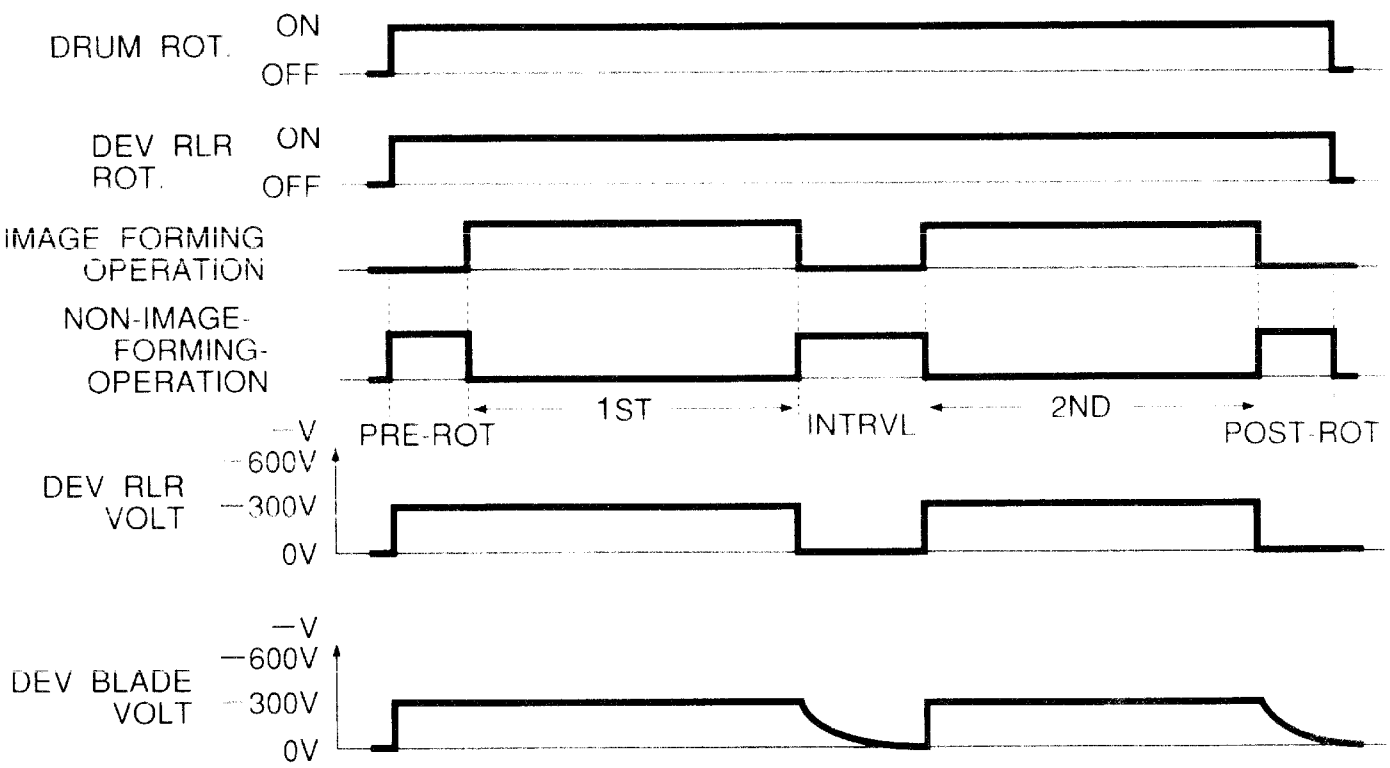
FIG. 10 is a diagram of the image formation sequence in the fourth embodiment of the present invention.

FIG. 10 is a diagram of the operational sequence of the image forming apparatus in this embodiment. This diagram shows the sequence in which two prints are continuously outputted.

In FIG. 10, the positions (raised position or base line) of the bold lines represent the operational states of the photoconductive drum and development roller: When the bold line is at the raised position, they are being rotationally driven. In this embodiment, the photoconductive drum 31 and development roller 38 are always kept in contact with each other. Therefore, while the photoconductive drum 31 is rotating, the development roller 38 is also rotating. However, in the case of apparatuses employing the so-called noncontact developing method in which a predetermined amount of gap is always kept between the peripheral surfaces of the photoconductive drum 31 and development roller 38, or in the case of apparatuses which employ a contact developing method, but in which the photoconductive drum and development roller are separable from each other, the photoconductive drum 31 and development roller 38 do not always rotate together.

Referring to FIG. 10, a signal requesting print output is sent from an unshown personal computer or the like, the photoconductive drum 31 and development roller 38 begin to be rotationally driven. As soon as the photoconductive drum 31 and development roller 38 begin rotating, the development bias and blade bias, which are virtually equal in potential at about −300 V, are applied from the development bias contact 40 and blade bias contact 41. At the same time, approximately −300 V is applied to the blade bias contact 41. In other words, the voltages supplied to the development bias contact 40 and blade bias contact 41 start up with approximately the same timings. The period immediately after the development roller 38, etc., begin to be rotated is a period in which the various components in the image forming apparatus are prepared for image formation;

in other words, it is a non-image formation period. Thus, during this period, the development blade rejuvenation is not necessary, and therefore, it is not necessary to provide the potential difference, even through this period is one of the non-image formation periods.

The first print is formed while the potentials of the development bias contact 40 and blade bias contact 41 remain approximately the same at −300 V (image formation period).

During this image formation period, the development roller 38 and development blade 39 remain approximately the same in potential. Therefore, the negatively charged external additive particles are made to migrate, by the rotation of the development roller 38 and the electric charge of the toner layer, from the portion of the development blade 39, in the contact area between the development roller 38 and development blade 39, to the portion of the development blade 39, in the adjacencies of the contact area, on the fixed edge side with respect to the contact area. However, the reversal toner particles, positively charged external additive particles, etc., do not adhere to the development blade.

As the period in which the first print is formed ends, the so-called "sheet interval", that is, the interval between the preceding image formation process and the following one, begins. During this sheet interval, the development bias is not applied. When the voltages applied to the development bias contact 40 and blade bias contact 41 attenuate, the voltage applied to the development bias contact 40 quickly attenuates, but the voltage applied to the blade bias contact 41 slowly attenuates at a rate tied to the time constant regulated by the resistor R1 and condenser C1 of the voltage attenuation retarding means 47.

As stated above, the voltage applied to the development roller 38 immediately drops, but the voltage applied to the development blade 39 slowly attenuates. Therefore, a certain amount of potential difference is created between the development roller 38 and development blade 39; a potential difference as large as 300 V is generated between the development roller 38 and development blade 39. This potential difference gradually reduces from the maximum difference of 300 V with the elapse of time.

This potential difference has the effect of transferring the negatively charged external additive particles having migrated from the portion of the development blade 39 in the contact area between the development roller 38 and 39, to the portion of the development blade 39, in the adjacencies of the contact area, on the fixed edge side of the development blade 39 with respect to the contact area, and adhering thereto, onto the development roller 38. As a result, the negatively charged external additive particles adhering to the surface of the development blade 39 are removed; the development blade 39 is rejuvenated. This process is carried out while the development roller 38 rotates. Therefore, once the negatively charged external additive particles are transferred onto the development roller 38, there is no chance for them to return to the development blade 39.

In this embodiment, the rate at which the voltage of the development blade 39 is allowed to drop by the voltage attenuation retarding means 47 is primarily determined by the amount of electric charge stored in the condenser C1. However, since the development roller is being rotated, negative electric charge generated by the friction between the development roller and development blade and between the development roller and toner particles is supplied from the development blade. Therefore, the apparent length of time the potential of the development roller 39 attenuates while being controlled by the voltage attenuation retarding means 47 is shorter than the theoretical voltage attenuation time determined by resistor R1 and the time constant of the condenser C1.

In this embodiment, the amount of the potential difference between the development roller 38 and development blade 39 reduced virtual zero in approximately 900 msec. The sheet interval in this embodiment is 1 second, which is long enough to provide potential difference between the development roller 38 and ebb 39 by the above described voltage attenuation retarding means in order to fully rejuvenate the development blade 39.

Next, the image formation on the second transfer medium P is carried out in the same manner as that on the first transfer medium P. During this image formation period, the negatively charged external additive particles are made to migrate from the portion of the development blade 39 in the contact area between the development roller 38 and development blade 39, to the portion of the development blade 39 in the adjacencies of the contact area, on the free edge side of the development blade 39 with respect to the contact area, and accumulate thereon, as described previously.

As the image formation on the second transfer medium P ends, the voltage from the high voltage power source 46 is turned off, as described above, when the preparatory post-rotation period, in which the image forming apparatus is prepared for the next print, begins.

Also during this preparatory post-rotation period, the voltage applied to the development blade 39 is controlled by the voltage attenuation retarding means so that potential difference is created for approximately 900 msec between the development roller 38 and development blade 39 as is in the sheet intervals.

With the presence of this potential difference between the development roller 38 and 39, the negatively charged external additive particles having migrated to the portion of the development blade 39, in the adjacencies of the contact areas between the development roller 38 and development blade 39, on the fixed edge side of the development blade 39 with respect to the contact area, from the portion of the development blade 39 in the contact area during the image formation on the second transfer medium P transfer onto the development roller 38. This process occurs while the development roller 38 rotates. Therefore, once the negatively charged external additive particles transfer onto the development roller 38, there is no chance for them to return to the development blade 39.

Then, the rotation of the development roller 38 and photoconductive drum 31 is stopped after the completion of the preparatory post-rotation process.

As described above, according to this embodiment, the development blade 39 is rejuvenated by returning the negatively charged external additive particles having migrated from the contact area between the development blade 39 and development roller 38 to the area of the development blade 39 in the adjacencies of the contact area, on the fixed edge side of the development blade 39 with respect to the contact area, to the development roller 38, by providing a predetermined potential difference (potential difference gradually reduced by voltage attenuation retardation control) between the development blade 39 and development roller 38, during the non-image forming periods. Therefore, the negatively charged external additive particles having migrated from the contact area between the development blade 39 and development roller 38 to the area of the development blade 39 in the adjacencies of the border of the contact area, on the fixed edge side of the development blade 39 with respect to the contact area, do not accumulate thereon. Therefore, the toner particles do not weld to the development blade 39.

The reason why a predetermined potential difference is provided between the development blade 39 and development roller 38 during the non-image formation periods is as follows: If potential difference is created between the two components during the image formation period, the amount by which the toner is allowed to remain on the peripheral surface of the development roller 38 abruptly changes, resulting in the formation of an image having a ghost border, across which image density is distinctively different.

In this embodiment, the length of time the predetermined potential difference is provided between the development roller 38 and development blade 39 is set to 900 msec. This setup, however, is not mandatory. There is no upper limit to the length of time the potential difference is provided between the development blade and development roller. However, the prolongation of the duration of the potential difference results in the reduction in printing speed. Therefore, several seconds or so is more than enough. Further, when the length of time the potential difference is provided is reduced, it is desired that the magnitude of the potential difference is increased.

Moreover, in this embodiment, in order to reduce the labor required of an operator involved in various maintenance works, the developing means inclusive of toner, which wears out relatively faster among the various image forming apparatus components and means, is transformed into a process cartridge removably mountable in the main assembly H of an image forming apparatus.

Figure 12:
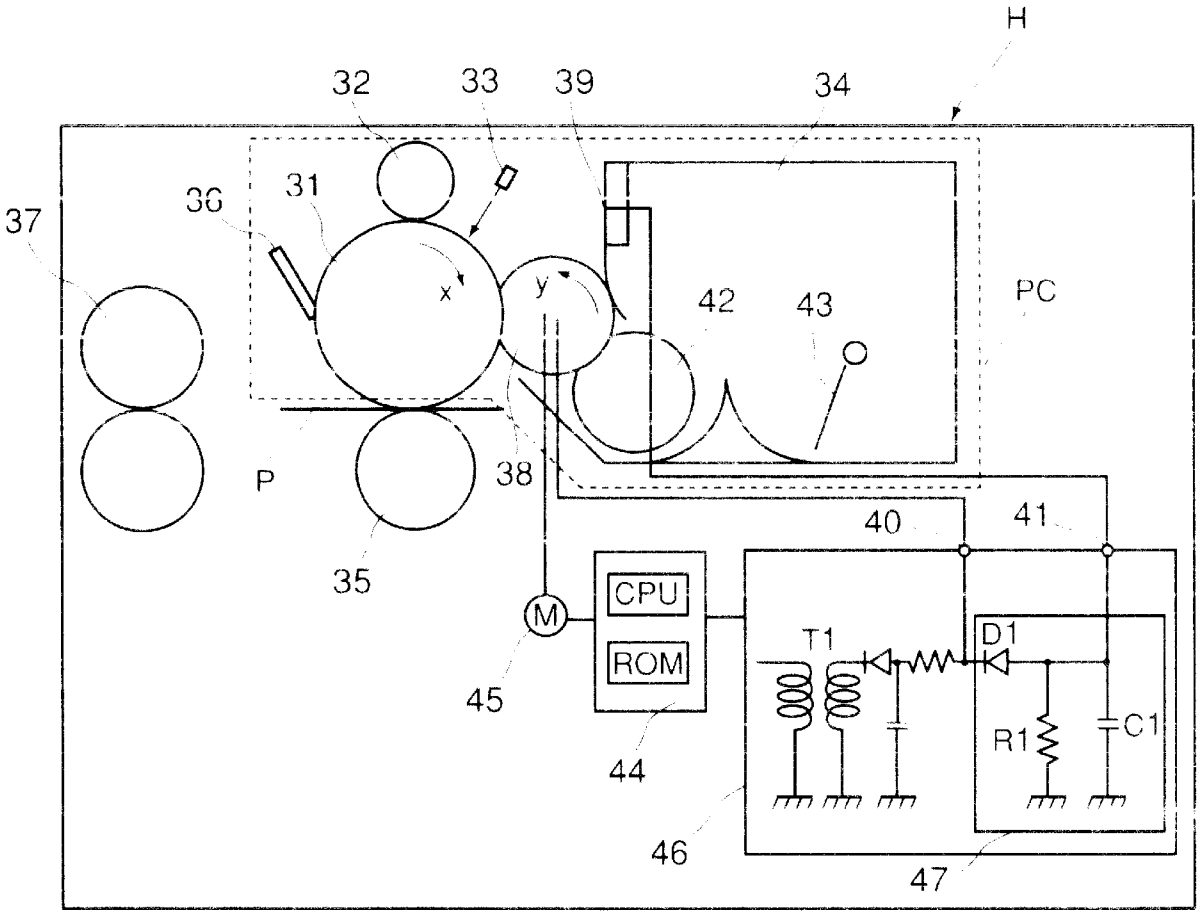
FIG. 12 is a schematic drawing of a modified version of the image forming apparatus in the fourth embodiment of the present invention.

Further, referring to FIG. 12, the process cartridge, into which the developing means is transformed, may be in the form of the so-called process cartridge PC, contoured by a dotted line, comprising the charge roller 32 as the primary charging device, and the cleaning means 36, in addition to the developing means.

Although the voltage attenuation retarding means for controlling the voltage attenuation, in this embodiment, is disposed in the high voltage power source of the image forming apparatus, this setup is not mandatory. As long as the potential of the development blade can be controlled (as long as voltage attenuation controlling means is a part of voltage application circuit), it may be outside the high voltage power source 46. For example, it may be disposed in the cartridge.

As described above, according to this embodiment, only a single voltage applying means is employed as a means to apply voltage to both the development roller and development blade. During the image forming period, voltage is applied to both the development roller and development blade by this voltage applying means in such a manner that both members remain the same in potential. Then, when the image formation period ends (part of non-image formation period), the voltages of the development roller and development blade are controlled by the voltage attenuation retarding means in a manner to keep the potential of the development blade higher than that of the development roller while keeping the development roller and development blade on the same side, in terms of polarity, as the developer, in order to accomplish the object of this embodiment, that is, to rejuvenate the development blade.

More specifically, the rates, at which the voltages of the development roller and development blade drop as the voltage applying means is turned off during the non-image formation period, are made different to create potential difference between the development roller and development blade, in order to return the external additive adhering to the development blade, to the development roller. Therefore, toner particles are caused to weld to the development blade, by the external additive particles adhering to the development blade. Therefore, images suffering from such insufficient density and/or unwanted vertical streaks that are traceable to the toner particles welded to the development blade are not formed.

(Embodiment 5)

Next, the fifth embodiment of the present invention will be described. The components in this embodiment similar to those in the preceding embodiment are given the same referential codes as those given to the corresponding ones in the preceding embodiment, and their descriptions will not be given here.

In the preceding embodiment, the lengths of the sheet intervals and preparatory post-rotation period were approximately one second, which was long enough for rejuvenating the development blade, even when the potential difference between the development blade and development roller was relatively small.

This embodiment is such an embodiment of the present invention that makes it possible to satisfactorily rejuvenate the development blade even if the lengths of the sheet intervals and preparatory post-rotation period are relatively short.

In order to accomplish the above object, the potential difference between the development blade and development roller is increased using the following method. That is, as the non-image formation period begins after the completion of the image formation period, the voltage of the high voltage power source 46 is briefly raised, and then, is controlled so that it attenuates at a slower rate than the voltage of the development roller. With the provision of this setup, the development blade can be sufficiently rejuvenated even if the length of time the potential difference is present is relatively short.

Figure 13:
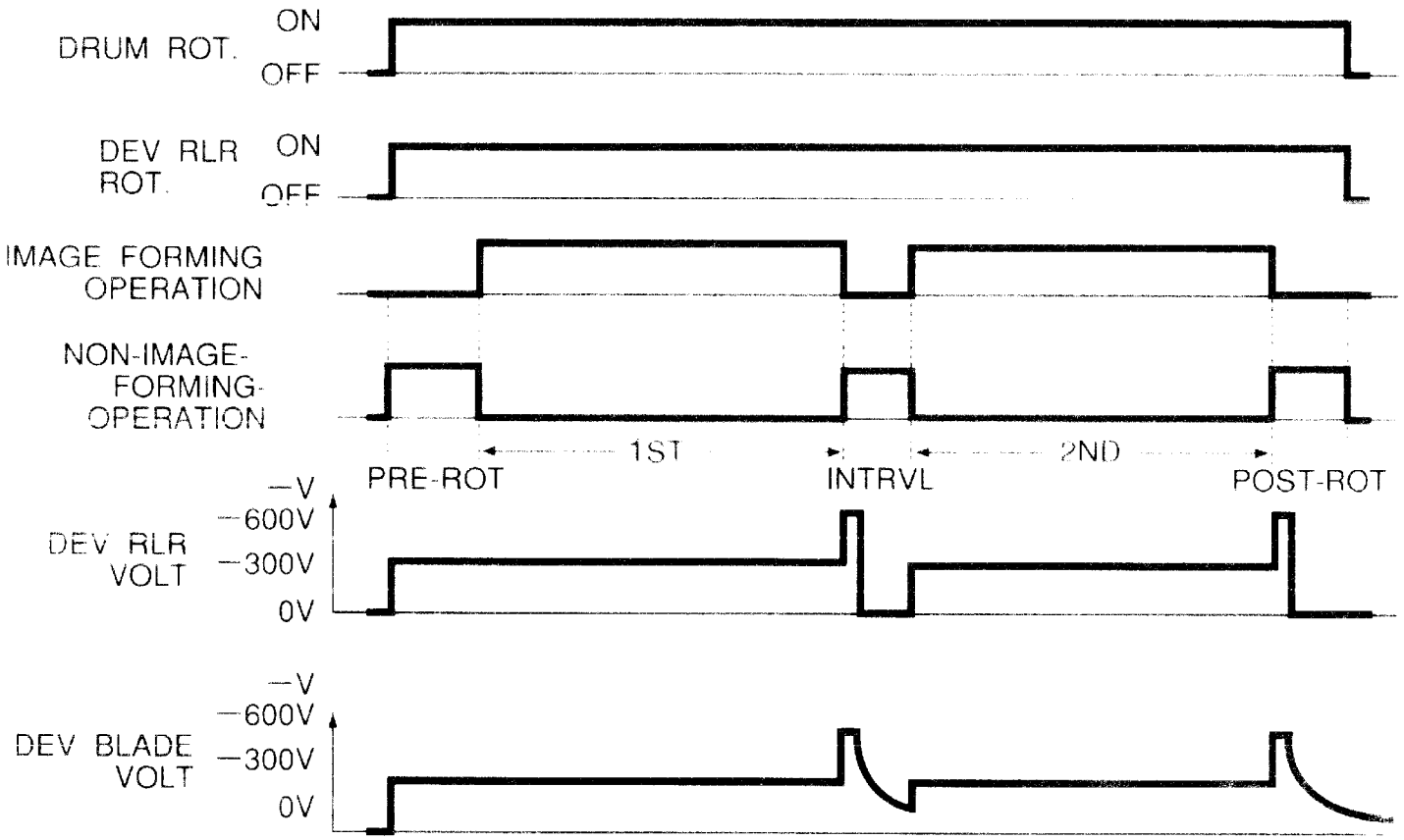
FIG. 13 is a diagram of the image formation sequence in the fifth embodiment of the present invention.

FIG. 13 is a diagram of the image forming sequence of the image forming apparatus in this embodiment.

Referring to FIG. 13, a signal requesting print output is sent from an unshown personal computer or the like, the photoconductive drum 31 and development roller 38 begin to be rotationally driven. As soon as the photoconductive drum 31 and development roller 38 begin rotating, the development bias and blade bias, which are virtually equal in potential at about −300 V, are applied to the development roller 38 and development blade 39 from the development bias contact 40 and blade bias contact 41. In other words, the voltages supplied to the development bias contact 40 and blade bias contact 41 start up with approximately the same timings.

The voltages of the development bias contact 40 and blade bias contact 41 are approximately the same at about −300 V, and the period in which the first print is produced begins (image formation period).

During this image formation period, the development roller 38 and development blade 39 remain approximately the same in potential. Therefore, the negatively charged external additive particles are made to migrate, by the rotation of the development roller 38 and the electric charge of the toner layer, from the portion of the development blade 39, in the contact area between the development roller 38 and development blade 39, to the portion of the development blade 39 in the adjacencies of the contact area, on the fixed edge side of the development blade with respect to the contact area. However, the reversal toner particles, positively charged external additive particles, etc., do not adhere to the development blade.

As the period in which the first print is formed ends, the so-called "sheet interval", that is, the interval between the preceding image formation process and the following one, begins.

As the sheet interval period begins, the voltage of the high voltage power source 46 is raised to −600 V. As a result, the voltages of the development bias contact 40 and blade bias contact 41 start up to −600 V. During this sheet interval, the surface potential of the photoconductive drum 31 is desired to be no less than −700 V. This is for preventing the formation of "fog", that is, the phenomenon that as the development bias is increased, toner particles are adhered to the areas of the transfer medium corresponding to white portions, and the like of the image thereon.

It took approximately 15 msec, in the actually clocked time, for the high voltage power source to start up.

After the high voltage power source 46 starts up in 15 msec, its output is turned off. As the high voltage power source 46 is turned off, the output voltage of the development bias contact 40 drops in short time.

However, the output of the blade bias contact 41 falls at a slower rate, because the electric charge having been accumulated in the condenser C1 of the voltage attenuation retarding means 47 is discharged.

Therefore, a potential difference as large as 600 V is created between the development roller 38 and development blade 39, and this potential difference gradually reduces with the elapse of time.

This potential difference has the effect of making the negatively charged external additive particles having migrated from the portion of the development blade 39 in the contact area between the development blade 39 and development roller 38, onto the portion of the 39 in the adjacencies of the contact area, on the fixed edge side of the development blade 39 with respect to the contact area, transfer onto the development roller 38. As a result, the external additive particles adhering to the development blade 39 are transferred onto the development roller 38; in other words, the development blade 39 is rejuvenated. Since this development blade rejuvenating process is carried out while the development roller 38 is rotated, there is no chance for the negatively charged external additive particles to return to the development blade 39.

In this embodiment, the sheet interval was set to 500 msec, and the output of the blade bias contact 41 fell below −300 V in approximately 400 msec. As long as the output of the blade bias contact 41 falls below −300 V, the output of the blade bias contact 41 does not affect the production of the next print (second print).

Then, the second print is produced as was the first print. During this image formation period, the negatively charge external additive particles migrate from the contact area between the development blade 39 and development roller 38 onto the portion of the development blade 39 in the adjacencies of the contact area, on the free edge side of the development blade 39 with respect to the development blade 39, and accumulate thereon, as described before.

As the period in which the second print is produced ends, the preparatory post-rotation period for the next print begins. Also during this period, the output of the blade bias contact 41 falls below −300 V in approximately 400 msec as does it during the sheet intervals. Then, the image forming operation ends. In other words, this preparatory post-rotation period is not followed by the image formation period. As a result, the electric charge in the condenser C1 is discharged in the length of time corresponding to the time constant of the condenser C1. Thus, the negatively charged external additive particles having migrated from the contact area between the development blade 39 and development roller 38 on the portion of the development blade 39 in the adjacencies of the contact area, on the fixed edge side of the development blade 39 with respect to the contact area, and having adhered thereto, are made to transfer onto the development roller 38 by the potential difference between the development roller 38 and development blade 39, as were they during the sheet interval. This process occurs while the development roller 38 rotates. Therefore, once the negatively charged external additive particles are transferred onto the development roller 38, there is no chance for them to return to the development blade 39.

Then, the preparatory post-rotation period ends, and the development roller 38 and photoconductive drum 31 stop rotating.

As described above, also in this embodiment, the development blade 39 is rejuvenated by returning to the development roller 38, the negatively charged external additive particles having been migrated from the contact area between the development roller 38 and development blade 39 onto the portion of the development blade 39 in the adjacencies of the contact area, on the fixed edge side of the development blade 39 with respect to the contact area, by briefly providing potential difference between the development blade 39 and development roller 38 during the non-image formation period. More specifically, according to this embodiment, the potentials of the development blade 39 and development roller 38 are raised by briefly raising the output of the high voltage power source 46 during the non-image formation period, and then, the potential difference is created by differentiating the development blade 39 from the development roller 38 in the rate at which their voltages fall, by the voltage attenuation regarding means 47. As a result, a greater amount of potential difference is created between the development blade 39 and development roller 38 during the non-image formation period. Therefore, even when the non-image formation period is relatively short, the development blade 39 is sufficiently rejuvenated. Therefore, the negatively charged external additive particles having been made to migrated from the contact area between the development blade 39 and development roller 38 onto the portion of the development blade 39 in the adjacencies of the contact area, on the fixed edge side of the development blade 39 with respect to the contact area, do not accumulate thereon. In other words, this embodiment is also capable of preventing the phenomenon that toner particles weld to the development blade 39 due to the permanent presence of the external additive particles on the development blade 39.

(Embodiment 6)

Figure 14:
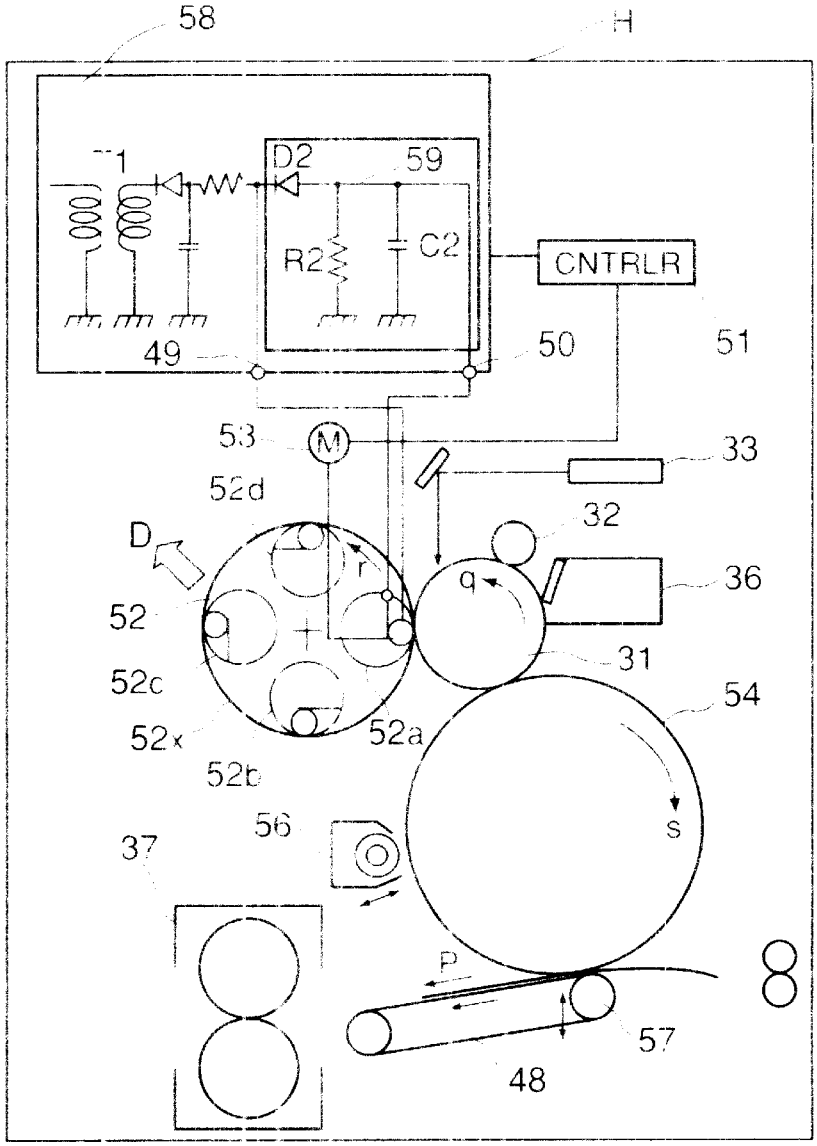
FIG. 14 is a schematic drawing of the image forming apparatus in the sixth embodiment of the present invention.

FIG. 14 is a schematic drawing of the image forming apparatus in the sixth embodiment of the present invention. The image forming apparatus in this embodiment is a color image forming apparatus. The primary components contained in the main assembly H of this image forming apparatus are: a photoconductive drum 31 as an image bearing member; a charge roller 32 as a charging means; an exposing device 33 for giving the image formation data; a developing device 52 for visualizing the electrostatic latent image on the photoconductive drum 31; an intermediary transferring member 54; etc.

The developing device 52 comprises: a rotary 52*x* as a development cartridge supporting member; a yellow color component development cartridge 52*a*, a magenta color component development cartridge 52*b*, a cyan color component development cartridge 52*c*, and a black color component development cartridge 52*d*.

The image forming apparatus in this embodiment is an electrophotographic color image forming apparatus. It separates an intended image into four color components, which are yellow Y, magenta M, cyan C, and black Bk, based on the image formation data sent from an unshown personal computer, work station, or the like, and sequentially forms four color toner images corresponding to the four color components, based on the four sets of image formation data separately derived from the original data. These color toner images are transferred in layers onto the intermediary transferring member, and then, are transferred all at once onto transfer medium (recording medium), such as a piece of paper, to obtain a full-color image. The image forming apparatus in this embodiment is the so-called rotary type color printer, that is, a color printer which employs a developing apparatus comprising the rotary and the plurality of developing means, that is, developing devices, mounted in the rotary.

Referring to FIG. 14, the image forming apparatus comprises an organic photoconductive drum 31 as an image bearing member. As an image forming operation is started, the photoconductive drum 31 is rotationally driven in the direction indicated by an arrow mark q. The peripheral surface of this photoconductive drum 31 is uniformly charged to a predetermined potential level, that is, the dark area potential level, by the application of bias to the metallic core of the charge roller 32 as a contact charging means. Then, the uniformly charged peripheral surface of the photoconductive drum 31 is exposed to the scanning laser beam projected from the exposing device 33 while being turned on and off in accordance with the image formation data for a first color component, or the yellow (Y) color component. As a result, the exposed points of the peripheral surface of the photoconductive drum 31 are reduced in potential level (to light area potential), effecting the first electrostatic latent image.

The electrostatic latent image formed through the above described process is developed into a visible image by one of the developing means (development devices) mounted in the rotary 52*x* of the developing device 52. The rotary 52*x* is structured for integrally holding a first development device 52*a* containing yellow (Y) toner as the toner of a first color, a second development device 52*b* containing magenta (M) toner as the toner of a second color, a third development device 52*c* containing cyan (C) toner as the toner of a third color, and a fourth development device 52*d* containing black (Bk) toner as the toner of a fourth color. It is rotated (in direction indicated by arrow mark r) to move a specific development device to the development station in which the device opposes the photoconductive drum 31. There is a toner layer with a predetermined thickness on the peripheral surface of the development roller, as a developer bearing member, of the development device in the development station in which the development device opposes the photoconductive drum 31. As the development roller as a developer bearing member is rotationally driven by a motor 53, a predetermined bias is applied to the metallic core of the development roller. As a result, the electrostatic latent image on the photoconductive drum 31 is developed. Each of the development devices 52*a*, 52*b*, 52*c*, and 52*d* is rendered discrete, being enabled to be replaced, independently from the others, as it wears out. Hereinafter, the first to fourth developing devices 52*a*, 52*b*, 52*c*, and 52*d* will be referred to as the first to fourth development cartridges 52*a*, 52*b*, 52*c*, and 52*d*, respectively.

First, the aforementioned first electrostatic latent image is developed into a visible image by the first development cartridge 52*a* containing Y toner as the toner of a first color. Whether a developing method is of a contact type or non contact type does not matter. In this embodiment, a latent image formed on the photoconductive drum 31 by exposure is reversely developed with the use of the combination of nonmagnetic single-component toner and a contact developing method.

The first toner image of a first color, that is, the first visualized image, is electrostatically transferred (primary transfer) onto the surface of the intermediary transferring member 54 as the second image bearing member, in the first transfer station, which is the transfer medium nipping portion between the photoconductive drum 31 and intermediary transfer member 54. The intermediary transferring member 54 comprises a cylinder as a substrate, an electrically conductive elastic layer coated on the peripheral surface of the cylinder, and a surface layer coated on the electrically conductive elastic layer.

The circumference of the intermediary transfer member 54 is greater than the length of the largest piece of transfer medium passable through the image forming apparatus. The intermediary transfer member 54 is kept pressed on the photoconductive drum 31 with the application of a predetermined amount of pressure, and is rotationally driven at virtually the same peripheral velocity as that of the photoconductive drum 31 in the direction (direction indicated by arrow s in FIG. 14) opposite to the rotational direction of the photoconductive drum 31 (in contact area, peripheral surface of photoconductive drum 31 and peripheral surface of intermediary transfer member 54 move in the same direction). To the cylinder portion of the intermediary transfer member 54, such voltage (primary transfer voltage) that is opposite in polarity to the toner is applied. As a result, the toner image on the peripheral surface of the photoconductive drum 31 is electrostatically transferred (primary transfer) onto the surface of the intermediary transfer member 54.

Meanwhile, the toner particles remaining on the peripheral surface of the photoconductive drum 31 after the completion of the primary transfer are removed by a cleaning means 36, in order to prepare the photoconductive drum 31 for the next latent image forming rotation.

Then, more image formation processes similar to the yellow image formation process described above are successively repeated. As a result, the toner image of a second color developed with the use of M toner, the toner image of a third color developed with the use of C toner, and the toner image of a fourth color developed with the use of Bk toner are sequentially transferred in layers onto the surface of the intermediary transfer member 54, effecting thereby a full-color toner image.

Thereafter, a transfer belt 48, which was kept away from the peripheral surface of the intermediary transfer member 54, is pressed upon the peripheral surface of the intermediary transfer member 54 with the application of a predetermined pressure, and is rotationally driven. There is disposed a transfer roller 57 within the loop formed by the transfer belt 48. To the transfer roller 47, voltage (secondary transfer bias) which is opposite in polarity to the polarity of the toner is applied. As a result, all the color toner images layered on the surface of the intermediary transfer member 54 are transferred all at once onto the surface of a transfer medium P delivered with a predetermined timing. Thereafter, the transfer medium P is conveyed to a fixing device 7, in which the full-color image, that is, the combination of four color toner images, is fixed to the transfer medium P, becoming a permanent full-color image. Then, the transfer medium P is discharged from the image forming apparatus as a full-color print of the intended full-color image.

The toner particles remaining on the peripheral surface of the intermediary transfer member 54 after the secondary transfer are removed by an intermediary transferring member cleaning apparatus 56 placed in contact with the peripheral surface of the intermediary transfer member 54 with a predetermined timing.

Figure 15:
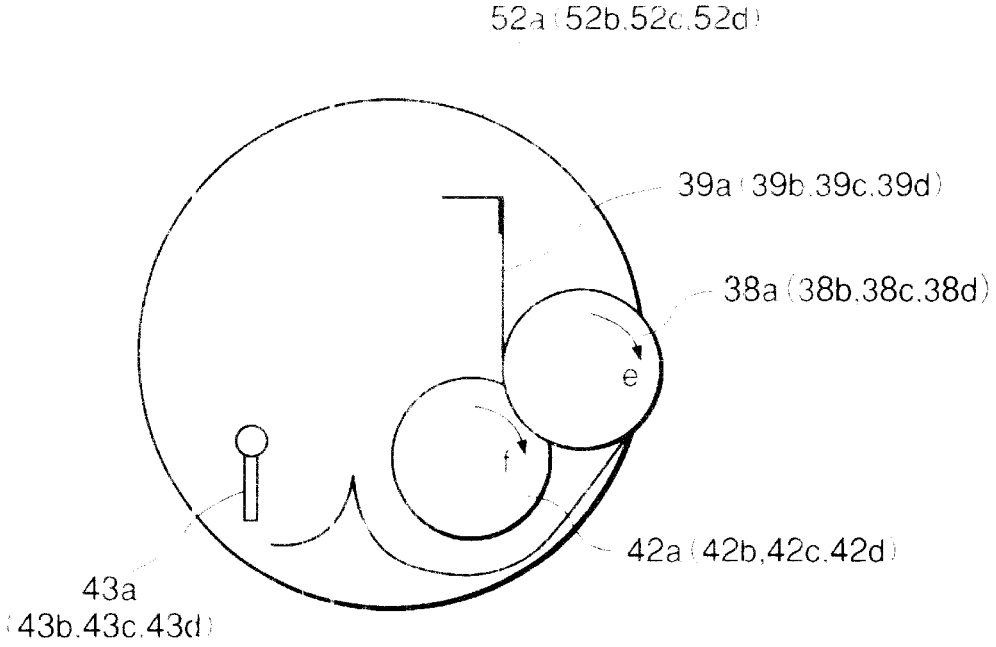
FIG. 15 is a schematic sectional view of the development cartridge in the sixth embodiment of the present invention.

FIG. 15 is a schematic sectional view of the development cartridge 52*a*, 52*b*, 52*c*, or 52*d*, as the developing means in this embodiment, containing Y, M, C, and Bk toners, respectively. It is for showing the structure of the development cartridge. These development cartridges 52*a*, 52*b*, 52*c*, and 52*d* are structured so that they can be removably mounted into the rotary type color printer, as an example of image forming apparatus, shown in FIG. 14, by opening and closing an unshown cartridge exchange cover. When the rotary 52*x* is in the state shown in FIG. 14, that is, when the cyan color development cartridge 52*c* mounting space is at the cartridge removal position, the cyan color development cartridge 52*c* can be removed in the diagonally upward direction indicated by an arrow mark D.

In the case of the rotary type color printer shown in FIG. 14, the development cartridge must be mounted into, or removed from, the image forming apparatus main assembly when the corresponding cartridge mounting space is at the cartridge removal position (mounting position). Thus, in order to replace the yellow, magenta, or black color development cartridges 52*a*, 52*b*, or 52*d*, that is, a cartridge other than the cyan color development cartridge 52*c*, the rotary 52*x* must be rotated so that the corresponding cartridge mounting space comes to the cartridge removal position (position of cartridge 52*c* in FIG. 14).

Hereinafter, for the simplification of the description of the development cartridges, only the development cartridge 52*a* containing Y toner will be described. The descriptions of the-development cartridges 52*b*, 52*c*, and 52*d* containing other color toners, one for one, are virtually the same as that of the development cartridge 52*a*.

The development cartridge 52*a* in this embodiment, shown in FIG. 15, is a reversal developing means in which nonmagnetic single-component Y toner as developer is contained.

This development cartridge 52*a* comprises: a development roller 38*a* which develops a latent image on the peripheral surface of the photoconductive drum 31 as it is rotated in contact with the peripheral surface of the photoconductive drum 31 in the direction indicated by an arrow mark e in the drawing; a supply roller 42*a* as a toner supplying means which is rotated in the direction indicated by an arrow mark f to supply the development roller 38*a* with toner; a development blade 39*a* as a developer regulating member for regulating the amount by which the toner is allowed to remain on the development roller 38*a*, as well as the amount by which the toner on the development roller 38*a* is given electric charge; a stirring member 43*a*, for supplying the supply roller 42*a* with toner while stirring the toner; etc.

Figure 16:
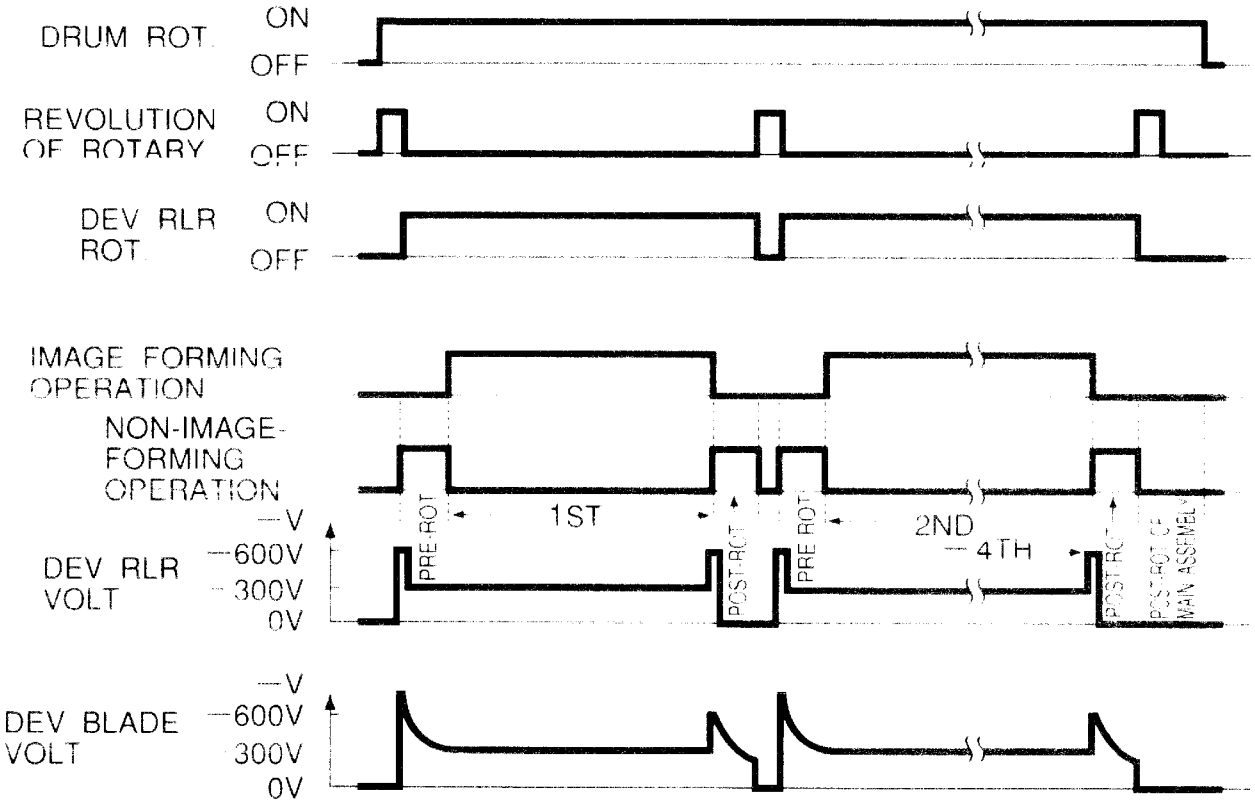
FIG. 16 is a diagram of the image formation sequence in the sixth embodiment of the present invention.

FIG. 16 is a diagram of the image forming operation of the image forming apparatus in this embodiment. In this embodiment, potential difference is created between the development roller 38*a* and development blade 39*a* using the following method. That is, during the preparatory pre-rotation period, the voltages of the development roller 38*a* and development blade 39*a* are kept at a higher potential level for a brief moment by making the high voltage power source 58 to overshoot, and then, immediately afterward, they are allowed to return to the predetermined normal potential level (−300 V). During this period in which the voltages are allowed to return to the normal potential level, the voltage of the development blade 39*a* is subjected to the voltage attenuation retarding control in order to create potential difference between the development roller 38*a* and development blade 39*a*.

In this embodiment, the values of the resistor R2 and condenser C2 were 100 MΩ and 4,700 pF, respectively.

The length of the time the potential difference is maintained during the preparatory pre-rotation period can be adjusted by controlling the length of the time the high voltage power source is made to overshoot. In this embodiment, the duration of the potential difference was 220 msec.

Since the condenser C2 has not been charged when the development bias begins to be started up, the length of time the potential difference is maintained during the preparatory pre-rotation period is shorter than the length of time the potential difference is maintained during the preparatory post-rotation period, which will be described later.

Referring to FIG. 16, as the printer is requested by an unshown personal computer or the like to output images, the photoconductive drum 31 is rotated, and the rotary 52*x* begins to be rotated to move the developing device 52*a* for a first color, in a manner to orbit about the axial line of the rotary 52*x*, to the development station in which the developing device 52*a* opposes the photoconductive drum 31. As the developing device 52*a* for a first color (yellow) arrives at the development station, the preparatory pre-rotation of the development roller 38*a* is started. At the same time, voltage (−700 V) begins to be supplied to the development bias contact 49 and blade bias contact 50.

Immediately thereafter, the output of the high voltage power source 58 is reduced to the predetermined normal development bias voltage (−300 V). As a result, the voltage of the development bias contact 49 quickly falls to −300 V. However, there has been accumulated a certain amount of electric charge in the condenser C2 of the voltage attenuation retarding means 59, the voltage of the blade bias contact 50 attenuate at a slower rate than the rate at which the voltage of the development bias contact 49 attenuates, creating, between the development blade 39*a* and development roller 38*a*, the potential difference for causing the negatively charge particles (toner particles and external additive particles) to transfer from the development blade onto the development roller.

As a result, the negatively charged external particles adhering to the development blade 39*a* are transferred onto the development roller 38*a* (development blade 39*a* is rejuvenated) immediately after the development roller 38 begins to be rotated.

As the electric charge in the condenser C2 is completely discharged, the output values of the development bias contact 49 and blade bias contact 50 become equal (−300 V), and the image formation for a first color begins (image formation period).

During this image formation period, the development roller 38*a* and development blade 39*a* remain approximately the same in potential level. Therefore, the negatively charged external additive particles are made to migrate, by the rotation of the development roller 38*a* and the electric charge of the toner layer, from the portion of the development blade 39*a*, in the contact area between the development roller 38*a* and development blade 39*a*, to the portion of the development blade 39, in the adjacencies of the contact area, on the fixed edge side with respect to the contact area. However, the reversal toner particles, positively charged external additive particles, etc., do not adhere to the development blade 39*a*.

As the image formation for a first color ends, the preparatory post-rotation period for the developing device 52*a* begins. During this period, the output of the high voltage power source 58 is raised to −600 V as was in the fifth embodiment, and then, is immediately turned off. As a result, the output of the development bias contact 49 quickly falls. However, because the condenser C2 has been fully charged, the output of the blade bias contact 50 gradually attenuates, creating potential difference between the development roller 38*a* and development blade 39*a*. Therefore, the negatively charged external additive particles having adhered to the development blade 39*a* of the yellow color component developing device during the image formation period are transferred onto the development roller (development blade is rejuvenated).

Then, the rotation of the development roller 38*a* is stopped, and the rotary 52*x* is rotated to prepare the image forming apparatus for the formation of the next color (magenta). During this rotation of the rotary 52*x* for moving the process cartridges in the manner to orbit about the rotational axis of the rotary 52*x*, voltage is not supplied from the development bias contact 49 and blade bias contact 50.

As the development cartridge 52*b* for a second color (magenta) is moved into the development station in which it opposes the photoconductive drum 31, the rotation of the rotary 52*x* is stopped.

Then, the preparatory pre-rotation of the development roller 38*b* is started as was the development roller 38*a* of the development cartridge 52*a* for a first color (yellow). At the same time, voltage substantially higher than the normal voltage begins to be supplied from the development bias contact 49 and blade bias contact 50. Then, the image formation process for a second color is carried out as was that for the first color. During this image formation, the negatively charge external additive particles are made to migrate from the contact area between the development roller 38*b* and development blade 39*b* onto the portion of the development blade 39*b* in the adjacencies of the contact area, on the free edge side of the development blade 39*b* with respect to the contact area, and accumulate thereon. Then, the development blade 39*b* is rejuvenated. The process similar to those carried out in the process cartridge 52*a* and process cartridge 52*b* is carried out in the rests of the process cartridges (for third and fourth colors).

Since the negatively charged external additive particles having adhered to the development blade during the preceding image forming period are transferred onto the development roller during the preparatory pre-rotation period for the image formation for each color, the external additive particles do not accumulate on the development roller, making it possible to provide a reliable image forming apparatus.

As the image formation for a fourth color ends, the preparatory post-rotation for the fourth color begins. During this period, bias is applied in a manner to create potential difference as described above. Thereafter, the rotation of the development roller is stopped, and the rotary 52*x* is rotated in a manner to make the process cartridges about the rotational axis of the rotary 52*x*. As the result of this rotation of the rotary 52*x*, the development roller is disconnected from the development bias contact 49 and blade bias contact 50, being prevented from being supplied with voltage. Therefor, the electric charge in the condenser C2 discharges through the resister R2.

As this image formation period ends, and the rotation of the rotary 52*x* ends, the post-rotation period for the apparatus main assembly, in which the intermediary transfer member 24, photoconductive drum 31, etc., are preparatorily rotated for the next printing operation, begins. Then, the rotation of the photoconductive drum 31 is stopped after this post-rotation period.

As described above, in this embodiment, the bias for transferring the negatively charged external additive particles from the development blade onto the development roller during the preparatory pre-rotation period is created by making the high voltage power source overshoot. However, this method is not mandatory. For example, the effect similar to that in this embodiment can also be obtained by presetting the output of the high voltage power source to a potential level higher than the predetermined normal potential level.

In addition, the components, the developing means inclusive of toner, which wears out relatively faster among the various image forming apparatus components and means, is integrally disposed in a cartridge removably mountable in the main assembly H of an image forming apparatus. Therefore, the labor required of an operator involved in various maintenance works is substantially reduced.

Although the voltage attenuation retarding means for retarding the voltage attenuation, in this embodiment, is disposed in the high voltage power source of the image forming apparatus, this setup is not mandatory. As long as the potential of the development blade can be controlled (as long as voltage attenuation retarding means is a part of voltage application circuit), it may be outside the high voltage power source 46. For example, it may be disposed in the cartridge.

As described above, according to this embodiment, the development blades can be rejuvenated even in a full-color image-forming apparatus, as in the preceding embodiment, using the following method: a single voltage applying means is employed as a means to apply voltage to both the development roller and development blade. During the image forming period, voltage is applied to both the development roller and development blade by this voltage applying means in such a manner that both members remain the same in potential, whereas during a part of the non-image formation period, the potential of the development blade is made greater than that of the development roller by increasing the potential of the development blade while keeping the development roller and development blade on the same side, in terms of polarity, as the developer, creating potential difference between the development blade and development roller. Therefore, even the development blades in a full-color image forming apparatus can be rejuvenated as is the development blade in the preceding embodiment; the object of the present invention is accomplished.

More specifically, the voltage applying means is caused to overshoot for a brief moment when it is turned on during the non-image formation period. Then, potential difference is created between the development roller and development blade by differentiating the rate at which the voltage of the development roller falls from the rate at which the voltage of the development blade falls. This potential difference makes the negatively charged external additive particles adhering to the development blade return to the development roller. Therefore, the phenomenon that toner particles weld to the development blade due to the presence of the external additive particles adhering to the development blade does not occur. Therefore, images suffering from the insufficient density and unwanted vertical streaks traceable to the welding of toner particles to the development blade are not formed.

(Image Evaluation Tests)

Next, the results of the image evaluation tests carried out to compare the image forming apparatuses in the first to sixth embodiments with the image forming apparatuses prepared as comparative examples will be shown.

The following image forming apparatuses were prepared as the comparative image forming apparatuses.

Comparative Apparatus 1: it is similar to the image forming apparatus in the first embodiment, except that the biases applied to the development roller 8 and development blade 9 were kept the same in potential (−300 V) during both the image formation period and non-image formation period; in other words, potential difference was not provided between the development roller 8 and development blade 9.

Comparative Apparatus 2: it is similar to the image forming apparatus in the first embodiment, except that biases of −300 V and −600 V were applied to the development roller 8 and development blade 9, respectively, during both the image formation period and non-image formation period; in other words, potential difference was provided between the development roller 8 and development blade 9 even during the image formation period.

The image forming apparatuses in the preceding embodiments, and the comparative image forming apparatuses, were each operated to output 2,000 copies of a pattern with a predetermined printing ratio in the normal ambience. Then, the copies were evaluated regarding the insufficient density and unwanted vertical streaks. More specifically, a solid images and a halftone image were outputted for every 500 copies, and these solid and halftone images were evaluated.

The results are shown in Table 1. It is evident from the results given in the table that toner particles did not weld to the development blades in any of the image forming apparatuses in accordance with the present invention, allowing the image forming apparatuses in accordance with the present invention to reliably form satisfactory images for a long period of time.

In Table 1, G means the presence of no image defect, and N means the occurrence of the insufficient image density and unwanted vertical streaks.

TABLE 1

| | | NO. OF PRINTS | | | | |
|---|---|---|---|---|---|---|
| | EVALUATION | 0 | 500 | 1000 | 1500 | 2000 |
| EMB.1 | LOW DENSITY | G | G | G | G | G |
| | STRIPE | G | G | G | G | G |
| EMB.2 | LOW DENSITY | G | G | G | G | G |
| | STRIPE | G | G | G | G | G |
| EMB.3 | LOW DENSITY | G | G | G | G | G |
| | STRIPE | G | G | G | G | G |
| EMB.4 | LOW DENSITY | G | G | G | G | G |
| | STRIPE | G | G | G | G | G |
| EMB.5 | LOW DENSITY | G | G | G | G | G |
| | STRIPE | G | G | G | G | G |
| EMB.6 | LOW DENSITY | G | G | G | G | G |
| | STRIPE | G | G | G | G | G |
| COMP. | LOW DENSITY | G | G | G | G | G |
| EX. 1 | STRIPE | G | G | N | N | N |
| COMP. | LOW DENSITY | G | G | G | N | N |
| EX. 2 | STRIPE | G | G | G | G | N |

G: Good,
N: No good

Further, the image forming apparatuses in the preceding embodiments, and Comparative Apparatuses 1 and 2, were left one week in a high temperature/high humidity ambience (30° C. and 80% RH). Then, they were tested for toner leakage. The apparatuses in the embodiments, and Comparative Apparatus 2 did not show any sign of toner leak, but Comparative Apparatus 1 leaked toner.

The cause for the toner leak from Comparative Apparatus 1 seems to be that the toner was unevenly charged and contained a large amount of reversely charged toner particles.

The image forming apparatuses in the preceding embodiments were monochromatic copying machines or full-color copying machines. This does not means that the scope of the prevent invention should be limited to these copying machines. On the contrary, the present invention is applicable to a wide range of image forming apparatuses, such as printers, facsimile machines, monochromatic copying machines, etc., comprising developing means for forming developer images, using an electrophotographic or electrostatic recording method.

(Embodiment 7)

Figure 17:
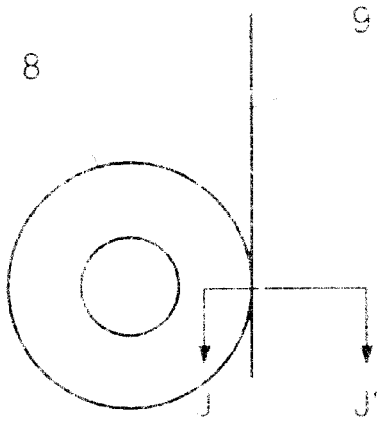
FIG. 17 is a schematic drawing for depicting the imperfections of the toner layer on the development roller.
Figure 17:
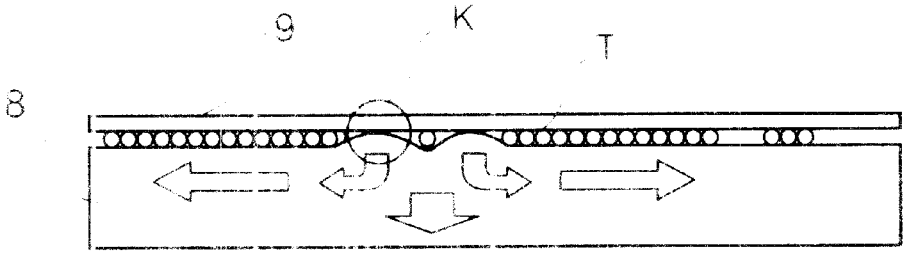
Figure 18:
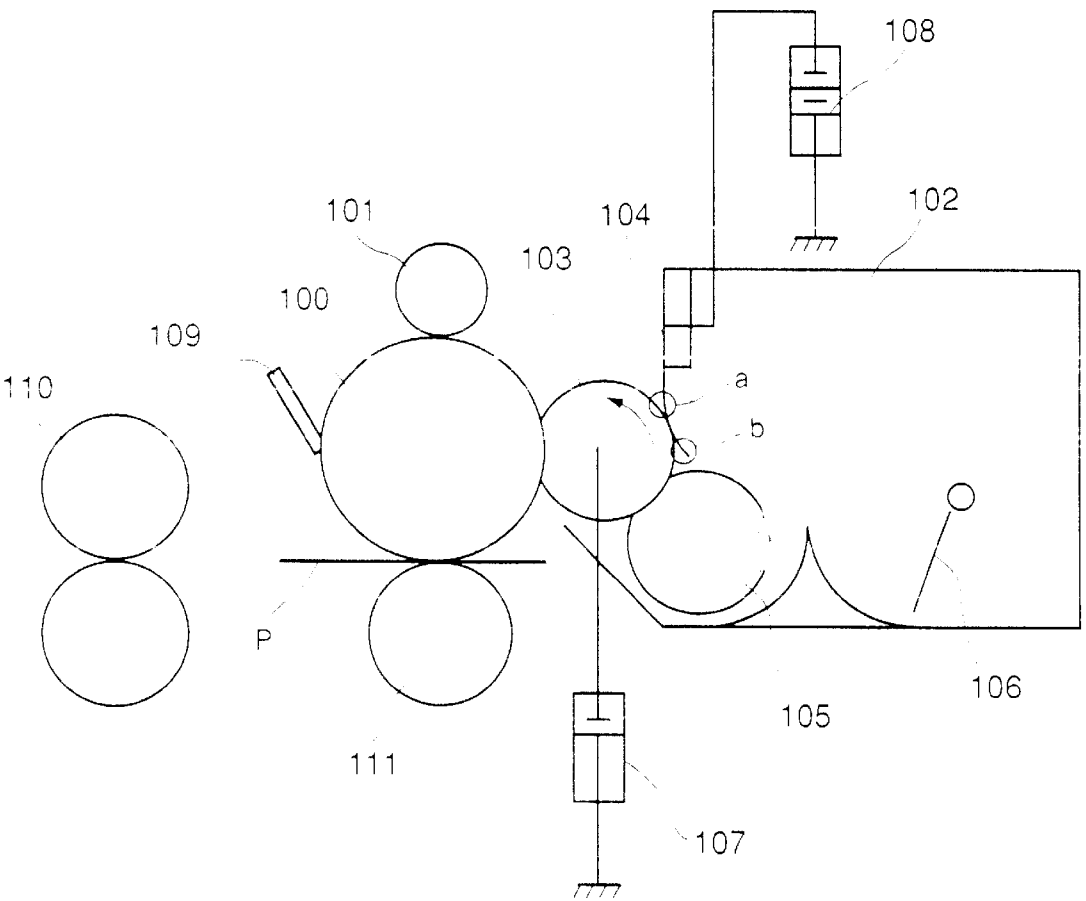
FIG. 18 PRIOR ART
FIG. 18 is a schematic drawing of a typical image forming apparatus in accordance with the prior art.

Hereinafter, the seventh embodiment of the present invention will be described with reference to FIG. 17. The components in this embodiment similar to those in the first embodiment will be given the same referential codes as those in the first embodiment, and they will not be described here. FIG. 17 is a drawing for depicting the imperfections of the toner layer on the development roller; FIG. 17(*a*) is a schematic sectional view of the development roller and development blade in contact with each other, and FIG. 17(*b*) is an enlarged sectional view of the interface between the development roller and development blade and its adjacencies, at the plane J–J' in FIG. 17(*a*).

In the preceding embodiments, there is a toner layer between the development roller and development blade. Toner is normally insulative. Therefore, the toner layer between the development roller and development blade has a large amount of electric resistance.

However, there are times when the toner layer has defects in terms of electric resistance. For example, toward the end of the service life of a process cartridge, the toner layer sometimes has holes, because, toward the end of the service life of a process cartridge, the amount of the toner in a process cartridge has become very small due to consumption, making it virtually impossible for the toner to be borne on the development roller by the normal amount. Further, foreign substances (paper dust, etc.,) sometimes enter the contact area between the development roller and development blade, and push away the toner particles, making the toner layer defective in terms of electric resistance. When the Stoner layer has such defects as those described above, the following problems occur: If there are through holes in the toner layer, the development blade 9 directly contacts the development roller 8 while the portion of the toner layer having through holes in the contact area (area K in FIG. 17(*b*)) is in the contact area.

In particular, if the current capacity is small and the surface resistance of the development roller 8 is also small, the voltage of the surface of the development roller 8 assimilates the voltage applied to the development blade 9, preventing the desired potential difference from being created between the development roller and development blade. As a result, images suffering from unwanted vertical streams are formed.

Therefore, in this embodiment realized in consideration of the above described problem, the formation of images suffering from defects such as the unwanted vertical streaks is prevented by making it possible to creating potential difference between the development roller and development blade even when the development roller and development blade have direct contact with each other.

In the first embodiment realized as the result of zealous studies, two power sources were provided to secure sufficient current capacity. In the fourth embodiment and the like, however, the potential difference is created between the development roller 38 and development blade 39 by discharging the electric charge accumulated in the condenser C1 of the voltage attenuation retarding means 47, through the development roller 38.

In other words, the electrical discharge from the condenser C1 is used to create the potential difference. Therefore, if the surface or bulk resistance of the development roller is small, the electric charge escapes in the lengthwise direction of the development roller, across the surface thereof, being not likely to create a potential difference of the desired magnitude. Further, if the surface or bulk resistance of the development roller is small, the time constant of the regarding means 47 becomes virtually independent from the resister R1; the time constant becomes very small.

In this embodiment, the electric resistance of the development roller is adjusted so that the desired potential difference can be obtained even if the development blade directly contacts the development roller.

As described before, the potential difference is dependent upon the amount of electric charge which can be discharged. Therefore, the development roller resistance range, in which the development roller is satisfactorily usable when two power sources are employed is that when a single power source is employed; the range is narrower when a single power source is employed, for the following reason. That is, when two power sources are employed, the electric current flowed to the development roller through the development blade can be increased within the power source capacity. However, in the case of a single power source, the amount by which electric current is allowed to flow to the development roller through the development blade is dependent upon the amount of the electric charge storable in the condenser C1, since the amount of the electric current which flows to the development roller through the development blade is dependent upon the amount of the electrical discharge from the condenser C1.

Therefore, the surface resistance and bulk resistance of the development roller are desired to be set to appropriate values with reference to the values given below.

As for the surface resistance, it is desired to be no less than $8\times10^5$ Ω, preferably $7\times10^6$ Ω. If the surface resistance of the development roller is no less than $8\times10^5$ Ω, it is difficult to create the desired potential difference between the development roller and development blade when they are directly in contact with each other.

The bulk resistance of the development roller is desired to be no less than $3\times10^5$ Ω, preferably, $1\times10^6$ Ω. If it is no more than $3\times10^5$ Ω it is difficult to realize the desired time constant.

Further, the value of the surface resistance of the development roller is desired to be greater by one or more places in the decimal system than the bulk resistance of the development roller, because potential difference is easier to create between the development roller and development blade when the resistance value of the surface layer is greater than when otherwise.

As described above, in the case of this embodiment, the usable resistance range for the development roller is narrower than that in the preceding embodiments. However, keeping the development roller resistance within the aforementioned range is not a particularly difficult manufacture requirement; it is possible to reliably manufacture development rollers, the resistance of which is in the above range.

(Image Evaluation Tests)

As for the electric resistance of the development roller in this embodiment, the surface resistance was $3\times10^6$ Ω and the bulk resistance was $8\times10^5$ Ω.

As for the electric resistance of the comparative development roller, the surface resistance and bulk resistance were $1.2\times10^5$ Ω, and $9\times10^4$ Ω, respectively.

These development rollers were mounted in the image forming apparatus, and each development blade is placed directly in contact with the development roller by arbitrarily creating a toner free area on the development roller. Then, these apparatuses structured as described above were operated in the normal ambience to output approximately 2,000 copies of a predetermined pattern with a predetermined printing ratio, to evaluate this embodiment. More specifically, a solid image and a halftone image were outputted for every 500 prints for the evaluation.

(Evaluation Results)

The comparative apparatus began to produce images suffering from unwanted vertical streaks after it printed approximately 1,000 copies. The apparatus in accordance with this embodiment, however, did not produce images suffering from unwanted vertical streams while printing approximately 2,000 copies.

In this embodiment, only a single power source was employed. However, the employment of only a single power source is not mandatory. In other words, this embodiment is also compatible with an image forming apparatus employing two power sources, since the capacities of the power sources can be reduced by employing a development roller, the electric resistance of which is in the above range.

As described above, according to this embodiment, even if the development blade directly contacts the development roller due to the presence of the toner-free areas on the peripheral surface of the development roller, the formation of images suffering from unwanted vertical streams can be prevented by adjusting the electric resistance of the development roller.

(Embodiment 8)

Figure 20:
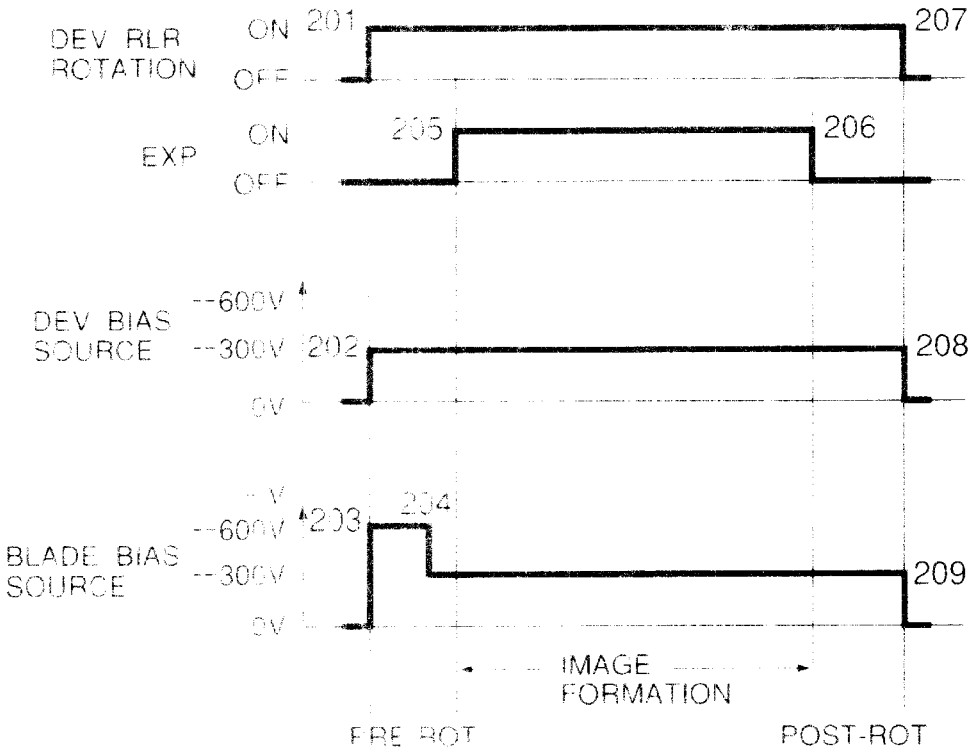
FIG. 20 is a diagram of the image formation sequence in the eighth embodiment of the present invention.

Next, the image formation sequence in this embodiment will be described with reference to FIG. 20. This sequence is compatible with the image forming apparatus depicted in FIG. 2.

As a signal requesting print output is sent from an unshown personal computer or the like, the preparatory pre-rotation period begins, in which the development roller begins to be rotated at Point 201 in the drawing. Here, the preparatory pre-rotation period means the period in which the development roller is rotated immediately before the start of the actual image forming operation (non-image formation period).

In this embodiment, the photoconductive drum 1 and development roller 8 are always in contact with each other. Therefore, while the photoconductive drum 1 is rotating, the development roller 8 is also rotating. However, in the case of apparatuses employing the so-called noncontact developing method in which a predetermined amount of gap is always kept between the peripheral surfaces of the photoconductive drum and development roller, or in the case of apparatuses which employ a contact developing method, but in which the photoconductive drum and development roller are separable from each other, the photoconductive drum 1 and development roller 8 do not always rotate together. In other words, it is not mandatory that the photoconductive drum 1 and development roller 8 always rotate together.

As soon as the development roller begins to be rotated (201), the development blade power source begins to apply a DC bias of −300 V to development roller 8 (202), and blade bias power source begins to apply a DC bias of −600 V to the development blade 9 (203). Then, the blade bias power source reduces the magnitude of the voltage being applied to the development blade, to −300 V (204). The length of time −600 V is applied in this embodiment is 500 msec.

This application of −600 V and −300 V to the development blade 9 and development roller 8 at the beginning of the preparatory pre-rotation period creates potential difference effective to transfer onto the development blade, the reversal toner particles, that is, positively charged toner particles, responsible for toner leak. As a result, the toner particles in the toner layer coated on the development roller become more uniform in potential as well as polarity. Therefore, toner does not leaks at the beginning of the rotation of the development roller 8.

After the brief application of −600 V to the development blade while −300 is applied to the development roller 8, the voltages of the development bias power source 10 and development blade power source 11 are kept approximately the same at about −300 V, reducing the potential difference between the development roller 8 and development blade 9 to virtually 0 V. Then, the image formation period, in which photoconductive drum is exposed and a toner image is formed, begins (205).

In this image formation period, the development roller 8 and development blade 9 are approximately the same in potential. Therefore, a small amount of negatively charged external additive particles are transferred onto the development blade by the charge of the toner layer. However, the reversal toner particles, which effect images suffering from insufficient density and unwanted vertical streaks, do not adhere to the development blade.

As the exposure of the photoconductive drum 1 is stopped, that is, as the image formation period ends (206), the preparatory post-rotation period begins. Then, at the end of the preparatory post-rotation period, the rotation of the development roller is stopped (207); the development bias power source is turned off (208); and the blade bias power source is turned off, ending the image forming operation.

In this embodiment, a bias similar to the bias provided during the image formation period is also provided during the so-called "sheet intervals" in an image forming operation in which two or more prints are continuously outputted; the development roller and development blade are kept the same in potential by applying −300 V thereto from the development blade power source and blade bias power source. However, this setup is not mandatory. For example, even during the "sheet intervals", −300 V and −600 V may be applied to the development roller and development blade, respectively, to create potential difference between the development roller and development blade as during the preparatory pre-rotation period. With this setup, the negatively charged external additive particles capable of adhering to the development blade 9 during the image formation period can be returned to the development roller 8.

Further, also during the preparatory post-rotation period, potential difference may be provided between the development roller and development blade by making the development blade power source and blade bias power source different in the potential of the voltage they apply to the development roller and development blade, respectively, as in the preparatory pre-rotation period.

Further, in this embodiment, the output of the blade bias power source is abruptly switched from −600 V to −300 V at Point 204. However, this is not mandatory. All that is necessary is that the output is switched during the non-image formation period; it may be gradually reduced or in steps. The reason why potential difference is provided between the development roller and development blade during the non-image formation period is that if potential difference is created while the development roller and development blade are the same in potential, the amount by which toner is allowed to remain on the development roller 8 abruptly changes, resulting in the formation an image suffering from a ghost unwanted border, across which image density is distinctively different.

Also in this embodiment, the length of time potential difference is provided between the development blade and development roller is set to 500 msec. This is not mandatory. However, in order to rejuvenate the development blade, 5 msec or more is necessary. There is no upper limit to the duration of the potential difference between the development blade and development roller. However, the prolongation of the duration of the potential difference results in the reduction in printing speed. Therefore, several seconds or so is more than enough.

Moreover, in this embodiment, the potential difference is provided only once during the preparatory pre-rotation period, and its duration is 500 msec. However, the potential difference may be provided twice or more times during the preparatory pre-rotation period, for example.

(Embodiment 9)

Figure 21:
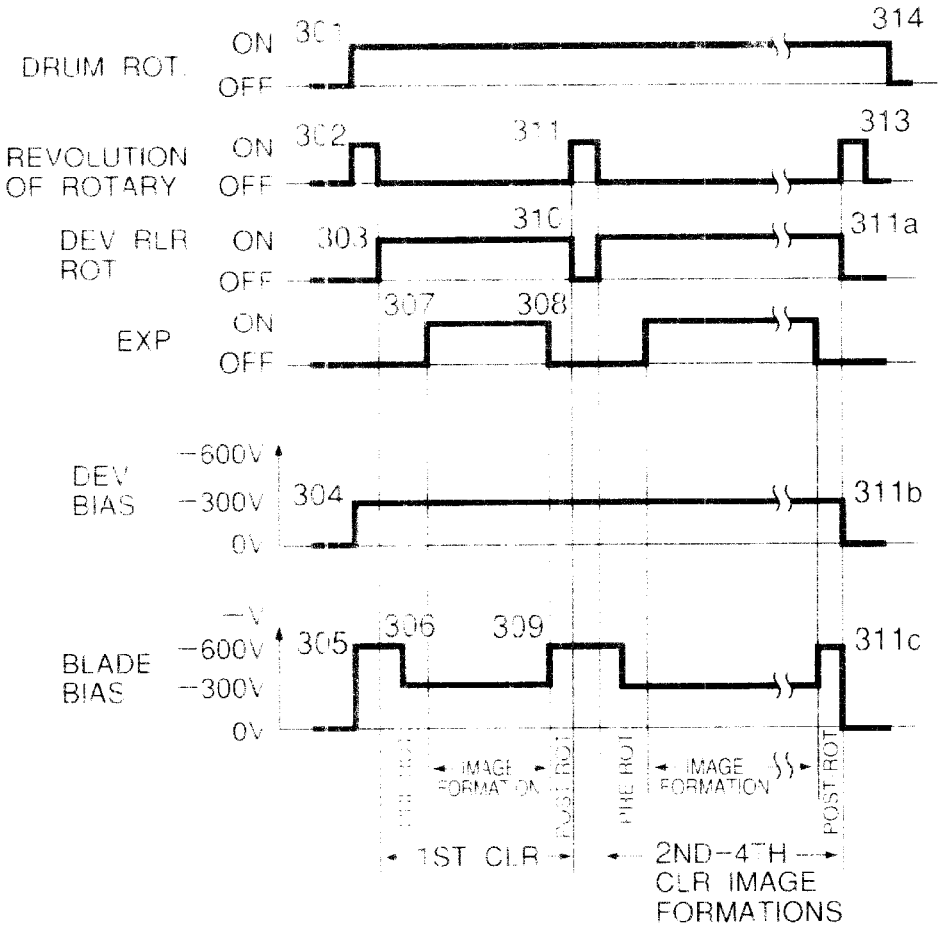
FIG. 21 is a diagram of the image formation sequence in the ninth embodiment of the present invention.

FIG. 21 is a diagram of the image forming sequence in the ninth embodiment. This image formation sequence is compatible with the image forming apparatus in FIG. 5. Referring to FIG. 21, as the image forming apparatus is requested to output images by an unshown personal computer or the like, the photoconductive drum 1 begins to be rotated (301), and the rotary 22*x* begins to be rotated to bring the developing device 22*a* for a first color to the development station in which the developing device 22*a* opposes the photoconductive drum 1 (302). As the developing device 22*a* for a first color arrives at the location at which the developing device 22*a* opposes the photoconductive drum 1, the development roller begins to be rotated to be prepared for image formation, and then, the image formation process for forming the image of a first color is started (303).

The voltage supply from the development bias power source 19 and blade bias power source 20 is started at the same time as the rotary 22*x* begin to be rotated, ensuring that the development roller is supplied with power (304, 305). The voltages supplied from the development bias power source 19 and blade bias power source 20 at this time are approximately −300 V and −600 V, respectively. The length of time −600 V is supplied from the blade bias power source 20 is 500 msec, and after the elapse of 500 msec, the output of the blade bias power source 20 is switched to −300 V, which is the same as the potential of the development bias power source 19 (306). The control section 21 of the main assembly of the image forming apparatus has the function of controlling the values of the voltages applied from the development bias power source 19 and blade bias power source 20 and the application timing.

The image is formed on the photoconductive drum 1 between when the photoconductive drum 1 begins to be exposed by the exposing device 3 (307) and when the exposure of the photoconductive drum 1 is stopped (308). During this period, or the image formation period, the development roller and development blade are kept virtually the same in potential.

As the period, in which the image of a first color is formed, ends, the preparatory post-rotation period for the developing device, in which development roller is rotated, begins. During this period, −600 V is continuously applied from the blade bias power source 20 (309). Then, the rotation of the development roller 8*a* is stopped, ending the image formation process for a first color (310), and the rotary is rotated to prepare for the image formation process for a second color (magenta) (311). In order to ensure that potential difference is created between the development roller 8*b* and development blade 9*b* when the development roller 8*b* for a second color (magenta) begins to be rotated, the voltage application from the development blade power source and blade bias power source is continued.

As the developing device 22*b* for a second color (magenta) arrives at the location at which developing device 22*b* opposes the photoconductive drum 1, the rotation of the rotary is stopped.

Then, the preparatory pre-rotation of the development roller 8*b* is started, and the image formation process for a second color is carried out as was that for the first color. Thereafter, image formation sequences similar to the above described image formation sequences are carried out for third and fourth colors.

As the image formation process for the fourth color ends, the rotation of the development roller 22*d* is stopped; the power supply to the development blade power source and blade bias power source is turned off (312*a*–312*c*); and the rotary is rotated (313).

As the rotation of the rotary ends, the preparatory post-rotation of the intermediary transfer member 24, photoconductive drum 1, etc., of the apparatus main assembly is started. Then, the rotation of the photoconductive drum 1 is stopped at the end of the preparatory post-rotation period for the apparatus main assembly (314).

When the image formation sequence in this embodiment was carried out by the full-color printer depicted in FIG. 5, toner did not leak at the beginning of the development roller rotation, and images which did not suffer from the abnormally low density and unwanted vertical streaks traceable to the adhesion of toner particles to the development blade were reliably obtained. Further, the labor required of personnel involved in the various maintenance works can be substantially reduced by transforming the developing means, inclusive of toner, which wears out faster than the other components of the image forming apparatus, into a process cartridge removably mountable in the image forming apparatus main assembly.

(Embodiment 10)

Figure 22:
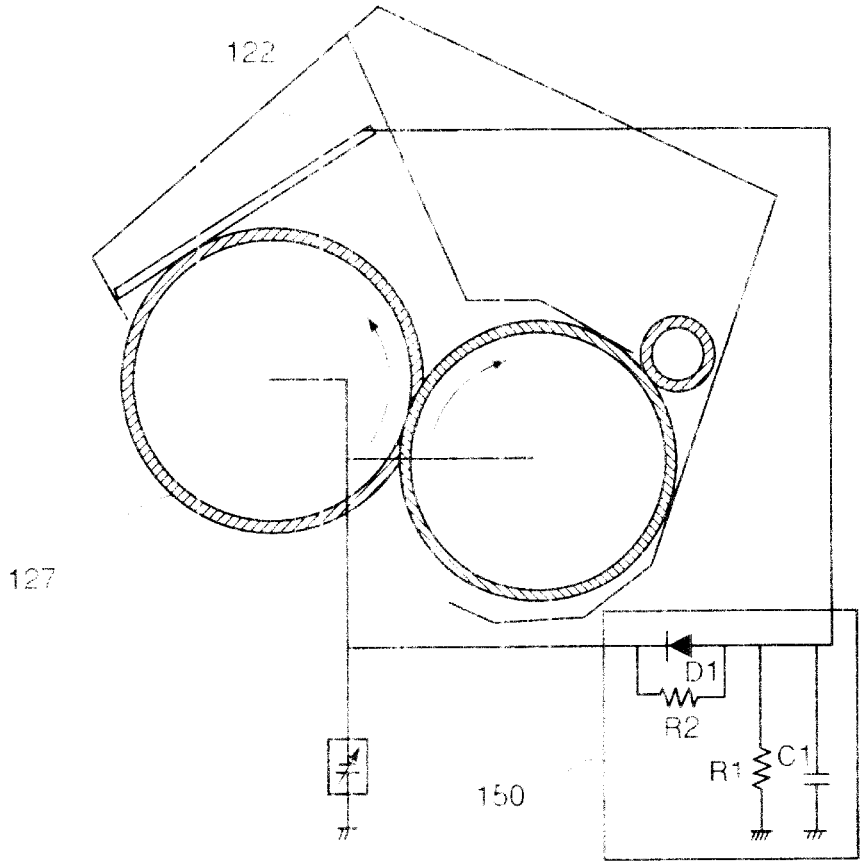
FIG. 22 is a diagram of the voltage attenuation retardation circuit in the tenth embodiment of the present invention.

Next, the image forming apparatus in this tenth embodiment of the present invention will be described. FIG. 22 is a schematic drawing of the image forming apparatus in the tenth embodiment of the present invention, for showing the structures of the essential portions thereof. This image forming apparatus is virtually the same as the image forming apparatus depicted in FIG. 14. Therefore, it will not be described here, except for its circuit for retarding voltage attenuation, which is different from the one shown in FIG. 11.

Referring to FIG. 22, in the case of the voltage attenuation regarding circuit 50 in this tenth embodiment, a resistor $R_2$ is disposed in parallel to a diode $D_1$. The resistance value of the resistor $R_2$ is 100 MΩ. Further, the specifications of the other components are as follows: D1: 0.1A at 2 kV; C1: 2,200 pF at 2 kV; and R1: 100 MΩ at 2 kV. These specifications, however, are not mandatory.

More specifically, it has been confirmed that in the case of an image forming apparatus in accordance with the prior art, the electrostatic capacity between the above described development roller 127 and the development blade 122 formed of electrically conductive metal, with the presence of a toner layer between them, and electrical load thereof, remain within the approximately the same range as long as the ambient conditions remain the same. However, it is possible that under certain conditions, the electrostatic capacity and electrical load will not always remain in the aforementioned range. In particular, the above described load characteristics drastically deteriorate in a high temperature/high humidity environment, or a low temperature/low humidity environment.

Thus, in this tenth embodiment, in order to keep stable the characteristics of the load between the development roller 127 and development blade 122 even in the above described various adverse environments, the resistor $R_2$ is disposed between the cathode and anode of the diode $D_1$, that is, the between the contact of the development roller 127 and the contact of the development blade 122.

Further, with the absence of the effects from the voltage waveform, the characteristic of this image formation sequence is equivalent to the characteristic of the image formation sequence of the image forming apparatus FIG. 11, and the same effects can be obtained.

As described above, according to this embodiment, the following control is executed while the development roller is rotated: During the image formation period, the development roller and development blade are kept virtually the same in potential, whereas during a part of the non-image formation period, potential difference is provided between the development roller and development blade by raising the potential of the development blade while keeping the polarities of the development roller and development blade on the same side as that of the developer. In addition, the means (circuitry) for retarding the voltage attenuation remains more stable even if the load placed upon the circuitry varies due to changes in the ambient factors. Therefore, it is possible to provide an image forming apparatus, in which the external toner additive does not adheres to the development blade even when changes occur to the operational environment of the apparatus; in other words, it is possible to provide an image forming apparatus which does not form images suffering from the insufficient density and unwanted vertical streaks traceable to the adhesion of the external toner additive to the development blade.

(Embodiment 11)

Figure 23:
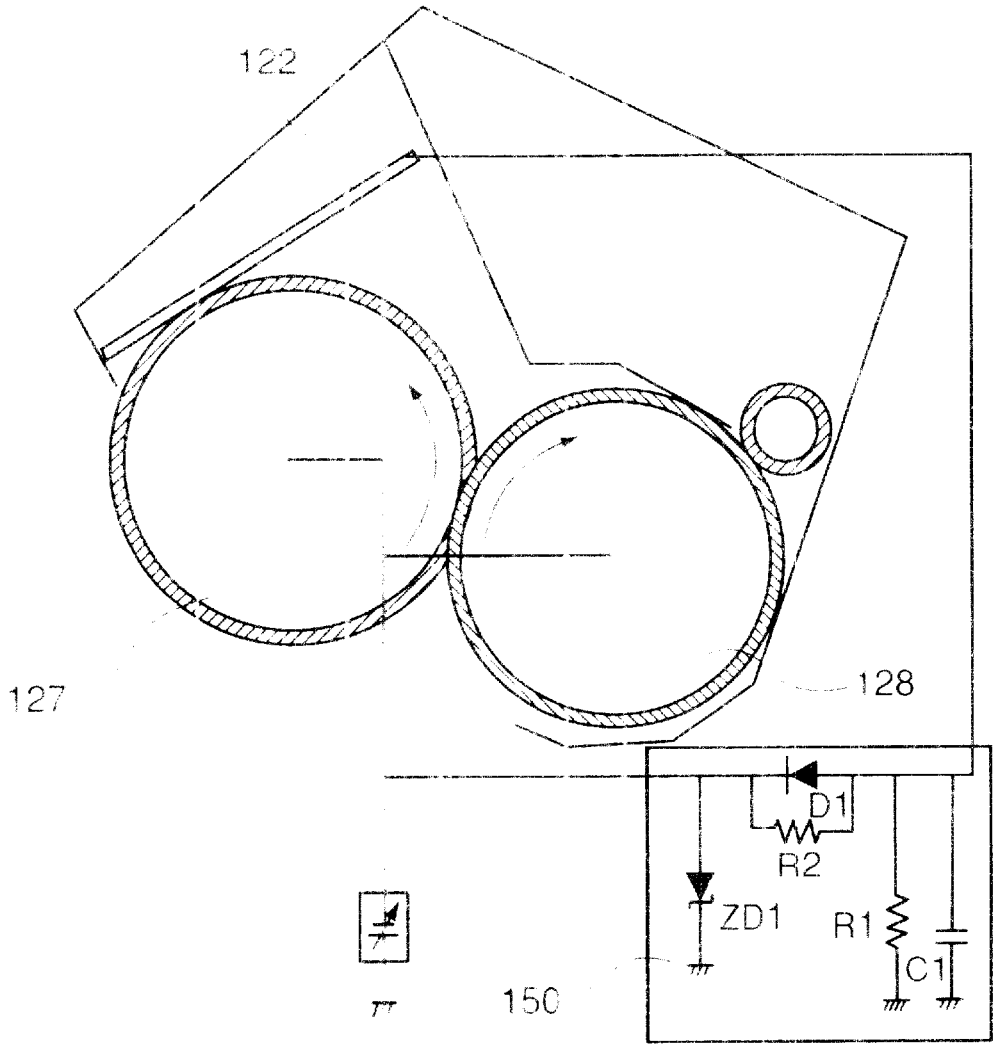
FIG. 23 is a diagram of the voltage attenuation retardation circuit in the eleventh embodiment of the present invention.

Next, the eleventh embodiment of the present invention will be described. FIG. 23 is a schematic drawing of the image forming apparatus in this eleventh embodiment, for showing the structures of the essential portions of the apparatus. The image forming apparatus is virtually identical to the apparatus shown in FIG. 14, except for its voltage attenuation retarding circuit. Therefore, it will not be described, except for the voltage attenuation retarding circuit, which is a modified version of the circuit shown in FIG. 11.

Referring to FIG. 23, the voltage attenuation retarding circuit 50 of the image forming apparatus in the eleventh embodiment is virtually identical to the voltage attenuation retardation circuit 50 in the tenth embodiment, except for the addition of a Zener diode $ZD_1$. The specification of this Zener diode $ZD_1$ in this embodiment is 800 V.

It is thought that the amount of the overshoot by the voltage applying means in the image forming apparatuses in the preceding embodiments is thought to be affected by the variance among the voltage applying means for generating voltage, for example, a transformer (unshown). Thus, the Zener diode $ZD_1$ is employed to keep the amount of the overshoot within the desired voltage range.

Further, the provision of the resistor $R_2$, as is in the voltage attenuation retardation circuit 50 in the tenth embodiment, makes it possible to provide the same effects as those provided by the voltage attenuation retardation circuit 50 in the tenth embodiment, in addition to the characteristic effects of this eleventh embodiment.

Further, according to this embodiment, it is possible to more accurately control the voltage applied in order to create potential difference between the development roller and development blade while the development roller is rotated. Therefore, it is possible to minimize the overshoot for which the variance among the voltage applying means is responsible. Further, during the image formation period, the development roller and development blade are kept virtually the same in potential, whereas during a part of the non-image formation period, potential difference is provided between the development roller and development blade by raising the potential of the development blade while keeping the polarities of the development roller and development blade on the same side as that of the developer. In addition, the means (circuitry) for retarding the voltage attenuation is made to remain more stable even if the load placed upon the circuitry varies due to the changes among the ambient factors. Therefore, it is possible to provide an image forming apparatus, in which the external toner additive does not adheres to the development blade even when changes occur to the operational environment of the apparatus; in other words, it is possible to provide an image forming apparatus which does not form images suffering from the insufficient density and unwanted vertical streaks traceable to the adhesion of the external toner additive to the development blade.

As described above, according to the present invention, it is possible to prevent developer from solidly adhering, and welding, to a developer regulating member. Therefore, it is possible to prevent the formation of images suffering from the insufficient density and unwanted vertical streaks traceable to the developer adhesion and welding to a developer regulating member. Therefore, it is possible to reliably form satisfactory images for a long period of time.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus comprising:

a developer carrying member for carrying a developer to develop an electrostatic image formed on an image bearing member with the developer;

a developer regulating member for regulating an amount of the developer carried on said developer carrying member; and control means for controlling a potential difference between said developer carrying member and said developer regulating member such that the potential difference is larger in at least a part of a non-developing operation than in a developing operation, when said developer carrying member carries the developer.

2. An apparatus according to claim 1, wherein a potential applied to said developer regulating member is larger than a potential applied to said developer carrying member, toward a polarity of a regular charging polarity of toner in the developer.

3. An apparatus according to claim 1, wherein a potential applied to said developer regulating member has a polarity which is the same as a regular charging polarity of toner in the developer, and an absolute value of the potential applied to said developer regulating member is larger than an absolute value of a potential applied to said developer carrying member.

4. An apparatus according to claim 1, wherein the potential difference in the part of the non-developing operation is in a range of 60–500 V.

5. An apparatus according to claim 1, wherein the developer contains toner particles and auxiliary particles which are externally added thereto and which have a charging polarity opposite to a polarity of the toner particles.

6. An apparatus according to claim 5, wherein the toner has a shape factor SF-1 in a range of 100–160, and a shape factor SF-2 in a range of 100–140.

7. An apparatus according to claim 6, wherein the toner is non-magnetic.

8. An apparatus according to claim 1, further comprising a single voltage applying means for applying a voltage to said developer carrying member and said developer regulating member, and a voltage attenuation retarding circuit for delaying a voltage applied to said developer regulating member, wherein the applied voltage is changed to said voltage applying means, and a change of the applied voltage is delayed by said voltage delaying attenuation regarding circuit.

9. An apparatus according to claim 8, wherein said voltage applying means applies a voltage, which is higher when the applied voltage is changed than when the developing operation is carried out.

10. An apparatus according to claim 8, wherein the potential difference in the part of the non-developing operation is produced by an impulse-like application of the voltage by said voltage applying means.

11. An apparatus according to claim 8, wherein a plurality of said developer carrying members and said developer regulating members are provided, and said apparatus further comprises a plurality of electrode contact portions for applying voltages to said developer carrying members and said developer regulating members.

12. An apparatus according to claim 11, wherein said developer carrying members and said developer regulating members are provided in developing devices, respectively, and said apparatus further comprises a developing device holding member for rotatably holding said developing devices.

13. An apparatus according to claim 1, wherein the part of the non-developing operation includes an instance when a rotation of said developer carrying member starts.

14. An apparatus according to claim 1, wherein said developer carrying member has a surface resistance value in a range of $8\times10^5$–$1\times10^{12}$ Ohm, and a resistance value with respect to a thickness direction in a range of $3\times10^5$–$5\times10^8$ Ohm.

15. An apparatus according to claim 14, wherein the surface resistance value is larger than the resistance value with respect to the thickness direction by at least one order.

16. An apparatus according to claim 1, wherein said developer carrying member and said developer regulating member are provided in a cartridge, which is detachably mountable to a main assembly of an image forming apparatus.

17. An apparatus according to claim 8, wherein said developer carrying member, said developer regulating member, and said voltage attenuation retarding circuit are provided in a cartridge detachably mountable to a main assembly of an image forming apparatus.

18. A developing apparatus comprising:

a developer carrying member for carrying a developer to develop an electrostatic image formed on an image bearing member with the developer;

a developer regulating member for regulating an amount of the developer carried on said developer carrying member; and control means for controlling a potential difference between said developer carrying member and said developer regulating member, said control means providing a substantially zero potential difference during a developing operation, and providing a non-zero potential difference in at least a part of a non-developing operation, when said developer carrying member carries the developer.

19. An apparatus according to claim 18, wherein a potential applied to said developer regulating member is larger than a potential applied to said developer carrying member, toward a polarity of a regular charging polarity of toner in the developer.

20. An apparatus according to claim 18, wherein a potential applied to said developer regulating member has a polarity, which is the same as a regular charging polarity of toner in the developer, and an absolute value of the potential applied to said developing regulating member is larger than an absolute value of a potential applied to said developer carrying member.

21. An apparatus according to claim 18, wherein said the non-zero potential difference is in a range of 60–500 V.

22. An apparatus according to claim 18, wherein the developer contains toner particles and auxiliary particles, which are externally added thereto and which have a charging polarity opposite to a polarity of the toner particles.

23. An apparatus according to claim 22, wherein the toner has a shape factor SF-1 in a range of 100–160, and a shape factor SF-2 in a range of 100–140.

24. An apparatus according to claim 23, wherein said the toner is a non-magnetic toner.

25. An apparatus according to claim 18, further comprising a single voltage applying means for applying a voltage to said developer carrying member and said developer regulating member, and a voltage attenuation regarding circuit for delaying a voltage applied to said developer regulating member, wherein the applied voltage is changed by said voltage applying means, and a change of the applied voltage is delayed by said voltage attenuation retarding circuit.

26. An apparatus according to claim 25, wherein said voltage applying means applies a voltage, which is higher when the applied voltage is changed than when the developing operation is carried out.

27. An apparatus according to claim 25, wherein the non-zero potential difference is produced by an impulse-like application of the voltage by said voltage applying means.

28. An apparatus according to claim 25, wherein a plurality of said developer carrying members and said developer regulating members are provided, and said apparatus further comprises a plurality of electrode contact portions for applying voltages to said developer carrying members and said developer regulating members.

29. An apparatus according to claim 28, wherein said developer carrying members and said developer regulating members are provided in developing devices, respectively, and said apparatus further comprises a developing device holding member for rotatably holding said developing devices.

30. An apparatus according to claim 18, wherein the at least a part of the non-developing operation includes an instance when a rotation of said developer carrying member starts.

31. An apparatus according to claim 18, wherein said developer carrying member has a surface resistance value in a range of $8\times10^5$–$1\times10^{12}$ Ohm, and a resistance value with respect to a thickness direction in a range of $3\times10^5$–$5\times10^8$ Ohm.

32. An apparatus according to claim 31, wherein the a surface resistance value is larger than a resistance value with respect to a thickness direction by at least one order.

33. An apparatus according to claim 18, wherein said developer carrying member and said developer regulating member are provided in a cartridge which is detachably mountable to a main assembly of an image forming apparatus.

34. An apparatus according to claim 25, wherein said developer carrying member, said developer regulating member, and said voltage attenuation retarding circuit are provided in a cartridge detachably mountable to a main assembly of an image forming apparatus.

35. An image forming apparatus comprising:

an image bearing member;

a developer carrying member for carrying a developer to develop an electrostatic image formed on said image bearing member with the developer;

a developer regulating member for regulating an amount of the developer carried on said developer carrying member; and control means for controlling a potential difference between said developer carrying member and said developer regulating member such that potential difference is larger in at least a part of non-image-forming operation than in an image forming operation when said developer carrying member carries the developer.

36. An image forming apparatus comprising:

an image bearing member;

a developer carrying member for carrying a developer to develop an electrostatic image formed on said image bearing member with the developer;

a developer regulating member for regulating an amount of the developer carried on said developer carrying member; and control means for controlling a potential difference between said developer carrying member and said developer regulating member, and said control means providing a substantially zero potential difference during an image forming operation, and providing a non-zero potential difference in at least a part of a non-image-forming operation, when said developer carrying member carries the developer.

* * * * *

UNITED STATES PATENT AND TRADEMARK OFFICE

CERTIFICATE OF CORRECTION

PATENT NO. : 6,751,423 B2
DATED : June 15, 2004
INVENTOR(S) : Katsuhiro Sakaizawa et al.

It is certified that error appears in the above-identified patent and that said Letters Patent is hereby corrected as shown below:

Drawings,
Sheet 9, “BLADE-REFLESH” should read -- BLADE-REFRESH --; and “POST-ROT BLADEREFLESH” should read -- POST-ROT BLADE-REFRESH --.

Column 3,
Line 52, “follow” should read -- following --.

Column 5,
Line 63, “of reliably” should read -- of a reliable --.

Column 7,
Line 66, “time” should read -- times --.

Column 9,
Line 48, “range,” should read -- ranges, --.

Column 11,
Line 14, “means” should read -- mean --.

Column 12,
Line 2, “means” should read -- mean --.

Column 14,
Line 18, “JISBO601” should read -- JISB0601 --; and
Line 36, “hard,” should read -- hand, --.

Column 15,
Line 29, “plate to” should read -- plate-to- --;
Line 30, “be pulled out,” should read -- be-pulled-out, --; and
Line 55, “to” should read -- to be --.

Column 16,
Line 3, “means” should read -- mean --.

Column 18,
Line 32, “may” should read -- may be --;
Line 43, “limited” should read -- limit --; and
Line 60, “is” should be deleted.

Column 19,
Line 4, “examine” should read -- examining --.

UNITED STATES PATENT AND TRADEMARK OFFICE

CERTIFICATE OF CORRECTION

PATENT NO. : 6,751,423 B2
DATED : June 15, 2004
INVENTOR(S) : Katsuhiro Sakaizawa et al.

It is certified that error appears in the above-identified patent and that said Letters Patent is hereby corrected as shown below:

Column 20,
Line 4, “calory” should read -- calorie --.

Column 30,
Line 35, “with a” should read -- with --.

Column 31,
Line 32, “desired-to” should read -- desired to --; and
Line 47, “is” should be deleted.

Column 32,
Line 2, “rotate,” should read -- rotates, --; and
Line 40, “desired to” should read -- desired to be --.

Column 35,
Line 4, “through” should read -- though --.

Column 39,
Line 11, “actually” should read -- actual --; and
Line 47, “charge” should read -- charged --.

Column 40,
Line 37, “migrated” should read -- migrate --.

Column 42,
Line 67, “are” should read -- is --.

Column 43,
Line 32, “the-development” should read -- the development --.

Column 44,
Line 36, “attenuate” should read -- attenuates --; and
Line 40, “charge” should read -- charged --.

Column 45,
Line 33, “charge” should read -- charged --.

Column 47,
Line 23, “images” should read -- image --.

UNITED STATES PATENT AND TRADEMARK OFFICE

CERTIFICATE OF CORRECTION

PATENT NO. : 6,751,423 B2
DATED : June 15, 2004
INVENTOR(S) : Katsuhiro Sakaizawa et al.

It is certified that error appears in the above-identified patent and that said Letters Patent is hereby corrected as shown below:

Column 48,
Line 4, “prevent” should read -- present --;
Line 41, “Stoner” should read -- toner --; and
Line 58, “creating” should read -- create --.

Column 51,
Line 9, “leaks” should read -- leak --; and
Line 12, “-300” should read -- -300V --.

Column 52,
Line 38, “22x begin” should read -- 22x begins --.

Column 54,
Line 31, “adheres” should read -- adhere --.

Column 55,
Line 19, “adheres” should read -- adhere --.

Column 56,
Line 16, “delaying” should be deleted.

Column 57,
Line 19, “said” should be deleted.

Column 58,
Line 10, “the” should be deleted.

Signed and Sealed this

Twelfth Day of October, 2004

JON W. DUDAS
*Director of the United States Patent and Trademark Office*